United States Patent [19]

Murray et al.

[11] 3,976,272

[45] Aug. 24, 1976

[54] CONTROL SYSTEM FOR RAILROADS

[75] Inventors: John R. Murray; Harvey W. Heer, both of Rochester; Larry G. Carswell, Fairport, all of N.Y.

[73] Assignee: General Signal Corporation, Rochester, N.Y.

[22] Filed: Nov. 18, 1974

[21] Appl. No.: 525,039

[52] U.S. Cl. ..... 246/5; 235/150.24; 246/3

[51] Int. Cl.[2] ..... B61L 27/00

[58] Field of Search ..... 246/2 R, 3, 4, 5, 122, 246/124; 340/147 P; 235/150.24

[56] References Cited

UNITED STATES PATENTS

| | | | |
|---|---|---|---|
| 3,079,494 | 2/1963 | Preston | 246/5 |
| 3,219,815 | 11/1965 | Livingston | 246/5 |
| 3,836,768 | 9/1974 | Clarke et al. | 246/3 |

FOREIGN PATENTS OR APPLICATIONS

| | | | |
|---|---|---|---|
| 2,114,608 | 10/1972 | Germany | 235/150.24 |

*Primary Examiner*—Trygve M. Blix
*Assistant Examiner*—Reinhard J. Eisenzopf
*Attorney, Agent, or Firm*—Pollock, Vande Sande & Priddy

[57] ABSTRACT

A traffic control system for governing from a central office train control equipment such as track switches and track signals which are disposed along a stretch of railroad track. The control system is flexible in that it can operate with either the CTC (unit lever) type of control wherein the operator designates the particular condition or position of track switches and track signals, or in an NX mode wherein the operator merely designates a particular entrance and exit for a particular route. The control system offers still further flexibility in enabling the operator to simply initiate a passing move on a stretch of railroad track which includes a siding. Still further flexibility is built into the control system in that it allows the operator to designate conflicting control requests at the same time. After the particular operator selected control requests have been entered the control system checks the validity of the selected control requests in a predetermined sequence. Those control requests which can be properly executed under the existing traffic conditions are transmitted to the field. Those controls which the control system indicates cannot be validly transmitted at the time of entering are maintained pending and, if conditions in the field change such as to make the previously entered controls valid, then these controls are transmitted for execution in the field.

28 Claims, 68 Drawing Figures

17
Communication System
18
MIS System
16
Message System
Field Status Processor
9
8
Tracking
Slotting
7
14
Control Tables
Indication Tables
13
System Tables
12
10
Q-Call
6
Tabular
15
Operator Input
11
Time-Out
NX-CTC Executive
5

FSP Fig. 15A
Update Fig. 15A
PUWBA
PUGBA
PRCBA Fig. 16
PWTBA Fig. 18
ROUTE Fig. 19
TRACK Fig. 20
FAMILY Fig. 21
SLOT Fig. 22
SHROT Fig. 23

| | | Location Of Signal | Code For Q-Call |
|---|---|---|---|
| Selected | Call Out | Recall | 1 |
| | | High QUEUE | 2 |
| | Answer Back | High QUEUE | 3 |
| | | Low QUEUE | 4 |
| | | FSP Buff | 5 |
| | | Unknown | 6 |

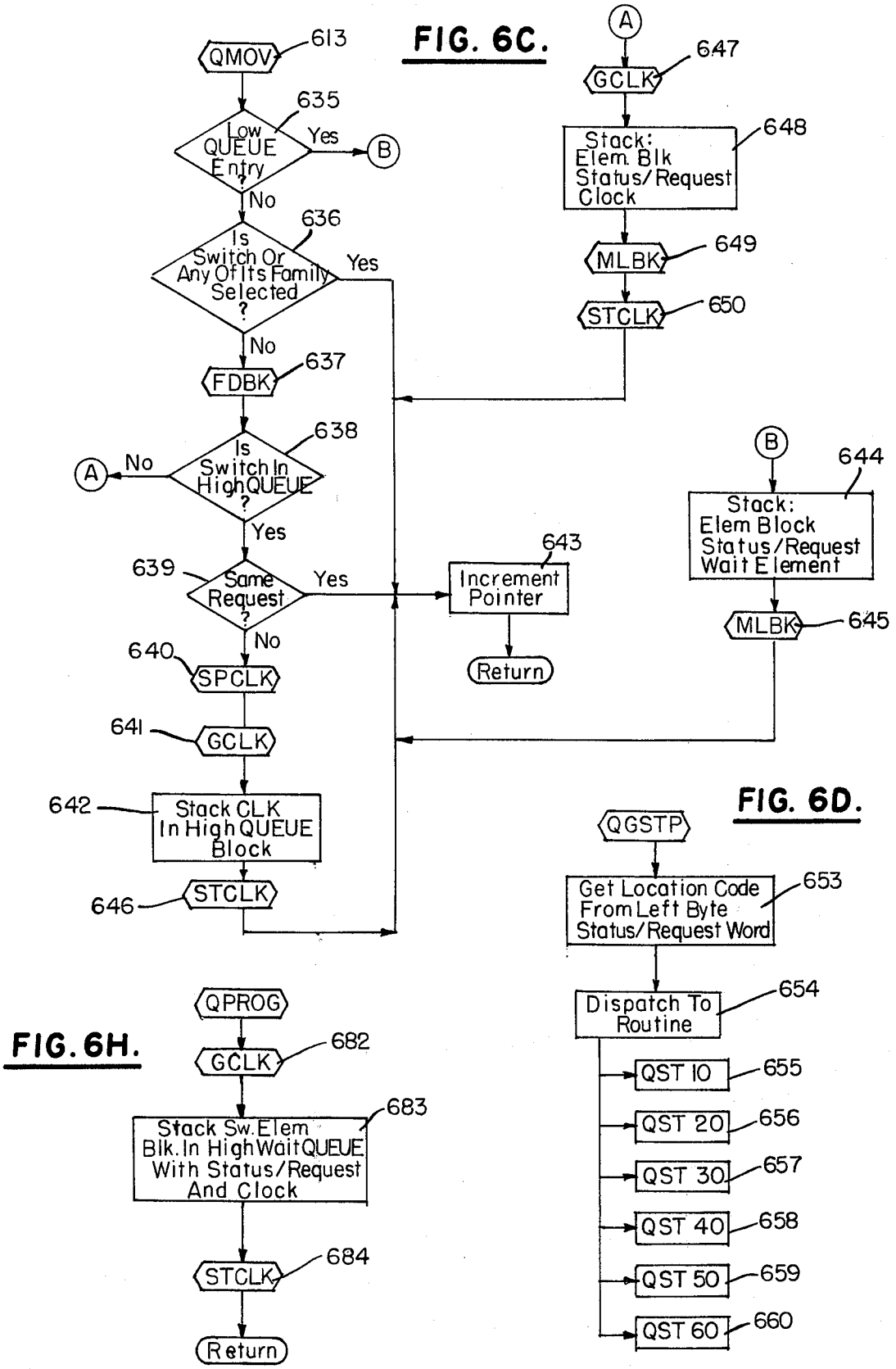
FIG. 6C.
QMOV
613
Low QUEUE Entry ?
635
Yes
B
No
Is Switch Or Any Of Its Family Selected ?
636
Yes
No
FDBK
637
Is Switch In High QUEUE ?
638
No
A
Yes
Same Request ?
639
Yes
No
SPCLK
640
GCLK
641
Stack CLK In High QUEUE Block
642
STCLK
646
Increment Pointer
643
Return
A
GCLK
647
Stack: Elem. Blk Status/Request Clock
648
MLBK
649
STCLK
650
B
Stack: Elem Block Status/Request Wait Element
644
MLBK
645
FIG. 6D.
QGSTP
Get Location Code From Left Byte Status/Request Word
653
Dispatch To Routine
654
QST 10
655
QST 20
656
QST 30
657
QST 40
658
QST 50
659
QST 60
660
FIG. 6H.
QPROG
GCLK
682
Stack Sw. Elem Blk. In High Wait QUEUE With Status/Request And Clock
683
STCLK
684
Return

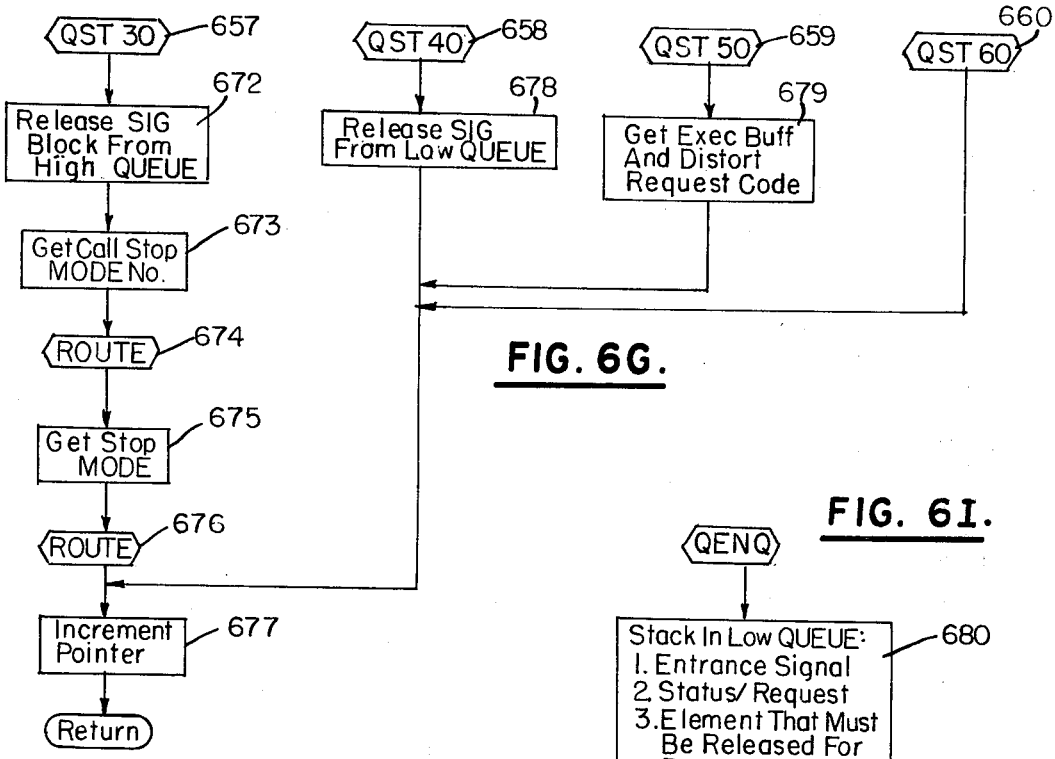
FIG. 6G.
FIG. 6I.
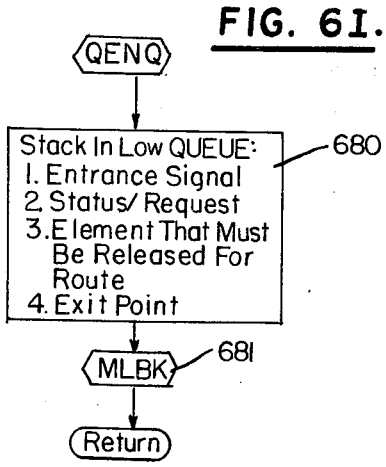
FIG. 7.
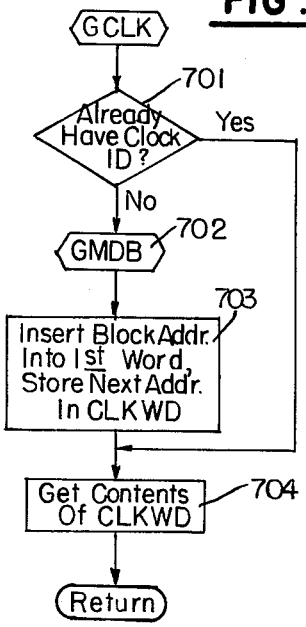
FIG. 8.
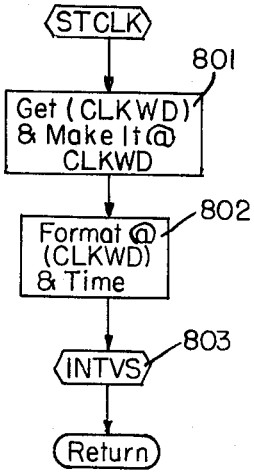
FIG. 9.
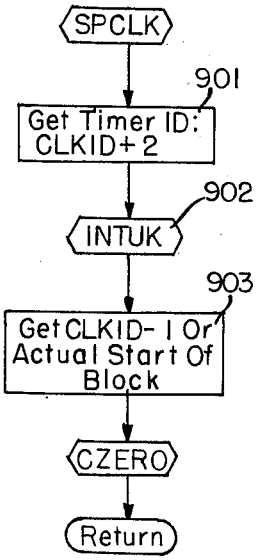
CLKWD: CLK ID Or 0
CLK ID
CLK ID-1
N
Site
Timer ID
-1

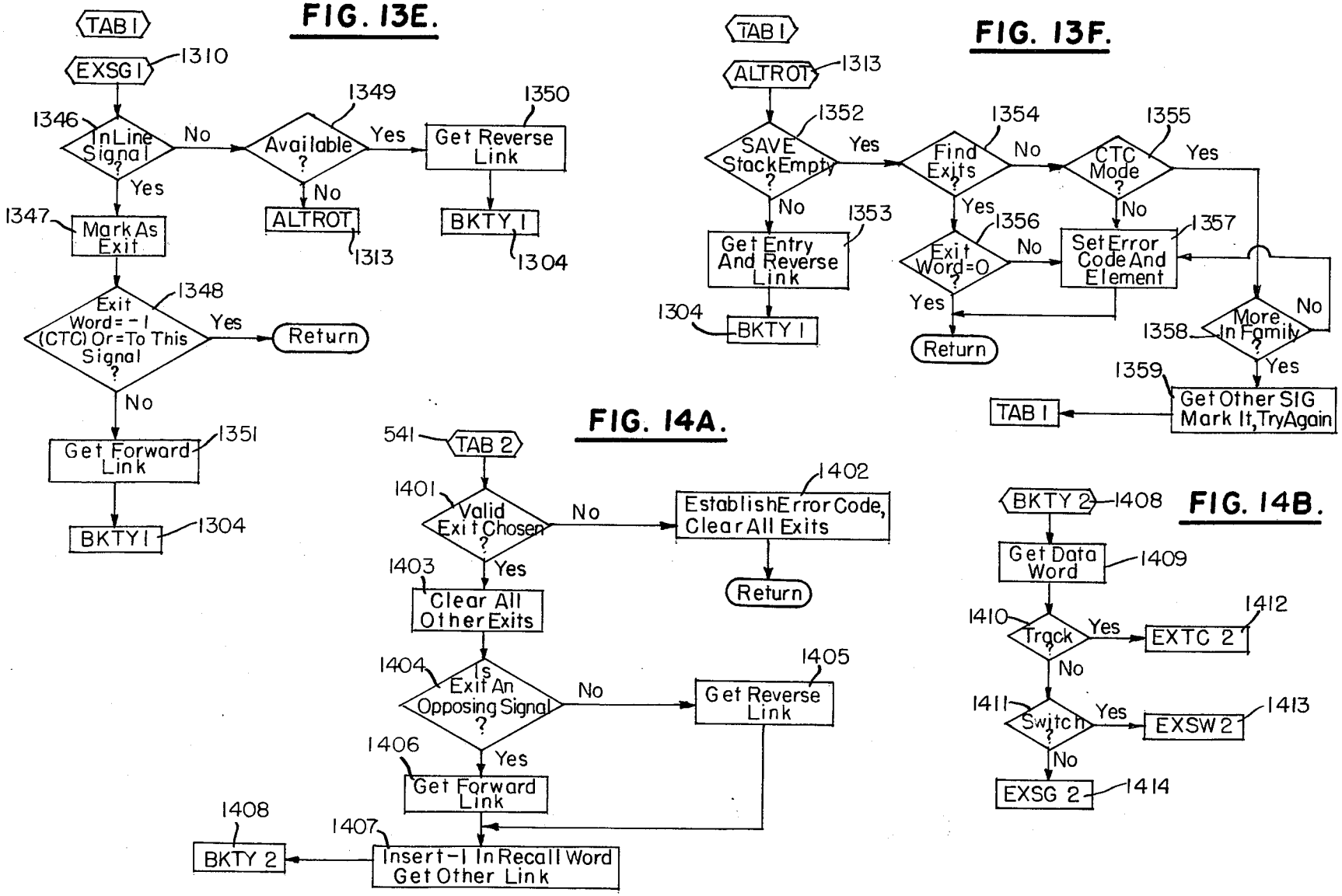
FIG. 13E.
TAB 1
EXSG 1
1310
In Line Signal ?
1346
Yes
No
Mark As Exit
1347
Exit Word = -1 (CTC) Or = To This Signal ?
1348
Yes
No
Return
Get Forward Link
1351
BKTY 1
1304
Available ?
1349
Yes
No
ALTROT
1313
Get Reverse Link
1350
BKTY 1
1304
FIG. 13F.
TAB 1
ALTROT
1313
SAVE Stack Empty ?
1352
Yes
No
Get Entry And Reverse Link
1353
BKTY 1
1304
Find Exits ?
1354
No
Yes
Exit Word = 0 ?
1356
No
Yes
Return
CTC Mode ?
1355
Yes
No
Set Error Code And Element
1357
More In Family ?
1358
No
Yes
Get Other SIG Mark It, Try Again
1359
TAB 1
FIG. 14A.
TAB 2
541
Valid Exit Chosen ?
1401
No
Yes
Establish Error Code, Clear All Exits
1402
Return
Clear All Other Exits
1403
Is Exit An Opposing Signal ?
1404
No
Yes
Get Reverse Link
1405
Get Forward Link
1406
Insert -1 In Recall Word Get Other Link
1407
BKTY 2
1408
FIG. 14B.
BKTY 2
1408
Get Data Word
1409
Track ?
1410
Yes
No
EXTC 2
1412
Switch ?
1411
Yes
No
EXSW 2
1413
EXSG 2
1414

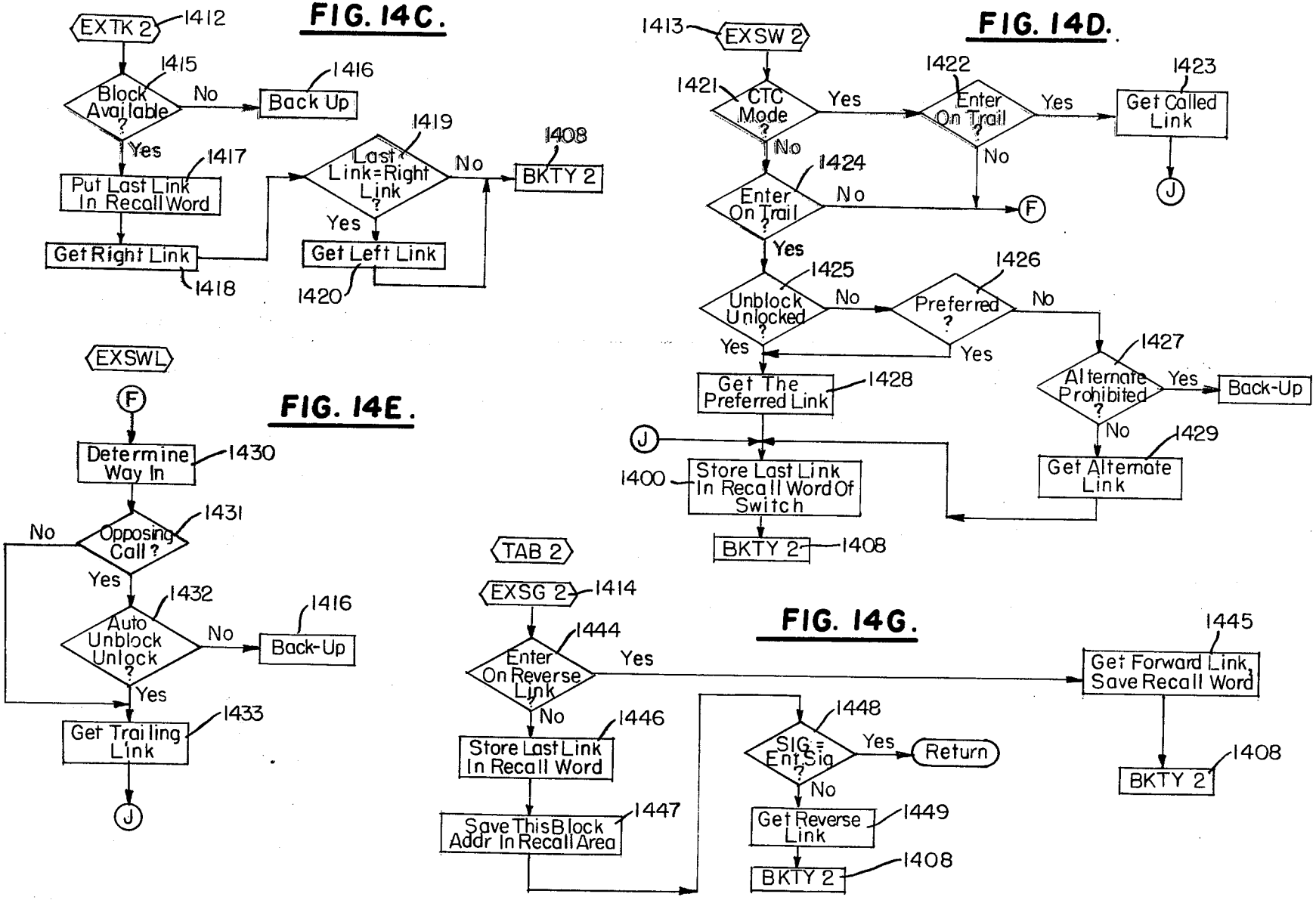
FIG. 14D.
1413
EXSW 2
1421
CTC Mode ?
Yes
No
1422
Enter On Trail ?
Yes
No
1423
Get Called Link
J
1424
Enter On Trail ?
No
Yes
F
1425
Unblock Unlocked ?
No
Yes
1426
Preferred ?
No
Yes
1427
Alternate Prohibited ?
Yes
No
Back-Up
1429
Get Alternate Link
1428
Get The Preferred Link
J
1400
Store Last Link In Recall Word Of Switch
1408
BKTY 2
FIG. 14C.
1412
EXTK 2
1415
Block Available ?
No
Yes
1416
Back Up
1417
Put Last Link In Recall Word
1418
Get Right Link
1419
Last Link=Right Link ?
Yes
No
1420
Get Left Link
1408
BKTY 2
FIG. 14E.
EXSWL
F
1430
Determine Way In
1431
Opposing Call ?
Yes
No
1432
Auto Unblock Unlock ?
No
Yes
1416
Back-Up
1433
Get Trailing Link
J
FIG. 14G.
TAB 2
EXSG 2
1414
1444
Enter On Reverse Link ?
Yes
No
1445
Get Forward Link, Save Recall Word
1408
BKTY 2
1446
Store Last Link In Recall Word
1447
Save This Block Addr In Recall Area
1448
SIG = Ent Sig ?
Yes
No
Return
1449
Get Reverse Link
1408
BKTY 2

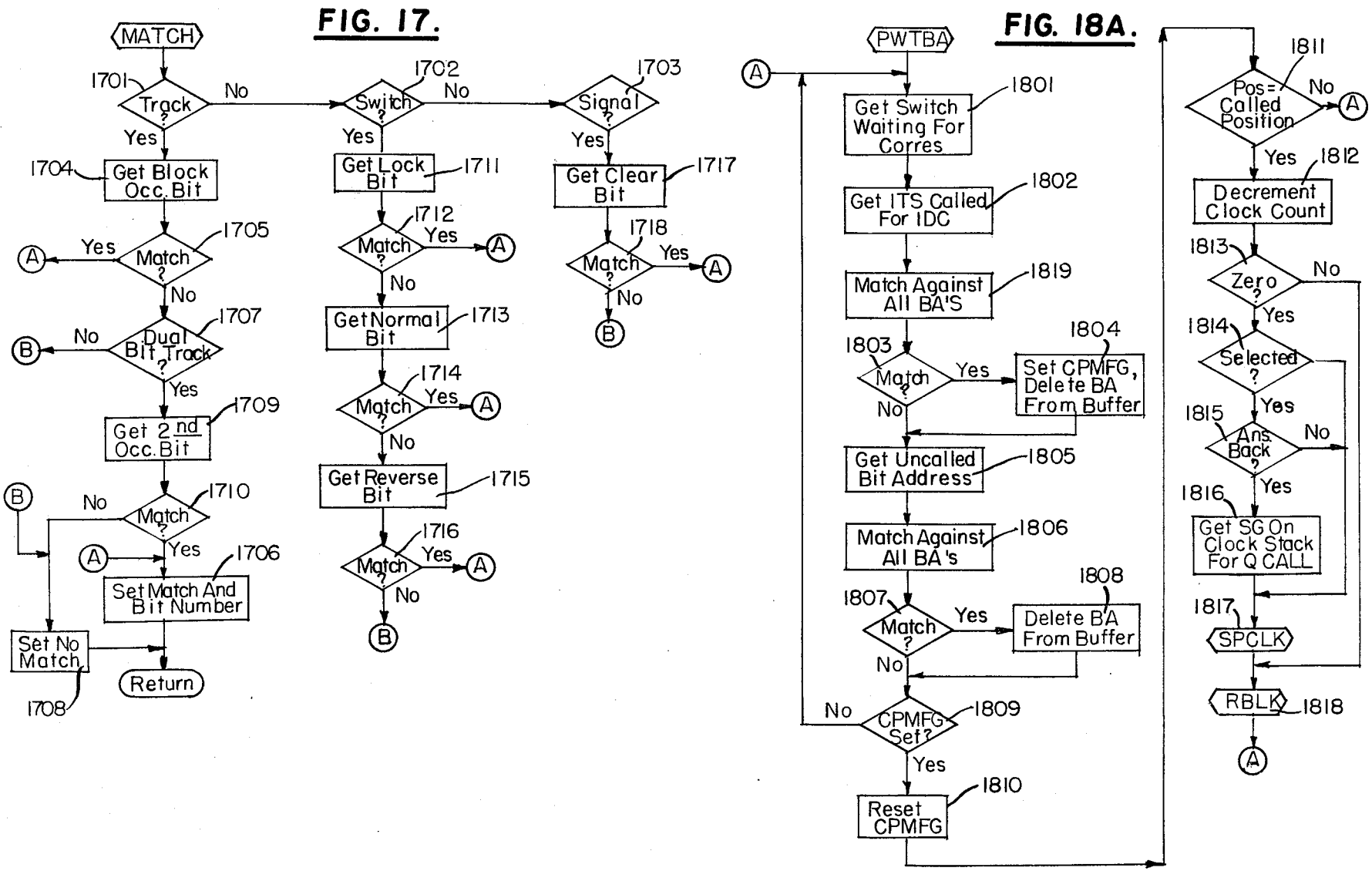
FIG. 18A.
PWTBA
Get Switch Waiting For Corres
1801
Get ITS Called For IDC
1802
Match Against All BA'S
1819
Match ?
1803
Yes
No
Set CPMFG, Delete BA From Buffer
1804
Get Uncalled Bit Address
1805
Match Against All BA's
1806
Match ?
1807
Yes
No
Delete BA From Buffer
1808
CPMFG Set?
1809
Yes
No
Reset CPMFG
1810
Pos= Called Position
1811
No
Yes
Decrement Clock Count
1812
Zero ?
1813
No
Yes
Selected ?
1814
Yes
No
Ans. Back ?
1815
Yes
Get SG On Clock Stack For Q CALL
1816
SPCLK
1817
RBLK
1818
FIG. 17.
MATCH
Track ?
1701
No
Yes
Get Block Occ. Bit
1704
Match ?
1705
Yes
No
Dual Bit Track ?
1707
No
Yes
Get 2nd Occ. Bit
1709
Match ?
1710
No
Yes
Set Match And Bit Number
1706
Set No Match
1708
Return
Switch ?
1702
No
Yes
Get Lock Bit
1711
Match ?
1712
Yes
No
Get Normal Bit
1713
Match ?
1714
Yes
No
Get Reverse Bit
1715
Match ?
1716
Yes
No
Signal ?
1703
Yes
Get Clear Bit
1717
Match ?
1718
Yes
No

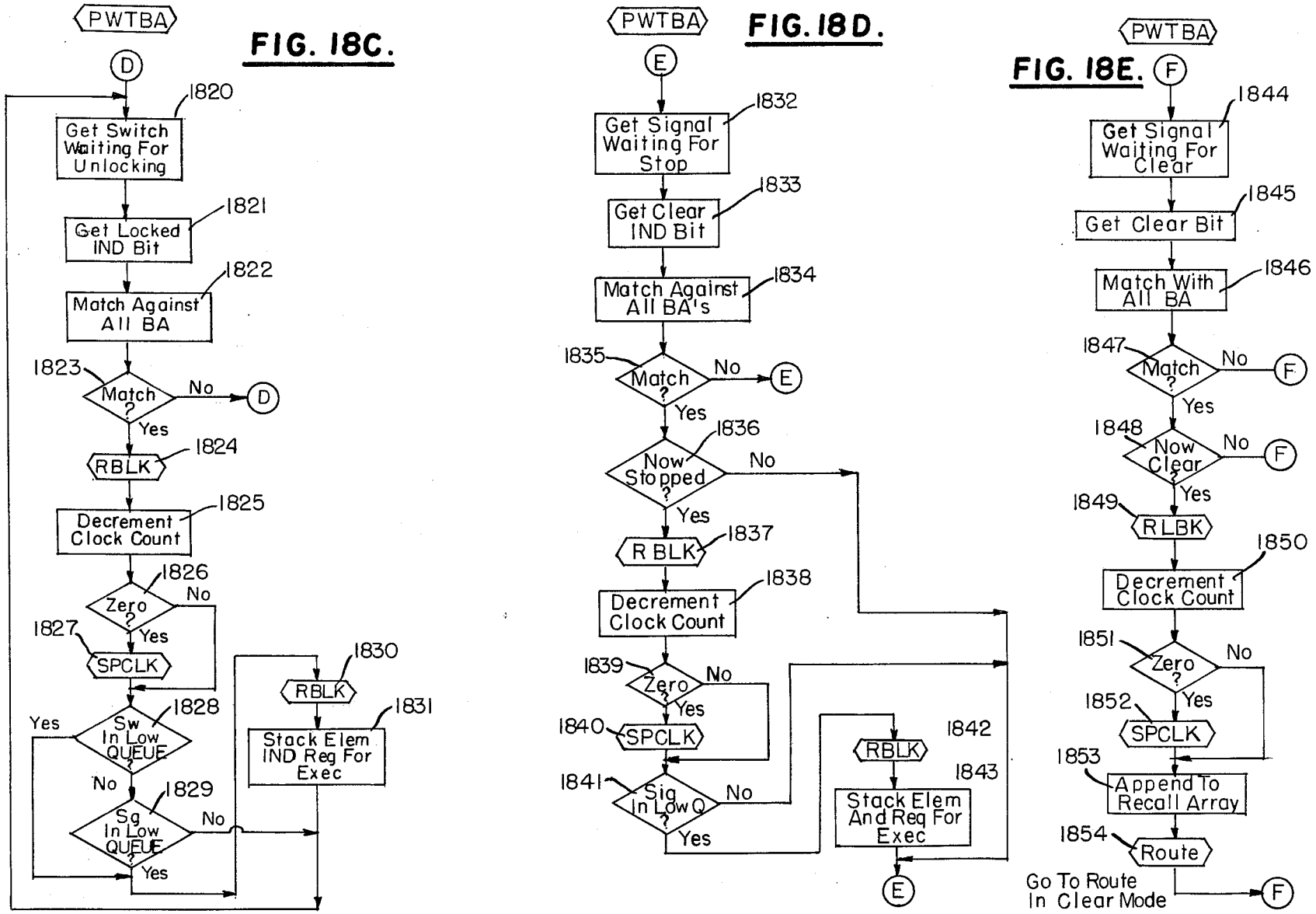
FIG. 18C.
PWTBA
D
1820
Get Switch Waiting For Unlocking
1821
Get Locked IND Bit
1822
Match Against All BA
1823
Match ?
No
D
Yes
1824
RBLK
1825
Decrement Clock Count
1826
Zero ?
No
Yes
1827
SPCLK
1828
Sw In Low QUEUE ?
Yes
No
1829
Sg In Low QUEUE ?
No
Yes
1830
RBLK
1831
Stack Elem IND Reg For Exec
FIG. 18D.
PWTBA
E
1832
Get Signal Waiting For Stop
1833
Get Clear IND Bit
1834
Match Against All BA's
1835
Match ?
No
E
Yes
1836
Now Stopped ?
No
Yes
1837
R BLK
1838
Decrement Clock Count
1839
Zero ?
No
Yes
1840
SPCLK
1841
Sig In Low Q ?
No
Yes
1842
RBLK
1843
Stack Elem And Reg For Exec
E
FIG. 18E.
PWTBA
F
1844
Get Signal Waiting For Clear
1845
Get Clear Bit
1846
Match With All BA
1847
Match ?
No
F
Yes
1848
Now Clear ?
No
F
Yes
1849
RLBK
1850
Decrement Clock Count
1851
Zero ?
No
Yes
1852
SPCLK
1853
Append To Recall Array
1854
Route
F
Go To Route In Clear Mode

| MODE | |
|---|---|
| 0 | Clear |
| 1 | Stop |
| 2 | Call Clear |
| 3 | Call Stop |

CONTROL SYSTEM FOR RAILROADS

FIELD OF THE INVENTION

The present invention relates to control systems and more particularly to a control system for enabling control of a plurality of track switches and signals in a railroad territory.

BACKGROUND OF THE INVENTION

The present invention is an improvement over the Centralized Traffic Control System for Railroads disclosed in U.S. Pat. 3,836,768 to Clarke et al. The disclosure of that patent is incorporated herein by reference.

The referred to Clarke et al patent discloses a centralized traffic control system for railroads which includes a central office from which a railroad territory may be controlled. The central office includes a display, which as disclosed may include one or more CRT displays for displaying traffic conditions along the railroad territory, means for designating operator initiated control requests, such as a keyboard for operator entry of operator selected control requests, communication equipment connecting the central office with a plurality of field stations for the transmission of controls and the reception of indication. At the hub of the control office is a digital computer which is appropriately programmed to accept operator designated control requests, check the validity of those control requests against the status of the field traffic conditions and transmit as controls those control requests which are valid in light of actual field conditions. The computer also drives the CRT displays so as to display the status of field conditions at a selected location in the territory. The control system which comprises the aforementioned Clark et al system is based on the CTC (unit lever) type operation in which the operator designates a particular track switch or particular signal and furthermore designates the condition to which that element is to be controlled. That is, the operator may designate a particular switch and determine that the switch should be in the reverse position, and correspondly he may designate a particular signal to be cleared in a particular direction.

Another method of railroad control, which cannot be implemented with the Clark et al control system is generally referred to as NX. In the NX method of operation the operator may designate an entrance location, which is usually a signal in the railroad territory, and an exit location which also is generally another signal in the railroad territory. The control system then determines at least one possible route for a train traveling between the designated entrance and exit locations and properly lines the track switches in the route and clears the appropriate track signals. Although this method of operation cannot be implemented by the Clark et al control system other prior art systems can implement this method of operation. These prior art systems are generally characterized by the use of relay logic. The advent of the digital computer and the associated technology has made it desirable to implement the NX method of railroad traffic control using the expanded logical capabilities of the digital computer technology. It is thus one object of the present invention to provide a control system for controlling a railroad territory with the NX method of operation employing digital computer technique with the advantages flowing therefrom.

One of the advantages of employing digital computer techniques is the expanded logical capabilities of the system. In any complex railroad territory the NX method of operation is decidedly simpler for the operator in that he merely has to designate an entrance and exit location and need not concern himself with the particular switches and signals between the entrance and exit locations. In the CTC (unit lever) type of operation, as exemplified by the Clarke et al system the operator would have to designate the particular configuration for each track switch in a route and designate a control to clear each track signal in the route.

Furthermore in the NX method of operation there may be a plurality of routes between the selected entrance and exit points. Although some of these possible routes may be prevented by reason of traffic conditions in the field there still may be more than one available route between the entrance and exit locations. The use of digital computer techniques allows the system to select a preferred route, based on preestablished priorities thus enabling preferred route to be automatically selected over other routes which are not preferred.

It is therefore another object of the present invention to provide a railroad traffic control system which operates in the NX method of operation and which will select a preferred route where more than one possible route is available.

The Clark et al system illustrates a control system which employs a CRT display so as to display, to the operator, field conditions including the operated position of the track switches, the condition of the track signals, pending controls which have been transmitted but not yet executed and the occupied condition of sections of track. In an effort to increase the efficiency of railroad operations railroad managements have a desire to monitor the position of particular identified trains. This requires a control system with the ability to designate particularly identified trains and, more important, to track these trains regardless of the direction of their movement and which can cope with the possibility that a particular train may split into two units. With this capability then not only can an operator identify the position of particular identified trains but a record can be made of the movement of the train through the railroad territory for a later use.

Therefore, it is another object of the present invention to provide a railroad control system which has the ability to track particularly identified trains regardless of the movement of the trains, in a forward or reverse direction.

In the Clark et al system control requests which had been entered by the operator, had been checked and found valid, and had been transmitted are selectively displayed on the CRT so as to enable the operator to determine which of the controls he had designated has not yet been executed in the field, although transmitted from the control office. However, this capability is available in the Clark et al system only when the location to which the controls had been directed is being displayed. However, it may be important to the operator to know if controls which had been transmited, have not been executed in the field, regardless of whether or not the particular location to which these controls had been transmitted was continuously being displayed. The lack of execution of these controls may indicate a failure condition in the communication system or in the field and, obviously, this information may be very significant to the operation of the railroad.

It is therefore another object of the present invention to provide a control system for operating a railroad which monitors controls which have been transmitted and provides an indication to the operator when these controls have not been executed within a predetermined time so that the operator may investigate the cause for the failure of execution.

Another corollary of the NX method of operation is that once a route has been selected and controls clearing that route have been transmitted and executed no element in that route may be employed in a conflicting route. That is, each of the elements become protected by the control system. However, as the train for which this route has been selected and cleared traverses the route, those elements in the route behind the train should now be available for other routings inasmuch as they are no longer necessary for the route that had previously been set up. In the aforementioned Clark et al system the operator can determine, by monitoring the CRT display the positions of trains in the territory and thus the availability of elements in the route behind any train. However, this operation obviously requires operator attention and prevents the operator from performing other tasks in that he is required to monitor the display.

It is therefore another object of the present invention to provide a control system for operating a railroad in which conflicting routes may be entered by an operator. Since the routes are conflicting only one of the routes will be effected in the field. The other route or routes will be maintained pending by the control system, and, as the control system, monitoring the travel of a train through a route detects that elements behind the train are available for the previously conflicting route, these elements will be automatically incorporated into the second route and controls to make this effective will be transmitted and executed in the field. None of this operation therefore requires operator attention.

The Clarke et al control system is also characterized by a decision table type processor which is enabled to determine the validity of control requests in light of field conditions. In more detail, the processor of the Clarke et al system comprises a decision table, unique for each field station, which determines what inquiries to make and where the relevant information can be found in order to determine whether or not a particular control request is proper. Since each of the decision tables is unique to any field station any alteration in the field station requires a concommittment alteration to the decision table. However, since the respective field stations are not independent of one another, alteration of one field station may require alteration of decision table not only for that field station but for associated field stations as well. For this reason, variations to the Clark et al control system may be difficult, time consuming and therefore expensive.

It is therefore another object of the present invention to provide a control system which includes both dynamic and static storage components. The dynamic storage components are definitive of the operated conditions of the various railroad elements (such as track section occupancy, track switch position and track signal condition) which make up the railroad, the controls which have been transmitted to the respective railroad elements and the internal status of the element in the processing regime. A static storage portion is provided which is definitive of the railroad elements and the relationship there between. The dynamic and static storage portions corporate with a novel processor means in order to determine whether or not the particular control request is or is not valid in light of actual field conditions. More particularly the processor is independent of the railroad configuration so it need not be altered when field modifications are made. To reflect field changes it is only necessary to alter the static storage elements that correspond to the changed elements. In line with the forgoing, and for purposes for making the terms used in this description clear and definite the following definitions will apply:

Availability - A term applied to each element of a route, an element is deemed available if it has not been selected by another active route, see definitions of railroad element and select, Blocking - One of a number of internal controls, i.e., controls which are not transmitted to the field; this control simulates a selected element such that the element is not available for use in any route, typically blocking would be employed when maintenance was underway on an associated element, see definitions of controls, railroad element and select, Communication Systems - A system for completing the communication link between the central office and each of the remote field stations, the function of the communication system is to assemble controls into a message, address that message to the designated field station and transmit the message, receive indications from each of the field stations, properly schedule transmission, detect communication failures, effect communication retries and signal when indications received from the field indicate that conditions from that field station have changed from a previously received indication, although there are wide variety of communication systems which could be used, one example of the communication system which can be employed is disclosed in the co-pending Dansbach et al application Ser. No. 516,849, filed Oct. 21, 1974 and the Pulverenti et al application Ser. No. 524,901, filed Nov. 18, 1974., see definitions of controls and indications, Control - An order for the repositioning of a track switch or the reconditioning of a track signal in the field, which has been checked by the system and found valid in the light of existing field conditions, generally a control is immediately transmitted to the field and thus those controls which have not yet been transmitted are immediately awaiting transmission, see the definition of valid, Control Request - A request originating at the central office, requesting a variation in the condition of traffic controlling railroad elements in the field, a CTC type of control request is a request for variation in the condition of a track signal or a variation in the position in the track switch or a combination of the foregoing, and NX type request is a request for clearing a route between the designated entrance and exit locations, in the course of operating with NX type of request the system of our invention generates pseudo CTC type request which are necessary to the route, see the definitions of the route, Common Element - A railroad element which is common to a route which has been selected and is also included in a requested route, see the definition of select and railroad element, Dynamic Data or Dynamic Information - That class of information which is expected to change in the ordinary course of operations, examples of dynamic information are controls or indications or any of the data stored in the high Q, low Q and recall, Entrance Location - A location in the railroad territory which may be the beginning of a route, generally a entrance location is an inline signal, Exit Location - A location in the railroad territory which may comprise the exit of a route, generally an exit is an inline signal, High Queue - A memory area in which data is stored, beginning at a predetermined location, which includes a representation of every route in which controls have been conditioned but for which indications have not yet been received that the conditioned controls have become effective in the field, see the definition of indications, control, Indication - Information received via the communication system which originated at a field station indicating a present condition of a track signal, track switch or the occupancy or non-occupancy of a track section, Low Queue - A data storage area beginning at a predetermined location in which is stored representation of all routes which include an element common to another route which has been set up in the field, the identification of the common element is included, Railroad Element - A physical piece of apparatus, the plurality of which make up the operating plant of the railroad, in this application we will be concerned with track switches, track signals and track sections as railroad elements, Recall or Recall Directory - A storage area beginning at a predetermined location which includes stored data of all routes which have been set up in the field and which are waiting passage of a train for which the route has been set up, Recall Word - A separate storage area for each railroad element in which can be stored identification of the next railroad element in a route which has been, or may be set up, Route or Routing - A route is a connected plurality of railroad elements between an entrance location and an exit location, routing also includes a conditioning of controls for proper positioning of track switches which may be included in the route, Select or Selecting - Appropriately storing a designation for each element which is to be included in a route for protecting that element from being included in any other route, Slotting - A procedure whereby railroad elements included in a route become available for other routes after a train has moved passed the railroad element, Valid or Validity - The act or result of determining from a particular control request and the field condition whether or not the control request would result in any potential unsafe conditions, when a control request is deemed valid appropriate controls may be conditioned for transmission to the field, for instance, a control request for a route would be considered valid if none of the elements have been selected and if all switches can be thrown to the position necessary to make the route.

SUMMARY OF THE INVENTION

Our invention comprises a system which meets the forgoing criteria. With the system of our invention CTC (unit lever) requests result in a command string with a different command for each control request. Each of the commands are checked for validity and if found valid may be outputed to the field as controls. The operator may also enter an NX type request in which he merely designates a specified entrance and exit location. In this mode the system determines if the route is achievable, i.e., is it possible to obtain the exit location by starting at the entrance location. The route may be refused if it is not achievable or if traffic conditions or the conditions of intervening elements prohibit the route. The system will first attempt to take a preferred route and alternates will be employed if the preferred route is unavailable. After the route has been determined by the system it will generate a psuedo command string which may result in controls being transmitted to the field to effect the route.

After the controls for a route are transmitted, in either mode, an entry is made in a high Q directory for the route and a timer is set to a predetermined period and started. If the timer expires, indicating that the controls did not become effective in the predetermined period, the system can determine which route the timer was operating on and can thus inform the operator that that particular route has not become available for some reason.

However, assuming that the controls are effected and the route is lined and clear, the system makes an entry in a recall directory for the route. As a train enters the route, indications to that effect are received and a number of actions take place on those indications. When a route is made up in the field, the signals in the route are, of course, caused to clear by conditioning an appropriate control. As the train accepts the route and is detected in the first track section, the signal associated with that section goes to stop, by reason of the control circuits in the field. Thus, when the indication to that effect is received at the control office the control bit for that signal must also be set to stop. Furthermore, the indication of train occupancy must be handled in the track occupancy indication bit for the associated track section. As a train now moves off to the first element or elements in the route, those elements can now be released for inclusion in other routes. As that occurs, the system checks a low Q. This low Q had been filed with routes which were entered by the operator but which were not available by reason of traffic conditions. For instance, a signal or track section included in the route may have been previously selected for another route. When a train travels over the previous route the element becomes available and by noting the low Q directory the system can determine those routes which are awaiting change in traffic conditions. Those routes which now be brought up and processed for the transmission of the proper controls. In addition, the identity of the train which has accepted a route is moved along so that the system has a record of movement of specifically identified trains. Finally, the system shortens the route in the recall area so that on the next operation the beginning of the route is the next forward element which the train has not cleared.

Further flexibility is built into the system by allowing the operator to merely select a site, specify a signal, if necessary and key in a pass. In the NX mode the system generates the psuedo command string from identification of entrance and exit locations. The passing request makes reference to a distinct storage area for each station. At each station there may be a number of routes (usually three) to set up to initiate a passing operation. For the train travelling in a non-preferred direction the first route would be set up over a first switch, in the reverse position, with the route ending just short of the second switch. For the train travelling in the preferred direction a route is set up past both switches, in the normal condition. And finally, a third route is set up for the first train over the second switch in the reverse position. Of course, the second route conflicts with the first and the third route conflicts with the second. In this situation, then, the first route is set up and the second and third routes are held awaiting the train travelling in a non-preferred direction clearing the first switch. As soon as it does, the second route, for the preferred train is now automatically set up. And finally, when the train travelling in the preferred direction clears the second switch the third route can automatically be set up. Thus, the pass key, when a site (and signal, if necessary) is identified allows the system to set up a string of psuedo NX commands in which each operate to provide a psuedo CTC command string.

BRIEF DESCRIPTION OF THE DRAWINGS

In drawings appended to the specification

FIG. 6A is a detailed flow chart of Queue Call;

FIG. 6C is a detailed flow chart of QMOV;

FIGS. 6D, 6E, 6F and 6G are detailed flow charts of QGSTP;

FIG. 6H is a detailed flow chart for QPROG;

FIG. 6I is a detailed flow chart for QENRQ;

FIG. 7 is a detailed flow chart for GCLK;

FIG. 8 is a detailed flow chart for STCLK;

FIG. 9 is a detailed flow chart for SPCLK;

FIGS. 13A, 13B, 13C, 13D, 13E and 13F comprise a detailed flow chart of TAB I which includes the subroutines BLKTY I, EXTK I, EXSW I and ALTROT;

FIGS. 14A, 14B, 14C, 14D, 14E, 14F and 14G are detailed flow charts of TAB II which includes BKTY II, EXTK II, EXSW II, EXSG II and BACKUP;

FIG. 17 is a detailed flow chart of MATCH;

FIGS. 18A, 18C, 18D and 18E are detailed flow charts of PWTBA;

DETAILED DESCRIPTION OF A PREFERRED EMBODIMENT

Figure 1:
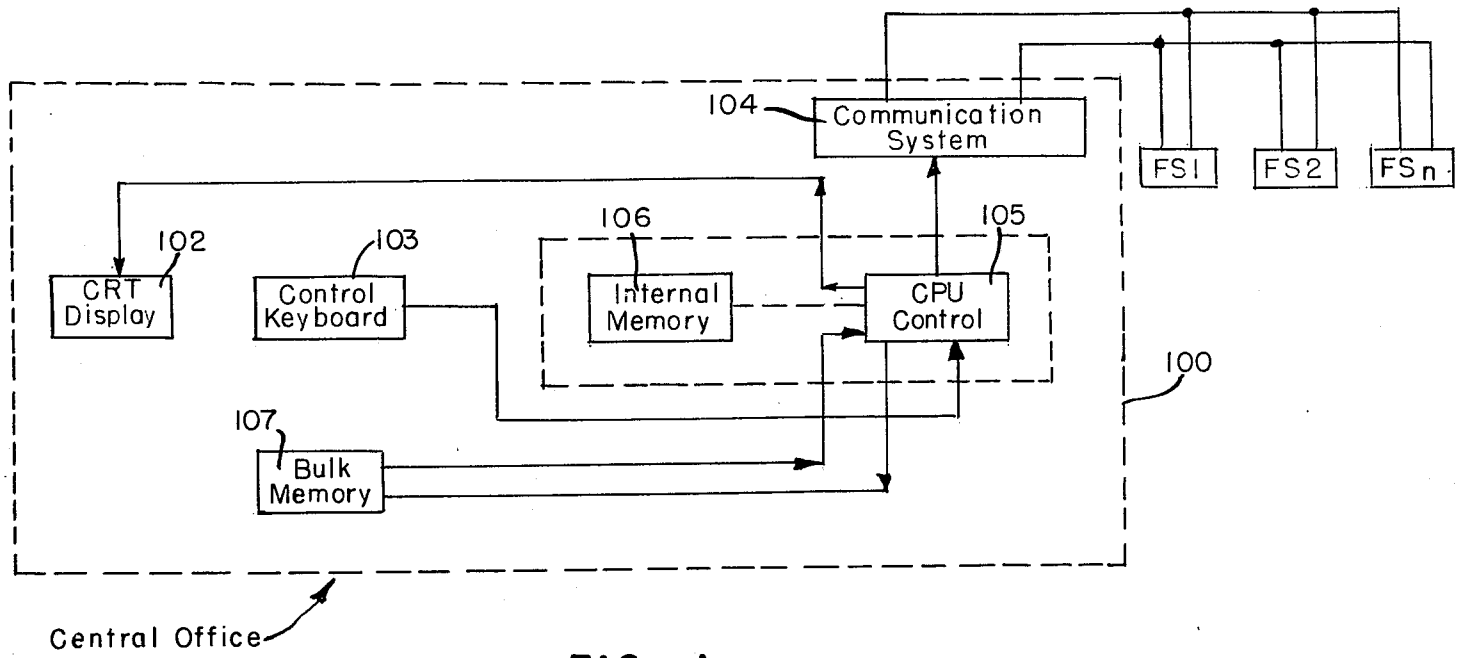
FIG. 1 is a block diagram of the apparatus of our invention.

Before describing the manner in which the objectives of this invention are achieved in detail, a brief discussion of the philosophy of the system will enable the reader to fit the detailed operations into the overall picture. In its broadest outline the overall system is much the same as that disclosed in the Clarke et al patent referred to above. More particularly, a central station controls the condition of track switches and track signals throughout the railroad territory by transmitting controls to a plurality of field stations. An operator may monitor the condition of the railroad territory and, through a keyboard or similar device, initiate control requests. These requests are processed by the digital computer and those requests which are determined to be valid are formated for transmission to the field stations. The portion of the processor which may control the communication system, is disclosed in the co-pending application of Pulverenti et al entitled Communication System (GR-391) and filed Nov. 18, 1974. The actual communication equipment which effects the transmission of control signals may be that disclosed in the co-pending Dansbach et al application entitled Communication System (GR-386) filed Oct. 21, 1974. In order for the operator to make intelligent control request he must be informed as to the condition of the various track switches and track signals. This information is communicated by the field stations, through the communication system, is processed by the communication software and is made available to the control system of this invention. The particular advantage of the control system of this invention lies in the flexibility of the system in that it is applicable to CTC (unit lever) or NX operation. More particularly, the processor of our invention accepts the control request and, if in the NX mode, determines the route, determines the signals to be cleared and determines the switches that are to be thrown and the position to which they are to be thrown. Based on the forgoing this system then formats the required controls and transfers them to the communication system for transmission to the field. This system furthermore monitors the indications and determines when the controls have been executed. If controls are not executed the system flags an error status report. Once the controls have been executed this system continues monitoring the route that it set up and tracks a train which accepts the route. Elements in the route behind the train are then released for inclusion in other routes. This enables the operator to key in conflicting routes. Of course, only one of these conflicting routes would be set up in the field but the other route would be maintained pending. As sufficient elements are released they are automatically incorporated in the second route and the controls are transmitted to execute the second route. Furthermore, where there may be a plurality of routes which are available, this system determines the preferred route and formats this route for execution.

In order to perform these functions the system must contain, within it, a model or representation of the railroad territory that is being controlled. This model is contained in a number of separate memory storage areas of the computer. Before describing the memory allocation of the computer it should be noted that an embodiment of our invention which has been constructed employs a Nova mini-computer manufactured by Data General Corporation. This computer is referred to as a mini-computer by reason of its word length which is 16 bits. Of course, other mini-computers could be used instead of the Nova and indeed a general purpose computer could be used as well, i.e., one whose word length is 32 bits and up. By reason of the large volume of data which is required to operate this system we have found it desirable to employ an auxillary bulk memory which has taken the form of a disc memory. Of course, if a computer is employed which has sufficient internal memory capacity the disc memory can be dispensed with. For a description of the Nova computer employed see "A System Reference Manual for the Nova, published by Data General Corporation", Southboro, Massachussetts (1970).

As disclosed in the Clarke et al patent this computer is connected to the field stations through a duplex communication link. At the central office the computer is also connected to a keyboard and display, as well as the bulk memory. Much the same apparatus can be used with our invention except that the operator's keyboard will be slightly different by reason of the added flexibility provided by the system of our invention.

In practicing our invention the railroad territory to be controlled is broken up into a number of sites. The sites themselves are broken down into a number of stations, for communication purposes. Each station is a separately addressable unit and may itself control a plurality of railroad elements. The site boundaries are significant because they define the territory which will be displayed and with which the operator is allowed to operate. That is, in keying in a control request the operator is restricted to the area within a single site. In order to key in control request to more than one site the operator is required to call up each site and to individually input his control request for each site.

Part of the system model of the railroad territory is stored in site tables. The plurality of site tables are stored in the bulk memory and therefore when an operator keys in a particular site the data in that site table is written from the bulk memory into the internal memory of the computer. A typical site table is reproduced below in Table 1.

Table I

| | |
|---|---|
| Site Control Information | |
| Cross-Reference Tables | Switches<br>Signals<br>Priority |
| Routing Tables | Default |
| Block 1 | |
| Block 2 | |

Table I-continued

| |
|---|
| Block N |

The site control information, which is the first category of information found in the site table identifies in predetermined words, the site number, a pointer to the first track block in the site, a pointer to the first switch block in the site, a pointer to the first signal block in the site, a pointer to the cross referene table for switches, a pointer to the cross reference table for signals, a pointer to the priority matrix, a pointer to the default matrix and the number of switches in the site. In addition to the forgoing elements the site control information may also include information useful for display purposes.

The second category of information found on the site table is the cross reference tables. Cross reference tables are provided for both track switches and track signals. When control requests are keyed in by the operator they are identified in ASCII code. However, the characteristics of each element which may be included in a control request may be found at designated portions of the site table at which information corresponding to that block element is stored. The cross reference table will provide a means of converting from the ASCII code to the address at which information respecting that element is stored.

The next category of information in the site table is the routing tables, both priority tables and default table. Taking the priority table up first, this table comprises a matrix which has a plurality of bit entries for each possible entrance on the site. Each of these multi-bit entries includes bits for each switch in the route leading from that entrance point. The particular bits define whether the preferred route from that entrance point includes that switch in a normal or reverse position. This table is referred to in building a route to enable the system to employ the preferred route, if possible. However, it is possible that the preferred route will, for some reason, be unavailable and therefore, the default table provides the system with another route from the desired entrance point. The default table is another matrix which has a multi-bit entries for each possible entrance point in the site. The particular bit condition for each switch defines whether the alternative route from that entrance point includes that switch in a normal or reverse position.

There are actually three possible entries in a table, either the priority or the default table for each switch. Thus, each entry is a multi-bit entry. In particular, the table could indentify the switch as being normal, reverse, or indeterminate. The latter category may be provided for switches which are not in the route from the identified entrance point. As such, that route is acceptable regardless of the position of a switch which is not in the route.

Finally, the site table also includes a number of element blocks. A block is included in the site table for each railroad element in the site. As has been defined above, for purposes of this application, an element can be considered either a track switch, a track signal or a track circuit (or track section).

Each track circuit block includes information in the same order as every other track circuit block. The first word identifies the next track circuit in the site. A second word identifies the type of element as well as a number of options which are available and display information. Other words can include the unique identification of the track circuit in the system, the address of the next element to the left of the track circuit, the address of the next element to the right of the track circuit, the identification of where the track circuit's occupancy condition can be found and other miscellaneous information.

A block for a track switch includes information in the same order as every other track switch block. The first word indicates the address of the block for the next switch in the system. The second word can include the type of element and certain variable information. Other words include the unique identification of the switch in the system, a pointer to the element on the trail of the switch, a pointer to the element on the normal of the switch, a pointer to the element on the reverse of the switch, a pointer to the track which controls the switch, the address of the control for calling the switch reverse, the address of the indication that the switch is in a normal condition, the address of the indication that the switch is locked, an index to the priority matrix and default matrix for this switch, as well as other miscellaneous information.

A signal block includes information in the same order for every other signal block in the system. The first word may be an address to the next signal in the system. The second word can include the element type and certain variable information related to the signal. Other words can include the unique identification number of this signal in the system, a pointer to the forward element, a pointer to the reverse element, the address for a control to clear the signal, the address to control the signal to stop, the address for an indication that the signal is cleared as well as other miscellaneous information.

Those skilled in the art will understand that the order in which information is stored in the element blocks can be varied without departing from the spirit of the scope of our invention. What is essential is that the system have a means of identifying the location of certain necessary items of information. For instance, when the condition of a particular switch must be determined, the system must be able to go to the switch block and obtain the address where that information may be located.

Although at least one internal memory area is reserved for a site table, system constraints may dictate that the site table is not always located in the identical memory area during the operation of our system. Therefore, all the addresses for information within a site table are relative. In this fashion, knowing the index into the area will enable the system to identify the absolute address of any particular item of information contained in the site table. The mini-computer operating system includes a package which performs the function of allocating internal memory and writing information into the internal memory from the bulk memory. This function also provides the system with an index to the allocated area so that necessary items of information can be readily located.

As is well understood by those of ordinary skill in the art other internal memory areas must be allocated to the computer operating system and the processing routines themselves which will be disclosed hereinafter. Furthermore, internal memory space is required for both control tables and indication tables. For definitions of these tables reference is made to the Clarke et al patent, previously referred to. In addition, the communication system requires internal memory area. As referred to previously the communication system may be the one disclosed in the aforementioned Pulverenti et al application (GR-391). In addition, the operation of our invention requires other internal memory areas to be allocated for working buffers, timers and a number of queue's, particularly a recall directory, high waiting queue and a low waiting queue. The manner in which these are created, written into, and read from will become clear as this discussion proceeds.

In more detail each railroad element in the control territory has a recall word in the internal memory of the computer. When a route is constructed a pointer is inserted into an element's recall word to point to the next element in the route. Of course, this pointer points to the address of the element block for the next element in the route.

There is also, in the internal memory of the computer, a recall directory for each site in the system. This directory includes memory space for a single word for each site. When a route, is lined and clear, that is when it is prepared in the field and is ready for a train to accept it, a recall directory word for that site has a pointer inserted therein. This pointer points to a block which has been created for the first element in the route. The block which is pointed to includes three entries. The first entry points to the next recall block which is associated with another route on the site (if any). The second entry points to the entrance element for the route and the third entry is designated to indicate the end of a recall block. In this fashion, if the system must determine if there is an active route for a particular site it merely refers to the entry for that site in the recall directory. From the pointer located there the system can then refer to the first recall block, i.e., the recall block for the first element for the route. In turn, the recall block points to the first element whose recall word points to the next element, and so on.

In addition to the recall directory the internal memory includes a high Q directory which again includes an entry for each site which has an active high Q. This entry is a pointer to a high Q block for the first element in the high Q. For each element in the high Q there is a block and each of these blocks refers to the next element in the Q. Each high Q block includes identification of the element, the request, the status of the request and identification of a timer for the Q.

Furthermore, a low Q directory is also provided which is similar to the directory for the high Q and the recall areas. This low Q directory points to the low Q block for each site much in the same manner explained with respect to the high Q. The low Q includes, instead of a timer identification, identification of the element which is being waited for.

An additional internal memory area is allocated for the selection tables. This table includes a bit location for each element in the control territory. When the element to which the bit entry relates is selected for a route the bit is set. In this fashion, requests which require the same element in a route can be denied on the basis of the previous selection of the element for a different route. Of course, when a train travels across an element in a route and leaves that element the bit can then be reset for the element is available for different routes.

Now that we have identified the various portions of the memory it will be useful to briefly review the overall operating sequence of the system, including the system philosophy.

When an operator keys in a request, whether it be a CTC (unit lever) type request in which he designates one or a number of track switches and track signals and indicates the desired condition thereof, or in an NX request where he designates an entrance location and an exit location or, even briefer type of NX request in which he indicates merely pass the following events occur. The executive responds to the identification of the site by calling that site table from the bulk memory to the internal memory for easier access. The executive then determines from the controls requested, the portion or portions of the processor which will have to pass on the validity of the controls. This routine, or routines, are called and operate. The results of these operations can be one or more of the following, an error indication indicating that one or more of the requested controls were invalid, the creation of an entry in the low wait queue for those controls which are presently invalid but which the system can forsee may become valid during the operation of the railroad, and the creation of a high Q entry simultaneous with the transmission of those controls which are considered valid.

The executive can also be called as a result of the communication system indicating that one or more indications from a particular station or stations has changed. If the indication or indications which have changed did so as a result of the execution of the control the entry for that control is deleted from the high queue and inserted instead, into the recall directory. If the indication or indications which have changed may now validate a conditionally invalid control request, the low wait queue may be checked and if this is in fact the case, the entry in the low wait queue will be deleted, the controls transmitted and an entry made in the high queue.

If the indication or indications which have changed did so as a result of a train travelling along a previously established route, the related entry will be deleted from the recall directory and the elements corresponding to the entries will now be available for further routes.

A still further reason for calling the executive may be the expiration of a timer. When an entry is made in a high queue, a timer is initiated. The timer is set to a period in which the system expects the transmitted control to be executed and indication return confirming the execution of the control. If the timer expires without the indication having been returned, an error message is constructed calling the operators attention to the fact that his control, although transmitted, has not been executed.

Referring now to FIG. 1, there is illustrated a block diagram of the elements of a railroad traffic control system employing our invention. This block diagram is substantially identical to FIG. 4 of the referred to Clarke et al patent except that block 104 is here identified as a communication system whereas the Clarke et al patent referred to that as a code convertor. The designation code convertor carries the connotation of a relay communication system. Since our invention can be employed with either relay based communication systems or a communication system controlled by the CPU control 105, we have chosen to designate block 104 as referring to a communication system. No further discussion of FIG. 1 is necessary save to indicate that the distinctions between our invention and the Clarke et al invention relate to the processes carried on by the CPU control 105 and the greater flexibility thereby provided to the individual operating the keyboard 103.

Figure 2:
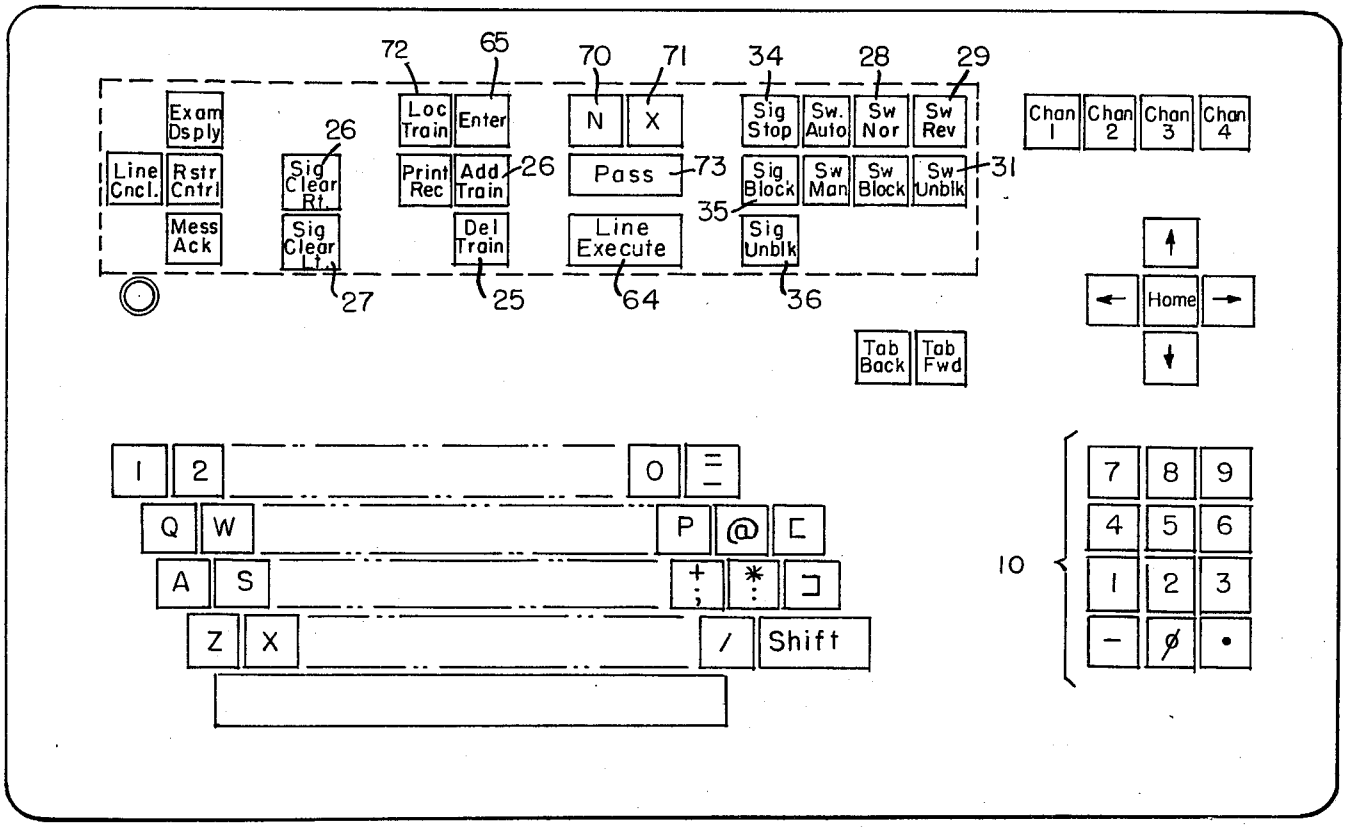
FIG. 2 is a representation of a typical operator keyboard which could be employed with the apparatus of FIG. 1.

FIG. 2 is a schematic diagram of a suitable keyboard 103. The operator controls which are relevant to our invention are the function keys located in the upper portion of the keyboard and the numerical designator keys 10 located in the lower right hand corner of the keyboard. In operating in the CTC (unit lever) mode the operator would designate a particular element using the numerical designator keys 10 and would then designate the particular function he desired using the function keys. Thus, for instance, if the operator desired to operate with switch 78 he would key in 78, and if he desired to throw that switch normal he would then depress function key 28. At that point he could designate one or more other specific functions such as 77, signal clear left by depressing function key 27. In this fashion the operator can control a selected signal to be cleared left, right, stop, blocked or unblocked. He can control a specified switch to be normal, reverse, blocked, or unblocked. After the operator has entered all those commands which he wishes to enter he depresses function key 64 line execute. This calls the executive to process the request.

In the NX mode the operator could designate a signal number using the numerical keys 10 and then depress function key 70, to designate that signal as an entrance location. If at that point he depresses function key 64 that would call the exec which would call ENROT and operate TAB I. Since no exit point has been selected the route cannot yet be constructed. At a later time the operator could then depress the numerical keys 10 to designate another signal and depress function key 71 to designate that signal as an exit location. If at this point he depressed function key 64 the executive would again be called and this time EXROT would be called to operate TAB II and ROUTE to construct a route, if possible.

A still further example of an operator request could be the designation of a signal, depression of function key 70, designation of another signal and depression of function key 71 and the operator would conclude by depressing function key 64 to call the exec. This, as we shall see below, would bring up NXROT, operate TAB I, TAB II, and ROUTE to construct a route. ROUTE would call FRCAL to output any necessary switch calls and QGCLR would output the necessary signal calls.

Still another possible operator initiative is to designate a site and if necessary a particular signal then depress function key 73 to initiate a passing move. This order would be concluded by depressing function key 64 to call the executive.

As we shall see, the system is capable of tracking a train which has been identified. In order to effect this function the operator first designates the entrance location of the train by identifying a particular inventory track section, depressing the numerical keys 1o to identify the train and then depressing function key 65 to enter the train. In a like fashion using function key 25 the operator can delete a train identification. The function key 26 allows the operator to add an additional train designation if that becomes necessary.

Figure 3A:
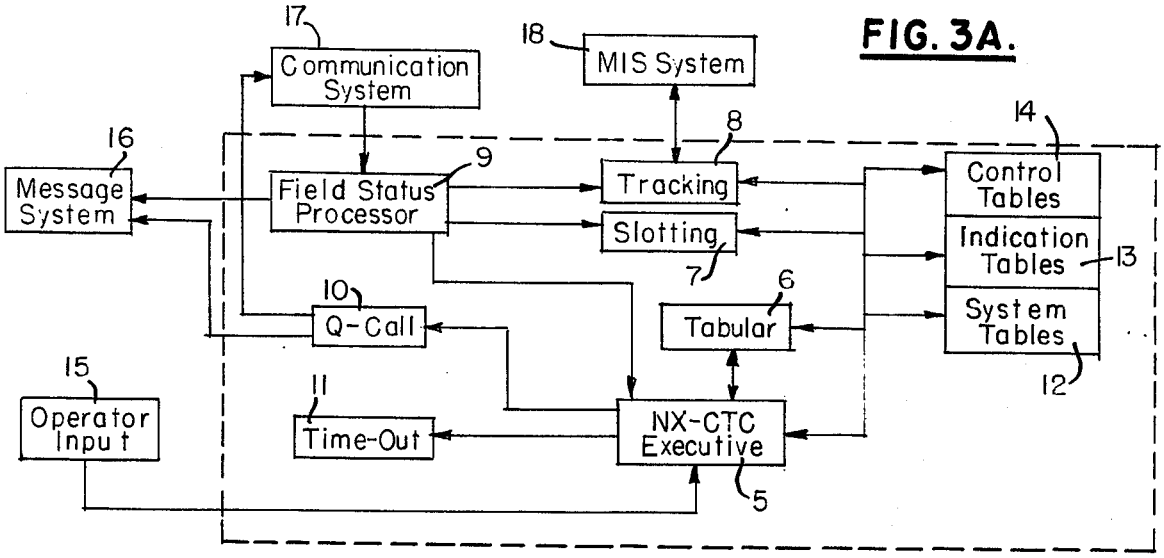
FIG. 3A is a functional block diagram of some of the major system components and which also indicates information flow paths.

FIG. 3A is a functional block diagram illustrating the various groups of functions which are performed, the nomenclature given to that group of functions, and some of the memory areas referred to, and the particular groups of functions which refer to those memory areas. FIG. 3A illustrates the NX-CTC executive 5 which is the highest level decision making entity. It pulls together the remaining groups of functions as an operating system. The executive 5 refers to the control tables 14, indication tables 13 as well as system description tables 12. In addition, the executive also refers to a tracking routine 8, a slotting routine 7, a tabular routine 6, a time-out routine 11, a Q call routine 10. The executive 5 receives operator input 15 as well as information from the field status processor 9 and the routines previously referred to, tabular 6, slotting 7 and tracking 8.

The field status processor 9, in addition to providing information to the executive 5 also provides information for the tracking routine 8, the slotting routine 7 and the message system 16. The field status processor 9 receives information from the communication system 17. Furthermore, the tracking routine 8 provides information to and receives information from the MIS system 18.

Those functions or tables which are included within the dashed boundaries will be discussed in detail herein. The message system 16 merely provides a communication link from the processor to the operator and may take the form of a CRT display or a hard copy printer. The communication system 17 can be any one of a number of commercially available communication systems. It may well include the apparatus disclosed in the Dansbach et al application (GR-386) and the Pulverenti et al. application (GR-391). The MIS system 18 is a management information system which can report the progress of various trains which travel through the control territory by cooperating with the tracking routine 8.

As may be apparent from the nomenclature given the different groups of functions, the field status processor 9 operates in response to indication changes from the field stations and provides information to the executive 5, on which information the executive 5 may act. The executive, operates in response to operator inputs or field status processor inputs, and may, in turn, refer to Q call 10 for managing the queue's and formatting messages.

In the course of its operation the executive 5 may refer to one or all of the system table 12, indication tables 13 and control tables 14.

The executive 5 may also call time-out 11. In response to the information received from the executive 5, Q call 10 can provide controls to the communication system 17 or messages to the operator via the message system 16.

In addition to providing information to the executive 5, the field status processor 8 may also call tracking 8 or slotting 7 either of these routines, by making changes in the system tables 12 may, as a result, call the executive 5 back into operation. Any time the executive 5 must determine the validity of a routing control request the routine tabular 6 is called.

As is well known to those skilled in the art internal operating speed of a mini-computer is many orders of magnitude faster than the fastest significant operation which can occur on a railroad. As a result when an operator originated control request is validated, which may refer to a particular site, a signal is provided to the communication system that a pending control is awaiting transmission. At that time, the system can then move the site tables for the particular site from the internal memory and replace it with another site table for another site and process other information. Although the pending control has not yet even been transmitted, insofar as the processing system is concerned, it has completed all action that is presently possible on the particular site. As is noted above, when such a pending control is created, an entry is made in a high queue which provides a scratch pad memory for the system. After the control is transmitted further delay may be encountered in the processes of actually transmitting the signal, receiving it at a particular field station, decoding the signal and determining the railroad element to which it pertains, effecting the change, noting the change at the field station, formatting an indication message descriptive of that change, physically transmitting the indication message back to the communication system, detecting the indication message and determining that it contains an indication that has changed, and notifying the field status processor thereof. At this point in time, the field status processor then requests the particular site page to be rewritten into the internal memory. The field status processor 9 and routines it calls detele the entry in the high queue and insert the entry in the recall array. Subsequent to this operation the site table can be released and the processor can work with other requests on this or other sites. In a like fashion, when the train for which a route may have been constructed travels through the route, indications to this effect would be received by the field status processor 9. Acting again, with routines to calls the elements of the route will be released so they are available for inclusion in other routes. Throughout the following description the reader should be aware of the fact that operations with the identical site table may actually be displaced in time and that similar operations may occur with other site tables interleaved with the first mentioned group of operations.

In order for the CPU to keep track of the events which have occurred and to properly interpret the indications received from the field, the recall array high Q and low Q are employed. Each site may have an active or inactive recall array, high Q and low Q depending upon the particular point in the control process that has been achieved.

Figure 3C:
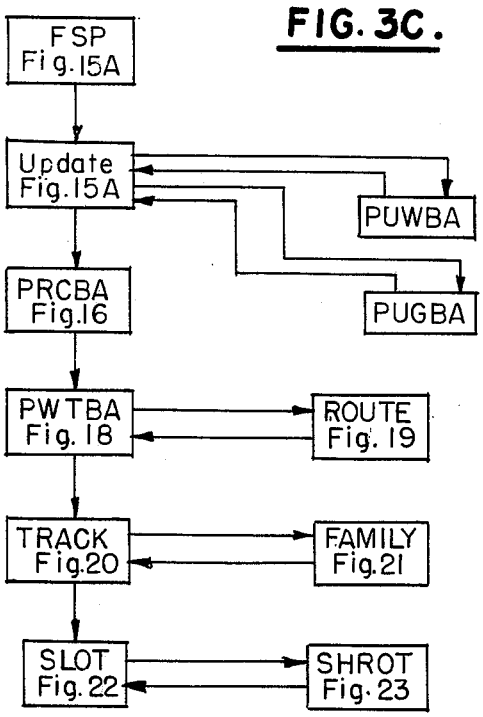
FIGS. 3B and 3C are similar to FIG. 3A but include in more detail and also indicates the figures of drawings which are related to the various flow charts.
Figure 3B:
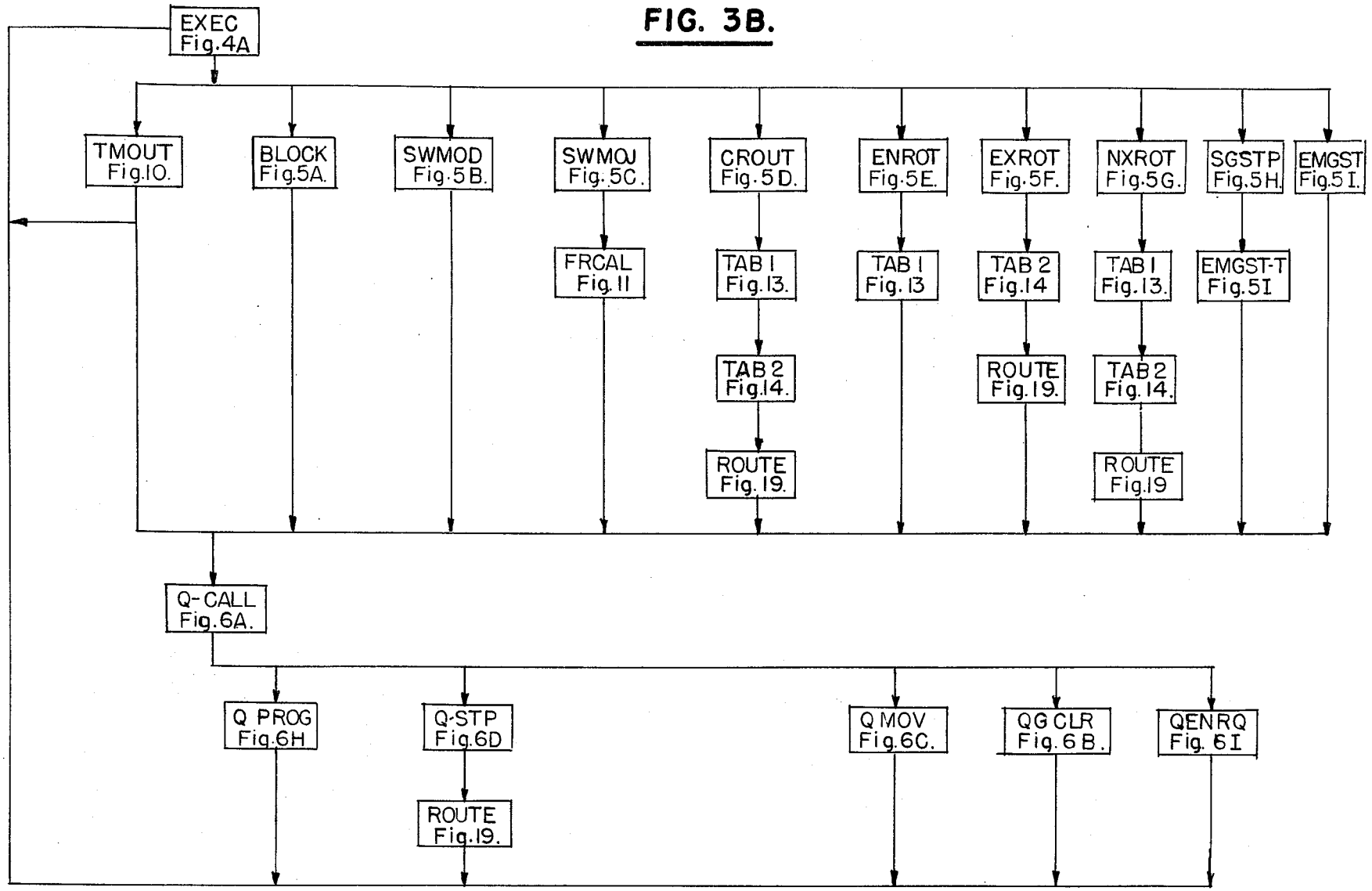

FIG. 3B is a more detailed illustration which indicates in what figure each of the different routines are illustrated. FIGS. 3B and 3C also show typical information paths that are followed. Thus, for instance, the EXEC may call CROUT which then refers to TAB I, TAB II and ROUTE. At the completion of the last mentioned routine QCALL may be called which in turn may call other routines as illustrated in FIG. 3B. Those routines illustrated in FIG. 3B operate in response to signals originated at the central office, either at the control keyboard or the expiration of a timer. On the other hand, the routines illustrated in FIG. 3C operate in response to field originated signals.

Referring again to FIG. 3B TMOUT is a routine to handle the expiration of high wait queue timer. BLOCK is a routine to handle the operator keying in a request to block a particular railroad element. SWMOD is a routine to handle the oprator keying in a request to change the switch mode. Switches can operate in either automatic or manual mode and this routine changes the mode from one to another. In the manual mode the system cannot automatically throw a switch. SWMOV handles an operator request to reposition the track switch. FRCAL formats the switch call. CROUT responds when the operator keys in a CTC (or unit lever) request in which designates elements and the requested position thereof. CROUT also calls TAB I, TAB II and ROUTE. ENROT, in cooperation with TAB I, handles an operator NX type of request in which merely an entrance element is selected. EXROT, in cooperation with TAB II and ROUTE, handles operator NX type of request in which he designates merely the exit point of a route. NXROT handles an operator keyed in request in the NX mode in which the entrance and exit of a route is selected. NXROT cooperates with TAB I, TAB II and ROUTE. SGSTP operates in response to the operator's request to stop a signal and EMGST operates in response to an operator's request to stop a signal under certain circumstances.

The routines ENROT, EXROT and NXROT are those routines which operate in the NX mode and in which the operator need not identify and request a specified position or condition for each of the railroad elements in the route. He merely need specify the entrance and exit locations and the system will automatically determine what elements are included in the route, select a preferred route and control these elements to the proper positions. The other routines are CTC (a unit lever type) routines in which the operator selects the railroad elements he wishes to control and indicates the desired position or condition thereof.

As should be evident from FIG. 3B, some of these routines are intermedate in the sense that they receive results from a preceeding routine and further process the data. TAB I, for instance, given an entrance point will determine all possible exit points and note all intermediate selected elements. TAB II, given a selected entrance and exit point will determine if a route is possible and, if possible, the required position for switches in the route. TAB II will also write the appropriate recall words.

Depending upon the point which ROUTE is called, it may select the elements, work with the recall words or stack information for Q call.

Q call and its associated subroutines manages the high wait and low wait Qs and will set and reset the control bits in order to transmit controls to the field.

The routines illustrated in FIG. 3C operate on the same tables, that is recall words, high wait and low wait Qs not in response to office initiated signals but, rather in response to indications from the field. The field status processor (FSP) determines the identity of those stations at which indication changes have been detected. UPDATE then calls the appropriate processing routine PRCBA (process recall bit addresses), PWTBA (process active Q bit address), PUBWA (process unknown switch addresses), PUGBA (process unknown signal bit addresses).

In the course of operating, PWTBA may call ROUTE if necessary. Then the routine TRACK is performed in order to track the movement of identified trains in the territory. The operation of this routine may require the operation of FAMILY. Finally, at the conclusion of TRACK, SLOT is called to identify those low wait Qs which are waiting on elements which can now be deselected.

In the course of operating SLOT, SHROT may be called to shorten the route as railroad elements are deselected.

FIGS. 3A, 3B and 3C do not identify all the routines that are accomplished. Rather, they identify the major routines which have functional logical significance. There are other routines, some of which are disclosed in this application, and others of which are not, which involve bit manipulation, such as setting an identified bit or resetting that bit, starting and stopping timers, obtaining appropriate size blocks of memory locations, or releasing blocks for other uses, which are well known in the art and do not require detailed discussion.

Now that the broad outlines of the systems functions have been described, we will see the manner in which they are accomplished in detail.

Figure 4A:
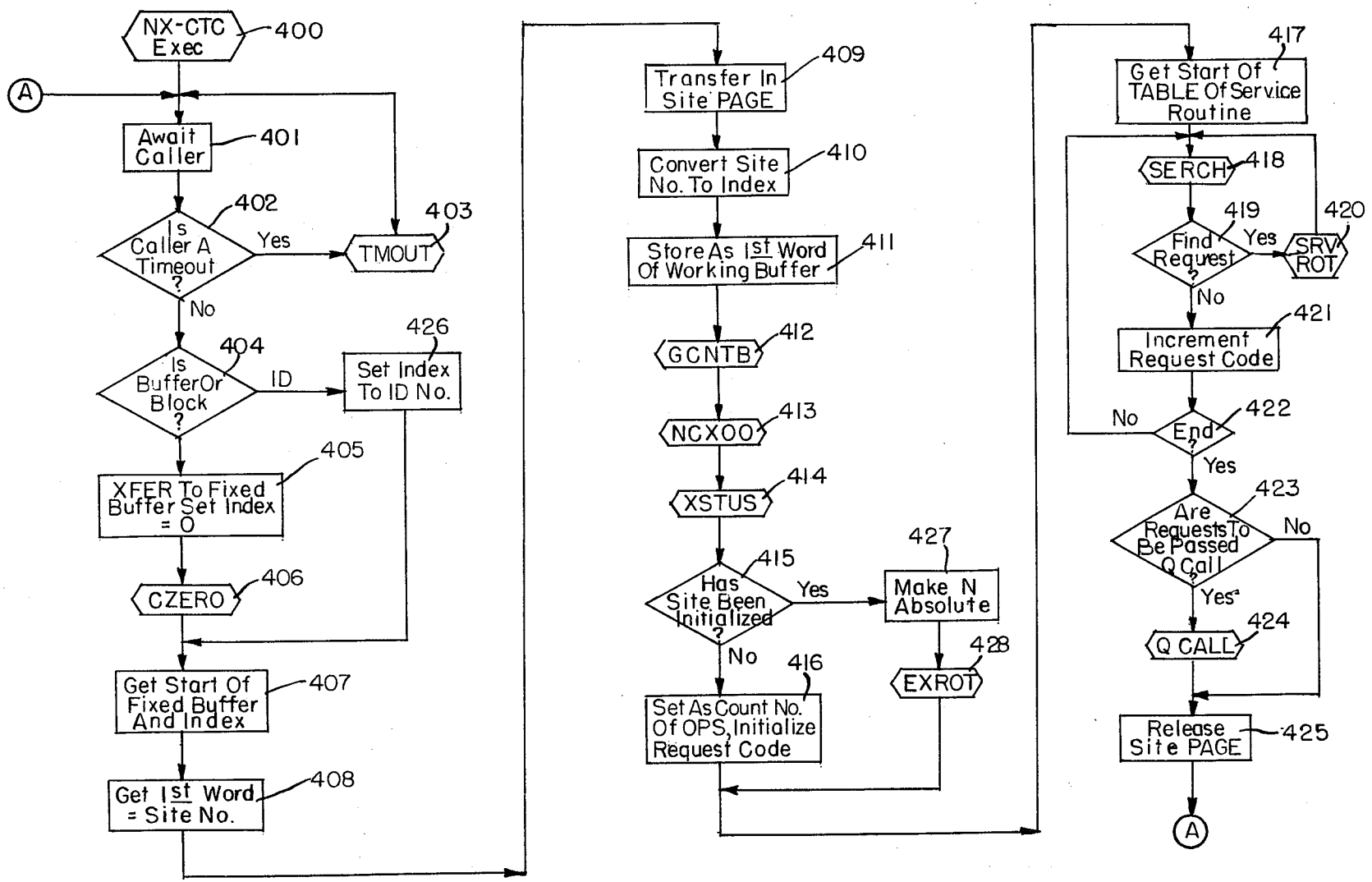
FIG. 4A is a detailed flow chart for the NX-CTC EXECUTIVE of our invention.

FIG. 4A illustrates the NX-CTC EXEC. This routine operates in response to one of three possible conditions. Either a timer associated with a high wait Q has expired, the operator has keyed in a request in either the CTC or NX modes or indication changes require action of the executive. The NX request may be merely the designation of an entrance signal, it may be a designation of an exit signal where an entrance signal has previously been identified, it may be the designation of both entrance and exit signals or it may merely be the designation of a particular site with a control request of PASS. We will defer explanation of the latter operation until the basic framework of the system has been explained.

Normally the system is sitting at function 401 awaiting a caller. The first decision point 402 determines if the caller is a time-out, if it is, the TMOUT routine 403 is called. In order for the explanation of the TMOUT routine to be meaningful, we will postpone that until a later time when more of the system processes have been explained.

Assuming it is not a TMOUT, decision point 404 determines if it is a buffer ID or a block. Key board requests as they are entered are stored in a buffer ID. However, other routines may call the EXEC with information located in a floating block. That is, the block in which this information appears may be different. Therefore, if the information resides in a block, function 405 transfers the block to the fixed buffer and function 406 merely releases the block which has now been utilized and is no longer necessary. However, if it was the buffer which retains the information keyed in by the operator, function 426 sets the index into the buffer to the ID number. Function 407 gets the start of the fixed buffer and index which, at this time are available by reason of the preceeding functions. Function 408 obtains the first word. By definition, this is the site number on which the operator is making requests. If information had been passed to the EXEC by one of the other routines, the site number would be the first word included. Function 409 transfers in the site table from the bulk memory. Function 410 converts the site number to an index and function 411 stores this as the first word as a working buffer. With this information, the system can obtain information from the site table which is now stored in the machines internal memory. Function 412 copies the control table for the site to a working area. As has been explained above, the control and indication tables do not reside in the site table. However, the system may be operating on the control table and inserting therein the controls which are only conditional. Since the communication subsystem may address a field station at the site and transmit to it controls from the control table, there is a desire to prevent the conditional controls from being transmitted. Thus, by copying the control table, the system can operate with the working control table without modifying effective controls.

Figure 4B:
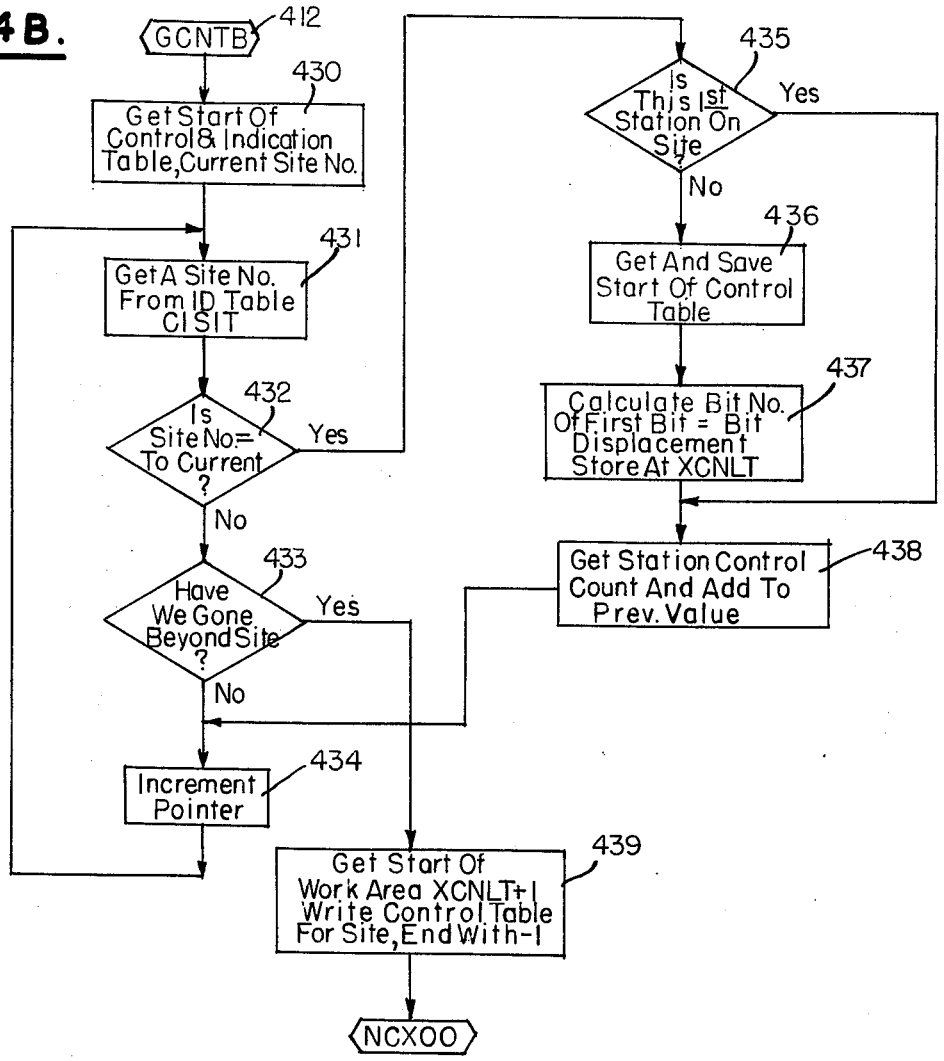
FIG. 4B is a detailed flow chart of GCNTB.

At this point it will be useful to refer to FIG. 4B to see the manner in which GCNTB operates. The first function 430 obtains the start of the control table for the current site number. Function 431 obtains the site number from the ID table CISIT. This is merely a table listing all the sites in the system. Decision point 432 determines if a site number equals the current site, i.e., the site which the system desires to work with. If it is not, decision point 433 determines if we have gone beyond the site. If not, function 434 increments the pointer and function 431 gets a new site number. In this process decision point 432 will, at some point, determine that the site number equals the current site. Then decision point 435 determines if the pointer is pointing at the first station on the site. At this point in time it would be and therefore function 438 gets the control count and adds to the previous value. That is, the number of bits in the controls for this station. Since the previous value was zero, then the count at the conclusion of function 438 equals the number of counts on this station. Function 434 increments the pointer to point to a new station. Assuming the site had more than one station (which is in general true), decision point 432 would determine that this site number was still equal to the current number and decision point 435 would now determine that this is not the first station on the site. Function 436 obtains the start of the control table for the station and function 437 calculates the bit displacement. Function 438 adds this to the previous value and the loop is repeated. At some point, after all the stations on the site have been treated, decision point 433 will determine that we have gone beyond the site and function 439 will obtain the start of a work area and write the control table for this site at the work area.

Returning now to FIG. 4A NCXOO, function 413 is performed. This is a special case of a NX request which is pending switch correspondence. At this point we can skip over the function since, if no request is pending, the system itself skips through this routine.

XSTUS (examine status) function 414 now occurs. This is illustrated in detail in FIG. 4D.

Figure 4C:
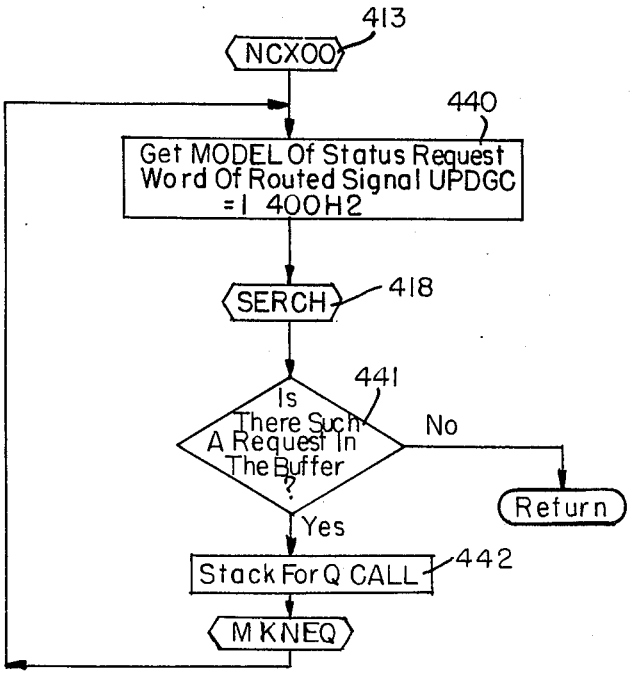
FIG. 4C is a detailed flow chart of NCXOO.
Figure 4D:
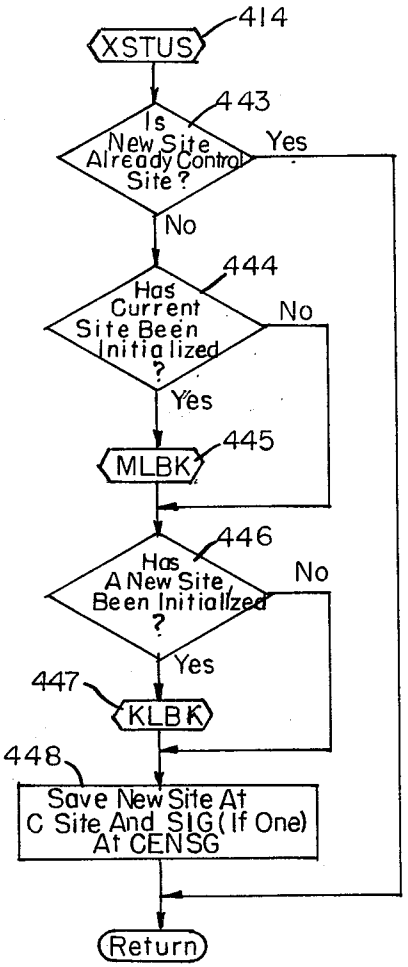
FIG. 4D is a detailed flow chart of XSTUS.

Referring to FIG. 4D, decision point 443 determines if the new site (the one just brought in to the internal memory) is already the control site. That is, has that site been previously worked with? If it has, that concludes this portion of the routine. However, if it is not, decision point 444 determines if the current site has been initialized. At this point, it will be well to explain that since a route cannot be specified until an entrance and exit point have been determined, we use the nomenclature that a site is initialized when only the entrance point is determined. Therefore, if the operator has not keyed in an entrance point, decision point 446 would then be entered. However, if he has initialized the site by specifying the entrance point, then function 445 makes a linkage block. This is merely a routine to save the requested entrance point. It should also be mentioned that generally an entrance point is a signal. At that point, decision point 446 determines if the new site has been initialized. If it has function 447 kills that linkage block or deletes it. Regardless of the outcome, function 448 stores the identification of the new site at a specified location - CSITE - and a designation of an entrance signal, if there is one at - CENSG - . That concludes this routine.

Referring now to FIG. 4A, again decision point 415 determines if the site has been initialized. If it has, function 427 makes the entrance absolute (adding the site index to the relative block address) and EXROT is performed at function 428. If the site has not been initialized, function 416 sets a counter to indicate the number of possible different operations that could be required as a result of the operator's request. The same function also sets a pointer at the first type of operation. Function 417 obtains the start of a table of service routines. These service routines include BLOCK, SWMOD, SWMOV, CROUT, ERNOT, NXROT, SGTB and EMGST. It is important to note, at this time, that the service routines, which we are now discussing, are called in a predetermined order as follows: stop signal, cancel signal block, cancel switch block, initiate signal block, initiate switch block, initiate switch manual, restore switch automatic, call switch normal, call switch reverse, clear signal, entrance signal, exit signal, NX. Thus, when the operator enters a command string with a mixed number of requests, all requests for stop signal are serviced before any other requests, etc. Function 418 then compares the first possible request code to the operator's request. If decision point 419 indicates that a request has been matched, then a dispatch is made to a service routine, at function 420. Thus, one of the previously referred to routines could be called. As that is completed function 421 increments the request code and decision point 422 determines if we have checked each request code for a possible request. If not, a comparison is again made and so on until each of the operator's requests has been serviced by the proper service routine.

At the conclusion of servicing the operator's request, decision point 423 determines if there are requests to be passed to Q call. This would be indicated by entries in the buffer area and, if there are, function 424 operates Q call. Function 425 then releases the site page because the operator requests have been serviced and there are no further functions to be performed.

Figure 5A:
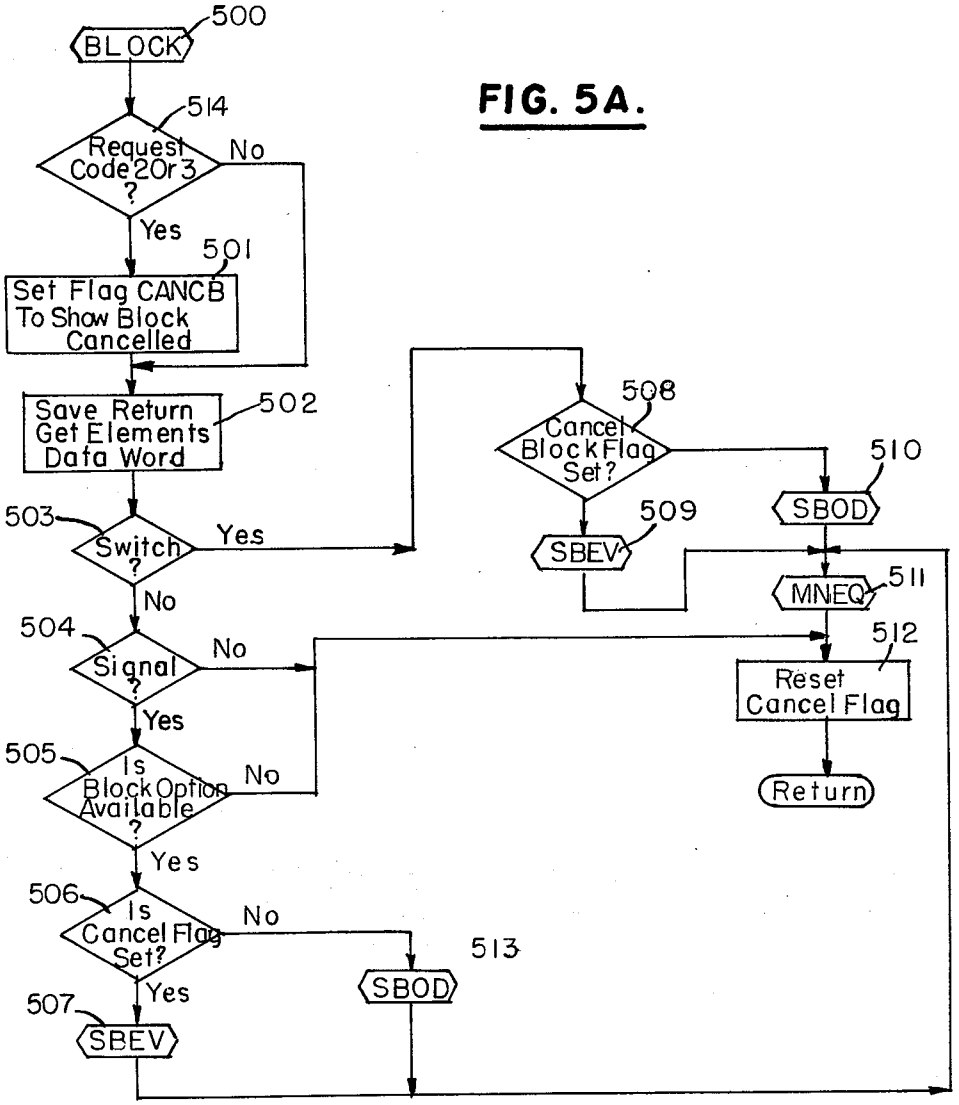
FIG. 5A is a detailed flow chart of BLOCK.
Figure 5C:
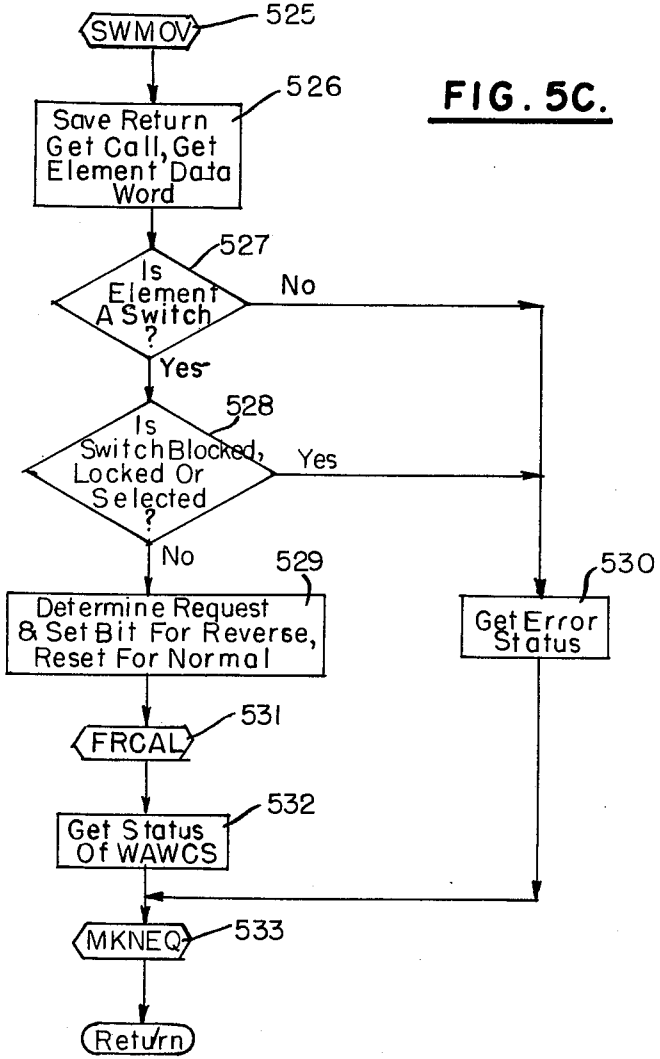
FIG. 5C is a detailed flow chart of SWMOV.
Figure 5B:
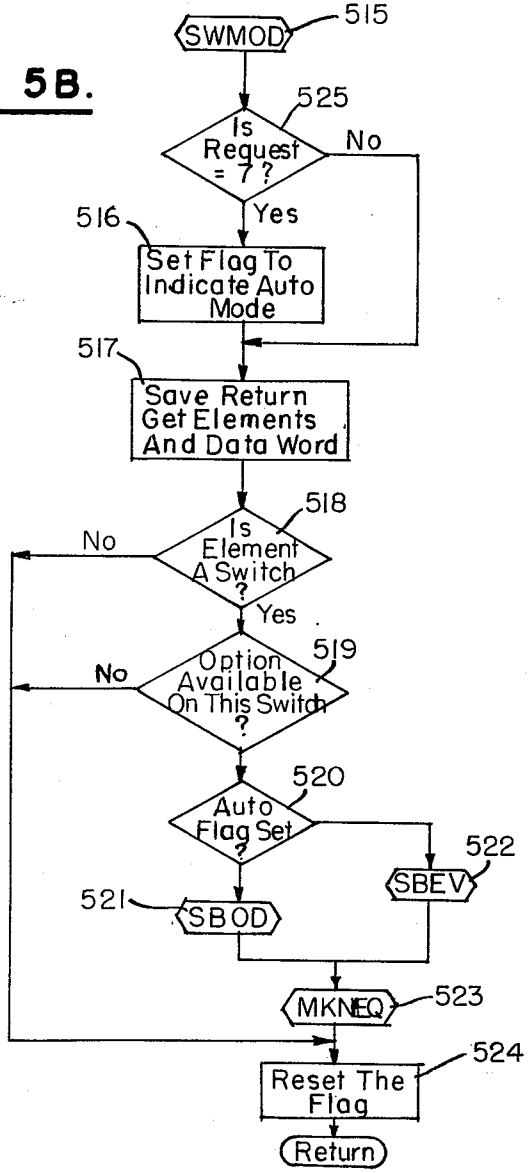
FIG. 5B is a detailed flow chart of SWMOD.
Figure 5F:
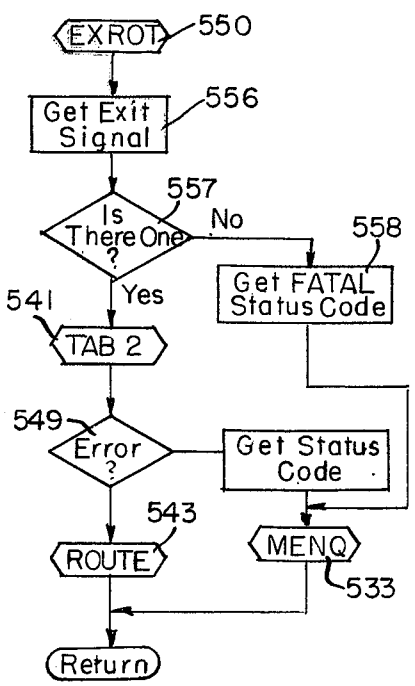
FIG. 5F is a detailed flow chart of EXROT.
Figure 5E:
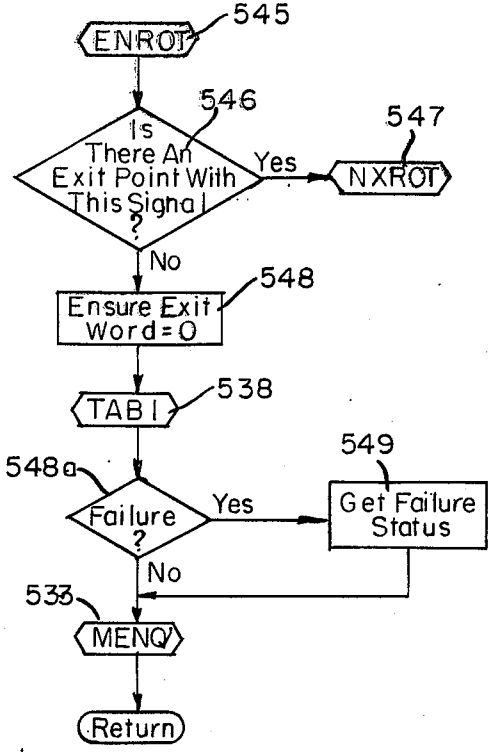
FIG. 5E is a detailed flow chart of ENROT.
Figure 5D:
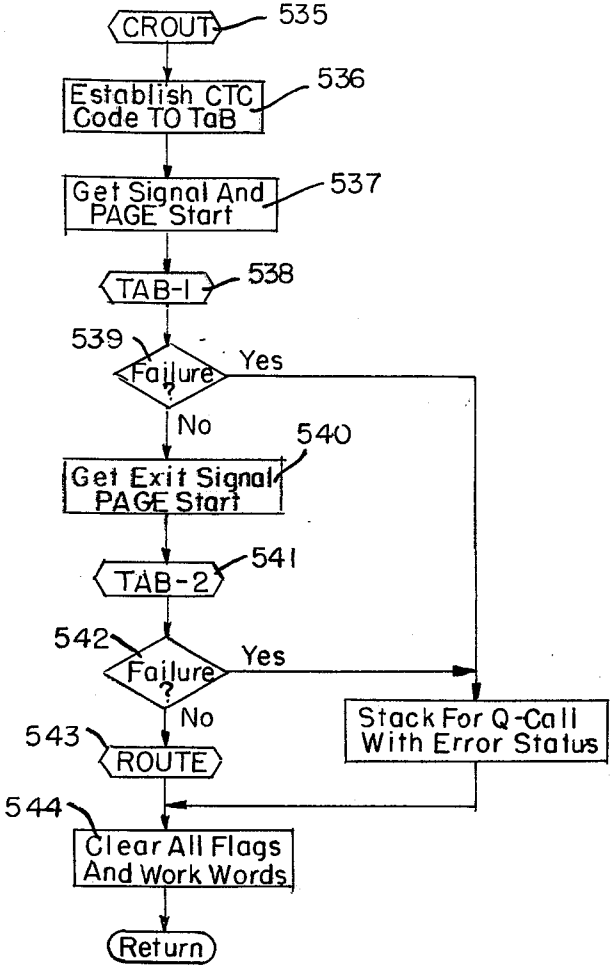
FIG. 5D is a detailed flow chart of CROUT.
Figures 5G, 5J:
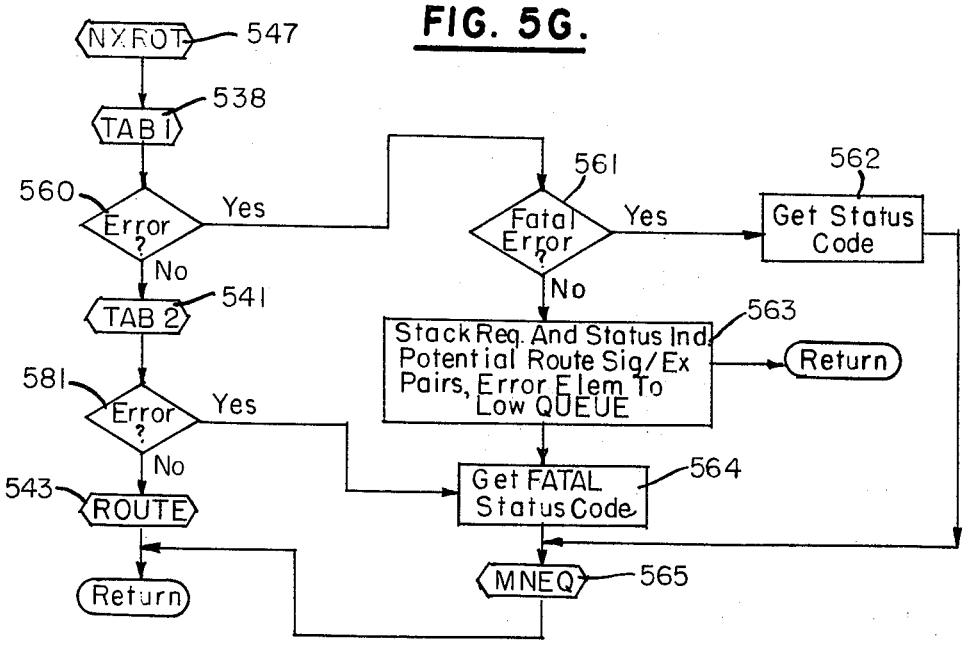
FIG. 5G is a detailed flow chart of NXROT.
FIG. 5J illustrates a number of codes and the conditions they represent.

To see, in detail, how an operator request is serviced we will now refer to FIG. 5G and explain NXROT.

The major routines performed by NXROT are TAB I, TAB II and ROUTE, if successful. TAB I is illustrated in detail, in FIGS. 13A through 13F. The function of TAB I is to find all possible exits, if no exits are specified or, to determine if the specified exit is achievable. In the course of its operation TAB I also identifies intermediate elements which are already selected. The first decision point 1301 determines if the entrance address identifies a signal. Since only signals are legal entrances, if it does not, this results in an error report. If the entrance address passed is a signal, decision point 1302 determines if it is available. That is, is it a stopped signal which is not selected is unblocked and is a legal entrance? If it is, then function 1303 gets the signals forward link. Then the routine refers to BLKTY 1 function 1304. At this point, function 1305 moves the last link, that is the entrance signal to a specified address and moves the new link, the forward link of the entrance signal into another specified address. The forward link of the entrance signal would normally be the track section adjacent the signal. With identification of this link the system can refer to the data word for the link in order to determine its type. Decision point 1306 determines if it is a track. If it is, EXTK I is referred to. If it is not a track, decision point 1308 determines if it is a switch, if it is, EXSW I is referred to, and, if it is not, a switch then EXGS I is referred to.

Assuming that the new link is a track section, decision point 1311 determines if it is multiply selectable. Certain track sections can be selected in a number of routes. Whether or not the track section is multiply selectable is defined in the element block. If it is not multiply selectable, decision point 1312 determines if it is now selected. If it is, function 1313A establishes the error code and refers to ALTROT (alternate route). If the track is multiply selectable, decision point 1314 determines if it has been selected to its legal limit. If it has, functions 1313A and ALTROT are also referred to. Even though the track section is not now selected, decision point 1315 determines if it is occupied. If it is, ALTROT is also referred to. ALTROT is referred to under these circumstances since this particular route is not available and its function is to look for other available routes.

Assuming, however, that the track is available, function 1316 gets a first link for the track. Decision point 1317 determines if the first link equals the last link, that is the entrance signal. Since tracks are bi-directional, of course, the system does not know if it is the first or the second track link which is the forward link in the direction of this particular route. If the first link equals the last link, then function 1318 obtains the second link. In any event, a link is obtained for that track which is not equal to the entrance signal. Decision point 1310 determines if that link is zero, and, if not, decision point 1311 determines if it is a reference out of the site area. If either of these are true, the route has reached the limit of the site area and function 13 marks the last passed signal as an exit. If the routine has not reached the site limit, then BKTY I is referred to again to obtain the next link. If we have reached the limit, decision point 1320 determines if the signal we had marked as an exit is equal to the exit word, i.e., the exit specified by the operator. If it does, the routine is completed since we have now determined that the exit is achievable. If that is not the case, however, if decision point 1321 determines if we are operating in the CTC mode. If we had been, that would also complete the routine. If not, ALTROT is referred to.

If at some point BKTY I determines that the link that we had obtained is a signal, EXGS I (FIG. 13E) is referred to. At this point decision point 1346 is referred to to determine if the signal is an inline signal, that is, is it controlling traffic in the same direction that we are traveling? If it is not, decision point 1349 determines if it is available. As before, if it is not, the system refers to ALTROT. However, if it is available, then function 1350 gets the reverse link and again checks BKTY I to determine its type and whether or not it will allow us to complete the route. However, if this was an inline signal, function 1347 marks it as an exit and decision point 1349 checks the exit word. If we are in a CTC mode, the exit word defines the CTC mode. In the NX mode we would determine if the exit word equals this signal. If the exit word either indicated CTC mode or equalled the signal, that would complete the routine. However, if neither of these conditions are met, function 1351 gets the forward link again refers to BKTY I.

If at some point BKTY I determines that the link we have obtained is that of a switch, then EXSW I is entered. Although a track and a signal have only two links, a switch has three links, a trailing link, a normal link and a reverse link. Therefore, in order to determine what the next link is in the route we have to determine which link we have entered on and the last call for the switch. If we have entered on the trailing link of a switch, we must know the switch call in order to determine which link we will exit on. Furthermore, if we are in the NX mode, in which mode the system is allowed to throw the switch, we will want to move past the switch in both the normal and reverse conditions to find all possible exits for our route. In the CTC mode, where the system is not allowed to throw a switch, the last switch call will tell us which link to exit on. In the CTC mode, if we have entered on a link to which the switch is not positioned, then that will obviously be an error condition. And, finally, in the NX mode, if we have entered on the normal or reverse link, we must determine what the last switch call was, for if it is not the same, the system will have to generate a control to throw the switch in order to establish the route. The logic of the foregoing conditions are carried out by the functions illustrated in FIGS. 13C and 13D.

Decision point 1322 determines if the switch is selected. If it is, function 1323 establishes an error code with the block and refers to ALTROT. This route obviously cannot be used since it requires the switch which is selected by another route. If this switch is ultimately necessary to the route, this determination will be used in making a low queue entry which will then wait on deselection of the switch.

However, if the switch is not selected, the decision point 1324 determines if we are in the NX mode. If we are not, that is if we are in the CTC mode, then the routine skips the point B where decision point 1337 determines if we have entered on the trail of the switch. If we have not, then the routine skips to point C where decision point 1341 determines if we have come in on the normal link of the switch. If we have, then decision point 1343 determines if the switch was last called normal. If it was not, function 1345 sets an ERROR code and refers to ALTROT. However, if the switch was last called normal, then function 1344 gets the trailing link, since that is the link we are going to exit on, and skips to point D. Decision point 1334 determines if we have been this way before. We will see the necessity for this as we proceed. If we have, the routine refers to ALTROT for again this is not an acceptable route. However, if we have not, function 1336 sets the bit of the trail link in order to tell us that we have passed over the trailing link of this switch and refers to BKTY I to determine the identity of the next link in the route.

Decision point 1342 operates if we did not come in on the normal link of the switch and determines if the switch was last called reverse, if it was, then the route is possible and function 1344, 1334 and 1336 are again performed. However, if the switch was not last called reverse, this is another error condition which is set by function 1345 and then ALTROT is again referred to.

However, if we did enter on the trail of the switch, decision point 1338 determines if the normal call is out. If it is not, since we are in the CTC mode, we must assume the switch will be in the reverse position therefore function 1339 gets the reverse link and refers to BKTY I to determine the identity of the next link. However, if the normal call was out, then we will assume the switch is or will be in the normal position and function 1340 gets the normal link and refers to BKTY I to determine the identity of the next link.

However, assuming we were in the NX mode, decision point 1325 will determine if the switch was locked. That is, is the field circuitry such to prevent the throwing of the switch? If locked, decision point 1326 determines if the switch is in the normal position. If it is not, function 1327 sets the error code and refers to routine ALTROT. A released switch is assumed to be selected and thus unavailable. If the switch is in the normal position, decision point 1329 determines if we have entered on the trail. If we have not, function 1328 obtains the trailing link, for that is the link we will exit on, then refers to BKTY I to determine the identity of the trailing link. However, if we have come in on the trail, since the switch is locked, normal function 1333 obtains the normal link, since we will be exiting on the normal link and BKTY I is referred to to determine the identity of the normal link.

However, if the switch was not locked, decision point 1331 would determine if we entered on the trail. If we have not, function 1330 gets the trailing link, decision point 1334 determines if we have been this way before, and, if not, function 1336 sets a bit of trailing link to mark it, and refers to BKTY I to determine the identity of this link. If decision point 1334 determined we had been this way before then this route has been investigated and ALTROT is referred to to obtain an alternative route.

However, if we did enter on the trail, then function 1332 enters this switch in a save register, the function of which will become clear hereinafter, and function 1334 obtains the normal link and BKTY I determines the identity thereof.

If at some point in proceeding through the railroad territory ALTROT is referred to, it is for the reason that a tentative route we have taken has been determined to be unusable or all exits have been found. Decision point 1352 determines if the save stack is empty. It will be recalled that the save stack contains the identity of every switch that we have passed which was entered on the trailing link. Therefore, if the save stack is not empty, function 1353 gets an entry from the save stack and a reverse link. It will be recalled that as we pass the switch we only use the normal link (function 1335), therefore we have not tried the reverse link yet. With this reverse link, BKTY I is referred to to determine the identity thereof. As the entries are retrieved from the save stack, they are deleted to ensure that we do not get into a closed loop.

If at some point decision point 1352 determines that the save stack is empty, then decision point 1354 determines if we have found any exits. It will be recalled from EXSG I that every signal we pass is marked as an exit. Thus, if we have found any exit, we will proceed to decision point 1356 to determine if the exit word equals zero. If the operator has not specified an exit signal, then the exit word will be zero and that concludes the routine. However, if the exit work does not equal zero, then function 1357 would set an error (and identify the element) code and conclude the routine. If the exit word is not equal to zero, it means we have a specified exit we were looking for and we had not achieved it. If we had achieved it, we would not have reached this point since we would have concluded the routine after decision point 1348 when we matched signal we passed as matching the exit word.

If decision point 1354 determines that we have not found any exits, then decision point 1355 checks if we are in a CTC mode. If not, that is another error condition. However, if we are in a CTC mode, then decision point 1358 determines if there are any more to the family. By way of explanation, in the CTC mode the operator would normally designate one or more switches, then a signal. A single control for a signal in the field may control one or more signals. However, the office and the control system treats each separately, that is each separate signal has an element block. The element block, however, identifies the other members of the family and therefore decision point 1358 can refer to the element block for the signal in question and determine if there are any other members to the family. If there are, function 1359 obtains the next one, marks it and returns to TAB I to search for this signal. Each member of a family refers to another member of that family which may refer to still another member, if there is one, and so on, in a chain. By marking this signal, we ensure that we do not enter into a closed loop. Thus, if we reach this signal again in trying different members of the family without success, we know there is no more to the family and refer to the error condition function 1357. Thus, by using the logic of TAB I with a specified entrance signal, we can either determine if a specified exit signal is achievable, by referring to the element blocks which may or may not connect the entrance or exit signal, or we can determine the identity of every potential exit signal in the site which is achievable from the entrance signal.

Referring again to FIG. 5G, after completing TAB I, decision point 560 determines if we have encountered any errors. If we have, decision point 561 determines if it was a fatal error. Any error in a CTC mode is a fatal error. On the other hand, in the NX mode we may have determined that a signal was unavailable to us (function 1302) or a switch was selected (function 1322). Any of these cases would not constitute a fatal error and function 563 would be performed to stack the requests and the status indication as a potential route as an entrance error pair and also identify the error element, that element which is unavailable, for storage in the low Q. If that occurred, that would conclude NXROT.

If there were no error on the operation of TAB I, then TAB II would be performed.

TAB II is entered with an entrance and exit location. However, in contrast to TAB I which proceeds to find all exits by starting at the entrance location, TAB II starts at the exit location and attempts to achieve the entrance location. The first decision point 1401 determines if a valid exit has been chosen. Some locations are not valid exits, and if one had been chosen, function 1402 would establish the error code to indicate this to the operator, clear all exits and return.

However, assuming a valid exit was chosen, function 1403 clears all other exits. Since TAB I proceeded this operation, a plurality of exits may be available. Of these, the operator has chosen one, and function 1403 clears the rest because their identification is no longer necessary. Decision point 1404 determines if the exit is an opposing signal. If it is not, function 1405 gets its reverse link. Since we are proceeding from exit to entrance, and we have determined that the signal is an inline signal, we want to mark the signal as the end of the route. However, if the exit was determined to be an opposing signal, function 1406 would get the forward link unless the forward link were zero or an off site location. In any event, function 1407 inserts a minus one in the recall word for the exit signal to indicate that it is the end of a route, and obtains the other link and refers to BKTY II to determine the identity of the other link.

BKTY II, with function 1409, obtains the data word for this other link, and, with decision points 1410 and 1411, determines whether it is a track section, a track signal or a track switch, and dispatches to the appropriate routine, either EXTK II, EXSG II or EXSW II, respectively.

If this link is a track section, EXTK II is referred to with decision point 1415 determines if the block is available. That is, has it been selected? If it is not available, then BACK-UP is referred to attempt to construct another route. However, if this track section is available, function 1417 puts the last link in the recall word for this track section. As a result, this track section's recall word now refers to the exit signal. Then, function 1418 gets the right link for the track section. Decision point 1419 determines if the last link equals the right link. If it does not, then it refers to BKTY II to determine the identity of this link. However, if the last link equals the right link, then the right link must be discarded and function 1420 gets the left link and refers to BKTY II again.

If, at some point, a link is determined to refer to a signal, then EXGS II is referred to. The first decision point 1444 determines if we have entered on a reverse link. If we have, then we know that this signal is not the entrance location (it is an opposing signal); therefore, function 1445 merely obtains the forward link and saves the recall word and refers to BKTY II to determine the identity of this element.

However, if we did not enter on a reverse link, then we may possibly be at the entrance signal. Function 1446 stores the last link in the recall word so that this signal's recall word will refer to the next element in the route. Function 1447 saves the block address for this signal in the recall area and decision point 1448 determines whether this signal equals the entrance signal. If it does, then the routine is completed. However, if it does not, then function 1449 obtains the reverse link and BKTY II is referred to to determine the identity of the next element.

If at some point an element is determined to be a switch, then EXSW is entered. There, decision point 1421 determines if we are in the CTC mode. If we are, then that means we must take the switch as we find it, and decision point 1422 determines if we have entered on the trail of the switch. If we have, function 1423 gets the link for the direction in which the switch is called and refers to J. Function 1400 stores the last link in the recall word of the switch and refers to BKTY II. However, if we have not entered on the trail of the switch (in the CTC mode), the routine skips to point F (FIG. 14E). There, function 1430 determines the way we have entered the switch, i.e., either normal or reverse by comparing the last link with the normal or reverse link in the element block of the site table for the switch. Once we have determined whether we have entered on the switch normal or reverse, decision point 1431 determines if there is an opposing call. If there is, decision point 1432 determines if the switch is automatic, unblocked and unlocked. If we were in the CTC mode, the switch would not be automatic and therefore we would refer to back-up. However, if there was no opposing call, function 1433 would get the trailing link and refer to point J (function 1400).

Assuming, however, that we were not in the CTC mode, then decision point 1424 determines if we entered on the trail of the switch. If not, the routine again skips to point F (FIG. 14E) and repeats the foregoing functions. However, in this case, the switch may well be in the automatic mode, unblocked and unlocked, and, therefore, even though there was an opposing call, the switch would be available, thus obtaining the trailing link at function 1433 and continuing on could result in an achievable route.

Figure 14F:
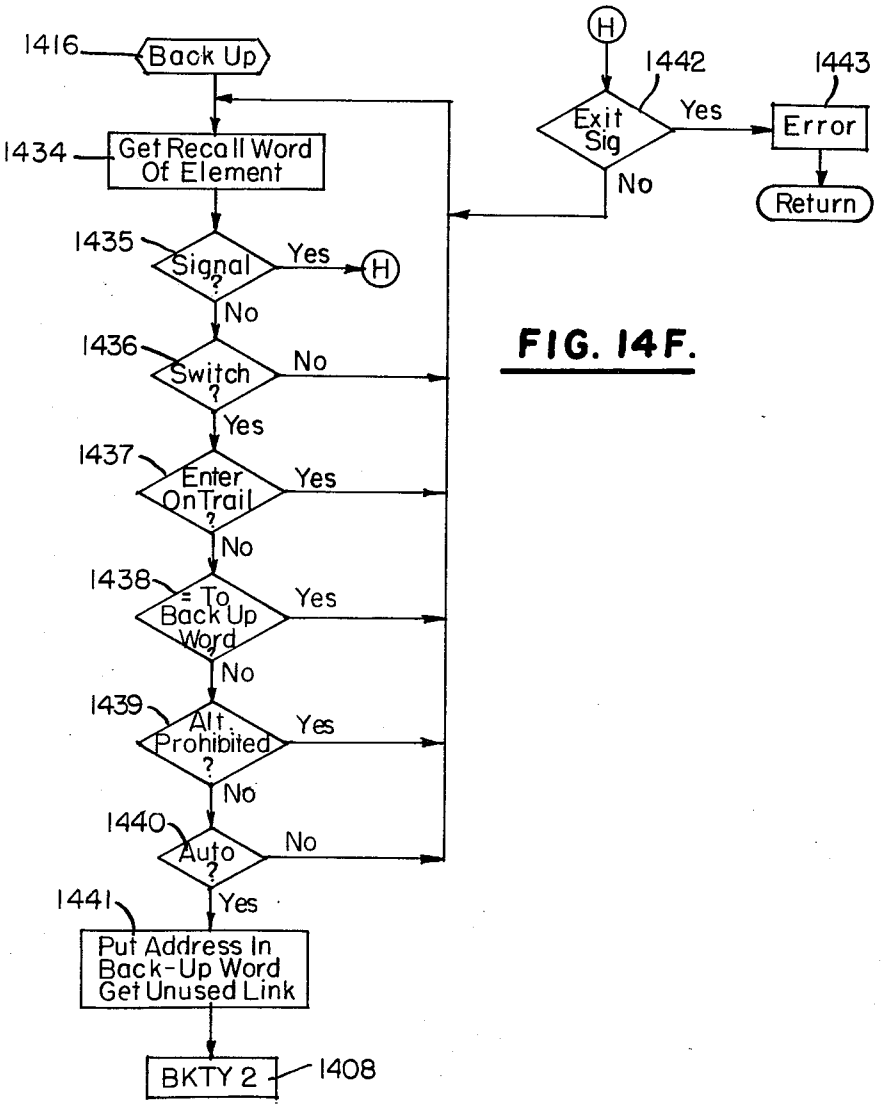

Assuming, however, that we entered on the trail of the switch, decision point 1425 determines if the switch is unblocked and unlocked. If it is, we get the preferred link, i.e., that link that is chosen in the priority routing table, store the link in the recall word of the switch, and refer to BKTY II to continue up the route. However, if the switch is either locked or blocked, then decision block 1426 determines if it is in the preferred condition. If it is, then we perform function 1428. However, if it is not, then we determine if the alternate condition of that switch is prohibited. If it is, we must proceed to back-up. If it is not, then function 1429 obtains the alternate link, stores the link in the recall word of the switch, and goes on the BKTY II to determine the identity of the link. Traffic conditions may make it impossible for us to reach our entrance point from the exit point with intervening switches in the preferred positions. In that event, what will occur is that the routine will not find the entrance signal selected, but, instead, will find a track link which is unavailable. Thus, we will be routed to BACK-UP. BACK-UP is illustrated in FIG. 14F.

The first function 1434 is to obtain the recall word of the element. This will point to the element we had last passed prior to attempting to reach the unavailable track section. Decision point 1434 determines if this is a signal. If it is, we skip to point H at which point decision point 1442 determines if this is the exit signal. If it is, that is a fatal error and function 1443 sets the error code and returns. However, assuming it is not, then function 1434 then gets the recall word for that signal which will be the next element between it and the exit. Decision point 1435 determines if it is a signal, and if it is, the same routine is performed. If it is not, decision point 1436 determines if it is a switch. It may well not be a switch, and then, function 1434 gets the recall word for that element which obtains the next element toward the exit signal. At some point in this routine, we will obtain an element which is a switch, if any switches had been passed. Of course, if no switches had been passed, then we may well, at some point, end in a fatal error. Assuming, however, that a switch had been passed in a preferred direction when we actually need the alternate route to obtain our entrance, decision point 1437 determines if we entered on the trail of the switch. If we had, there was really no choice in which direction we would exit from, and, therefore, we go back into the loop looking for a switch which we have some choice. Assuming we find such a switch which we did not enter on the trail, decision point 1438 determines if it is equal to the back-up word. As yet, we do not have a back-up word and so decision point 1439 determines if the alternate is prohibited to us. If it is not, then decision point 1440 determines if it is in the automatic mode. If it is, function 1441 puts the address of the switch in the back-up word and gets the unused link, i.e., the link we did not use in passing the switch in the previous pass. BKTY II then determines the identity of that link and continues in an attempt to reach the entrance point. If the switch is not in the automatic mode or if alternate is prohibited, then we continue in this loop looking for another switch which we can take in an unused direction in an attempt to reach our entrance point.

The routine terminates either by working our way all the way back to the exit signal without finding the entrance, or, at some point decision point 1448 determines that the signal we are at is equal to the entrance signal, and that completes the routine.

At each step in our way, we had arranged the recall words of adjacent elements to point to each other so that the recall word of the entrance signal now points to the next element in the route which has a recall word that points to the next element in the route and so on all the way to the exit signal.

Referring back now to FIG. 5G, we see that after running TAB II, decision point 561 determines if we have encountered an error. If we have, function 564 obtains the fatal error status code and function 565 makes a normal entry in a Q indicating that fact. However, assuming that we did not encounter an error and achieved the entrance signal, the routine ROUTE 543 would now be performed. That routing is illustrated in FIG. 19. At this point we have the entrance signal and any error elements and a code indicating the type of error.

Figures 19A, 19B:
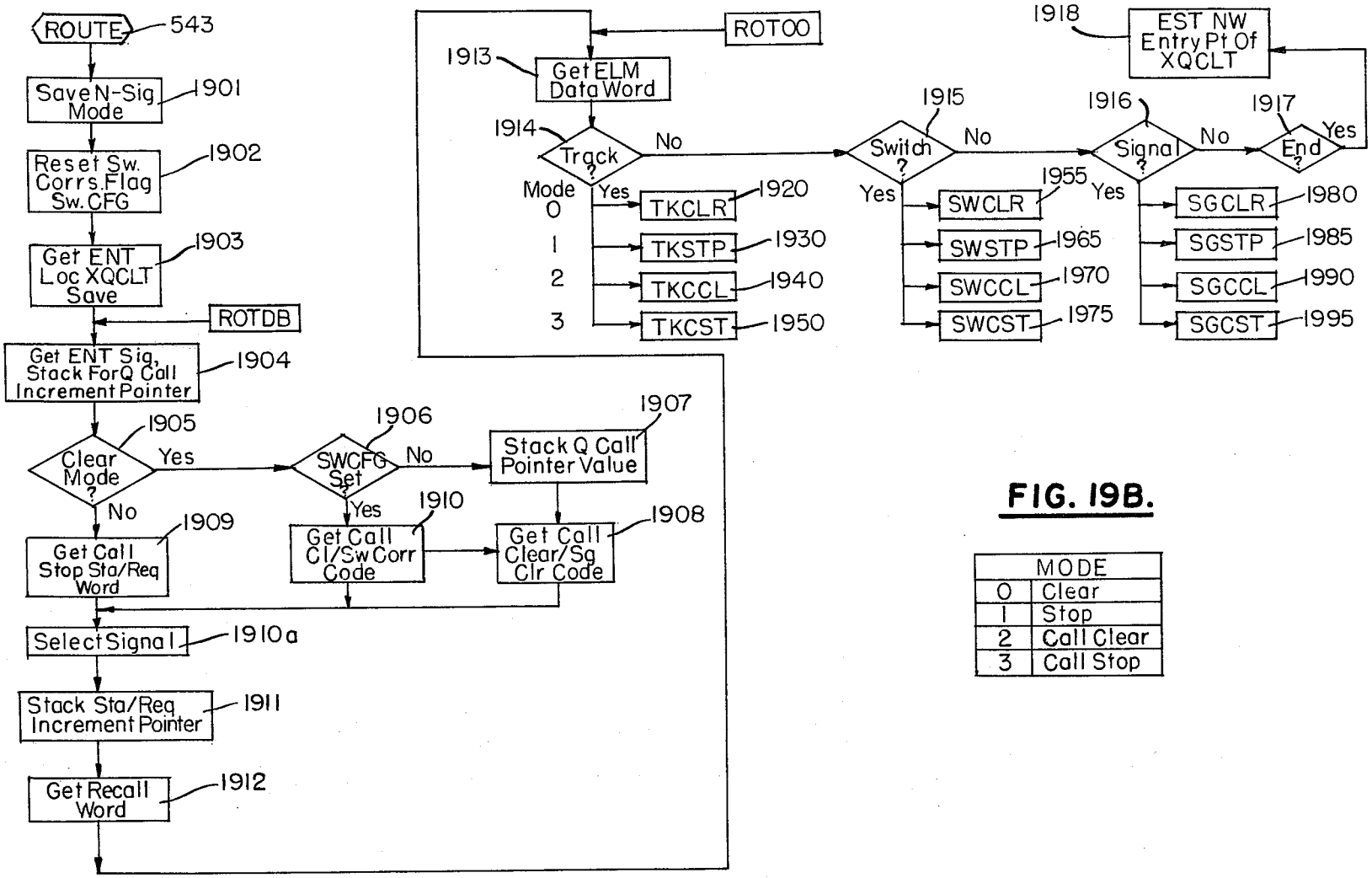
FIGS. 19A, 19B and 19C comprise a detailed flow chart of ROUTE.
Figure 19C:
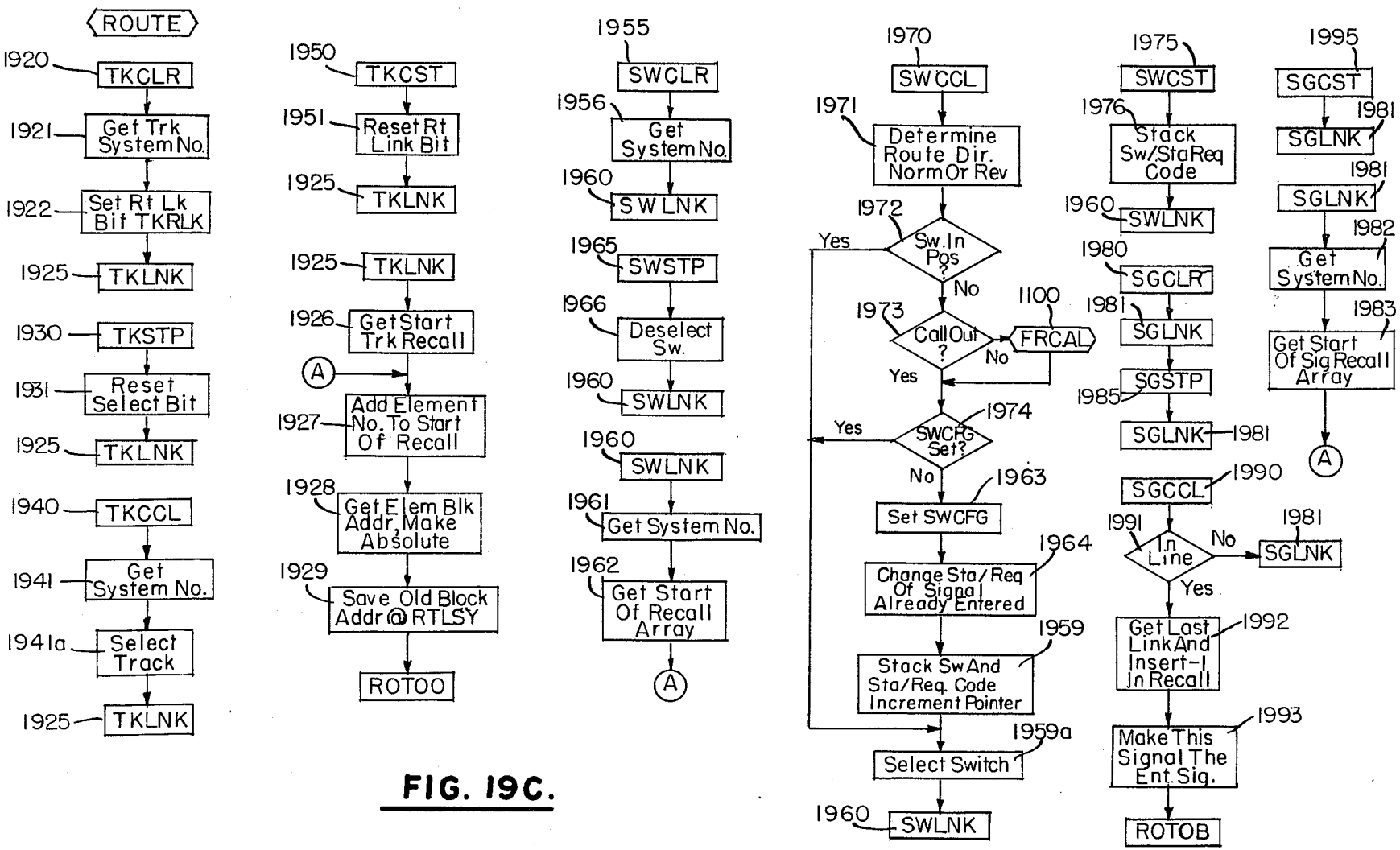

ROUTE is illustrated in FIGS. 19A, 19B and 19C. ROUTE performs a number of functions and the mode chart illustrated in FIG. 19B will be of assistance in explaining the various functions of this routine. We can consider that any route has four modes, that is, the stop mode when the route is not available, a call clear mode when signals have been requested clearing the route, a call stop mode when signals have been requested to put the route to stop and a clear mode when the route is available for use. Depending upon the mode in which ROUTE is entered, it will perform different functions. The mode in which ROUTE is entered is determined at the time it is entered. Thus, when entered after TAB II, the operator's request for a call clear would control the mode of ROUTE at this time. The first function 1901 obtains the entrance signal and the mode, and retains this information. Function 1902 resets the switch correspondence flag (SWCFG), the use of this flag will be discussed hereinafter. Function 1903 then obtains the entrance location for a stack of memory area referred to as XQCLT. Into this location and succeeding locations, ROUTE will insert the signal element, its request and status. After the stack is filled Q call will refer to it in making appropriate signal calls and in selecting appropriate entries for the high Q directory and low Q directory.

Function 1904 obtains the entrance signal, stacks it in XQCLT for Q call and increments the pointer to the stack. Decision point 1905 determines if we are in the clear mode and, since we are (call clear is considered clear), decision point 1906 determines if the switch correspondence flag is set. Since it was reset at function 1902, we then perform function 1907 to stack the Q call pointer value. Function 1908 then gets the call clear signal clear mode and stacks this as the next word in the XQCLT. Call clear represents the status and signal clear represents the request. Note that the processor has now changed the original NX request to a request to clear a signal.

At this point, a little philosophy is in order. Although the operator entry was an NX request identifying an exit and an entrance point, after the operation of TAB II which in effect define each necessary element in the route and, for switches the necessary position thereof, ROUTE and succeeding routines now treat the individual orders that are being built as if it were operating in a CTC (a unit lever) mode in which the operator designated desired switch position and signal conditions. In view of the foregoing, it is appropriate, although the operator entered request was NX, that the request is now referred to as a signal clear code. Thus, these may be referred to as psuedo CTC commands.

In any event, function 1910A selects the signal, function 1911 then stacks this status and request code beneath the element identification in XQCLT and increments the pointer so that the next word will be inserted below it. Function 1912 then obtains the recall word for the entrance element. As we have seen before, the recall word now points the next element in the route. Function 1913 then gets the data word for this element. The data word, of course, defines the type of element that it is. With this information, then decision points 1914 and 1915 and 1916 can determine whether the element is a track, switch or signal. Depending upon the result of that determination and on the mode zero, 1, 2 or 3 one of twelve subroutines will be entered TKCLR (track clear), TCSTP (track stop), TKCCL (track call clear), TKCST (track call stop), SWCLR (switch clear), SWSTP (switch stop), SWCCL (switch call clear), SWCST (switch call stop), SGCLR (signal clear), SGSTP (signal stop), SGCCL (signal call clear), or SGCST (signal call stop).

Subroutines just referred to are illustrated in FIG. 19C. In order to explain the construction of this subroutine, we will assume that our reference to the recall word (Function 1912) did bring up the address of the next element in the route which was a track section. Thus, the routine would be referred to TKCCL. In TKCCL (1940) the first function 1941 is to obtain the system number, the unique identification in the system of this element. Function 1941A then selects the track. We are then referred to TKLNK (1925). The first function here 1926 is to get the start of the track recall area and with function 1927 we add the element number (obtained at function 1941) to the start of the recall area. The result is an address in the recall area of the recall word for this track section. Of course, by reason of TAB II the recall area for that element contains the address of the next element in the route. Thus, with function 1928 we obtain that address. With function 1929 we save the track section's address at RTLSV and then through ROTOO get back to function 1913. We then obtain the data word for this new element, the one beyond the track section. Assuming that it is a switch, we would be referred to SWCCL. SWCCL 1970 is also illustrated in FIG. 19C. The first function there is to determine the route direction, that is should the switch be normal or reverse? This information was determined by TAB II which appropriately entered the recall word. Decision point 1972 then determines if the switch is in that position. This information is simply obtained from the indication table for this switch, the address for which is available in the element block table. Assuming it is, since the switch is properly positioned, no further entries are necessary.

However, if the switch was not in position, then decision point 1973 would determine if a call was out. Again this merely requires reference to the control table, and the specific bit which will provide this information is identified ina the element block table for this switch. If there is no call out, then FRCAL 1100 is performed to effect this function. We will explain this routine hereinafter. Thus, if a call is out or if FRCAL provides one, we next determine if SWCFG, the switch correspondence flag, is set. If this is the first switch we have come to, that flag would be reset (function 1902 - FIG. 19A). Since it is reset, function 1963 is performed to set this flag. If it was necessary to set this flag, then function 1964 would change the status and request code of a signal already entered in the stack from signal clear to signal clear waiting for switch correspondence. Subsequently, function 1959 would be performed to stack the switch and its status and request code. Function 1959 A then selects the switch whether or not any calls are necessary. Likewise, functions 1963 and 1964 would be omitted if the switch correspondence flag had already been set. This can safely be omitted since the flag is only set when at least one signal has its status request changed to waiting for switch correspondence which will protect the route from being cleared before the switch is in correspondence. After this operation has occured SWLNK is referred to which, at function 1961 gets the system number, which is available at the switch's element block. Function 1962 obtains the start of the recall array and the routine is referred to point A which obtains the block address for the next element in this route. Using this address, and routed through ROTOO, function 1913 again obtains the data word for the new element which defines the type of element that it is. Assuming that it is a signal, then SGCCL (1990) would be referred to. At this point, decision 1991 determines if this is an inline signal. If not, SGLNK is referred to at which functions 1981 through 1983 are performed and then the routine is directed to point A to perform functions 1927 through 1929. In effect, this series of functions merely obtains the address of the next element in the route.

However, if the signal was an inline signal function 1992 gets the last link, i.e., the link to the signal, and then inserts a minus one in the recall word. Thus the next time that link is referred to, it will indicate the end of a route. This is in line with the philosophy which was briefly referred to above in that the operation of ROUTE breaks the route which has been constructed into a series of minor routes from inline signal to inline signal. In order to continue the ROUTE function 1993 makes the signal, the entrance signal and refers back to ROTOB where again function 1904 is performed. In this fashion ROUTE processes each of the elements in the ROUTE as determined by the recall words for each element, determines the equivalent request, as if it were in the CTC (unit lever) mode, stores that request, and the status of that request in a stack, if any switches need positioning, appropriate calls are made.

Thus, at the conclusion of route, we have constructed a command string and processed it for validity. The same result could have been achieved if the operator had keyed in each switch move and each signal clear request individually.

Figure 11:
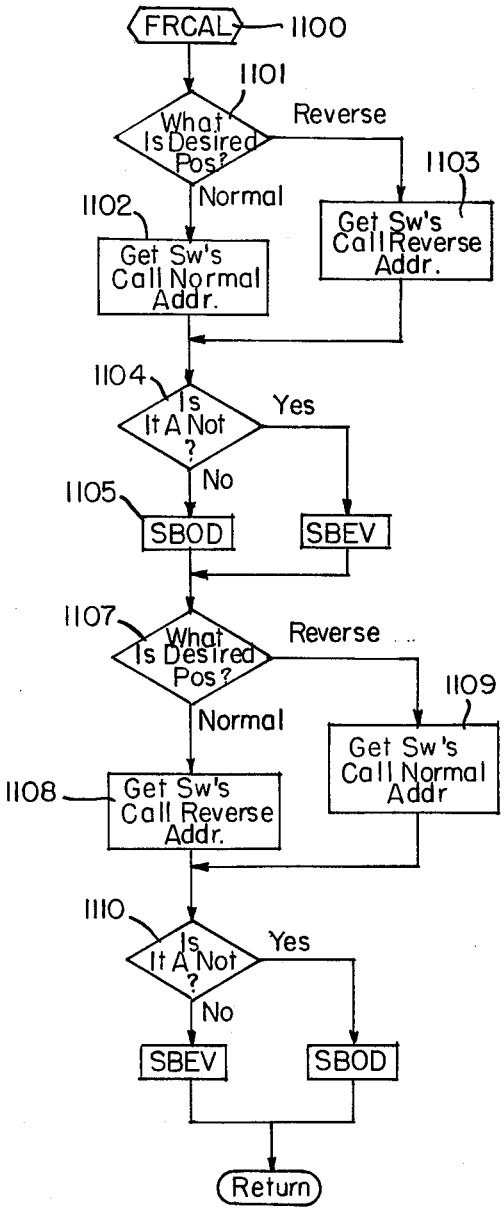
FIG. 11 is a detailed flow chart for FRCAL.

To complete the example, we can now refer to FIG. 11 where the format call (FRCAL) is illustrated. Decision point 1101 determines what the desired position of the switch is. If it is normal, then function 1102 obtains the address of that switch's call normal control, which is available at the switch's element block. Likewise, if we desired the switch in the reverse position, function 1103 would obtain the switch's call reverse address. Decision point 1104 determines if the code system that is in use is in positive or negative logic. If it is in positive logic, then function 1105 sets the bit odd, that is either the normal or reverse control bit is set. If it is in negative logic, then this bit is reset. In either case now when the controls are transmitted, the switch will be called to its desired position. Subsequently, decision point 1107 again determines the desired position of the switch. At this point the complimentry bits will be adjusted. Thus, if the switch is desired in a normal condition, function 1108 obtains the switch's call reverse control bit location. On the other hand, if the switch is desired in the reverse position, then function 1109 obtains the switch's call normal address. The decision point 1110 again determines if the code system is in positive or negative logic, and subsequent functions set or reset appropriate bits.

Figures 6A, 6F:
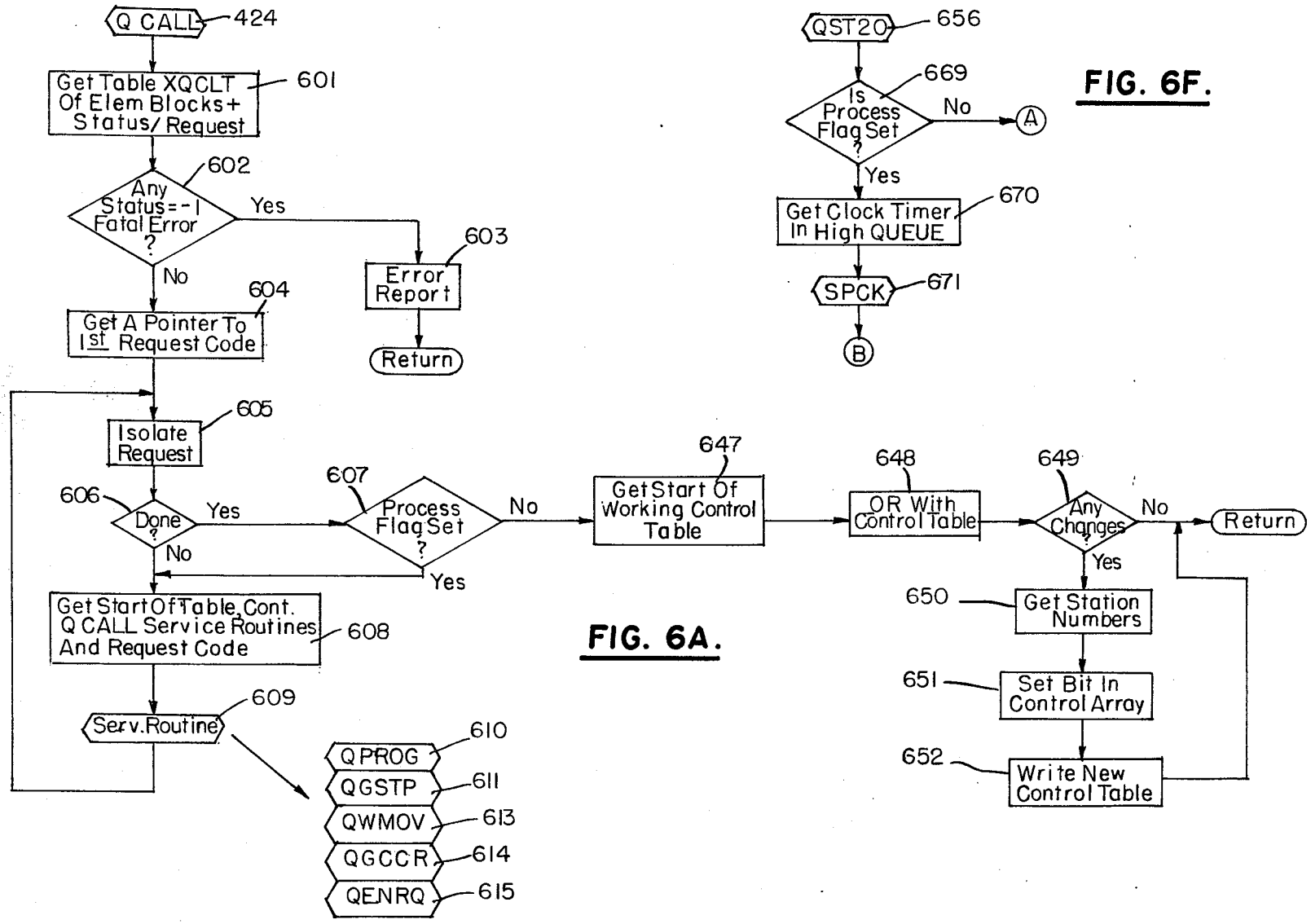

Now that we have reviewed the EXEC, NXROT, TAB I, TAB II and ROUTE, we note (see FIG. 3B) that Q call is the next routine. This routine is illustrated in FIG. 6. The entry into that routine is illustrated in FIG. 6A.

The previous processing routines have provided Q call with a table for each of the switches and signal elements which are to be controlled, the particular requests and the status of that request, and the identification of any elements on which the request must wait. The various service routines under Q call service these requests in a predetermined order which is, first QPROG, then QGSTP, OMOV, QGCLR, and QNERQ. More particularly, that is all entries calling for QPROG are processed before any others, and the remaining are processed in the order recited above, illustrated in FIG. 6A.

The first function is to get the table XQCLT in which entries have been made by ROUTE. Decision point 601 matches the status of each element block with the fatal error code, minus one. If there are any fatal errors, function 603 formats an error report.

Figure 6B:
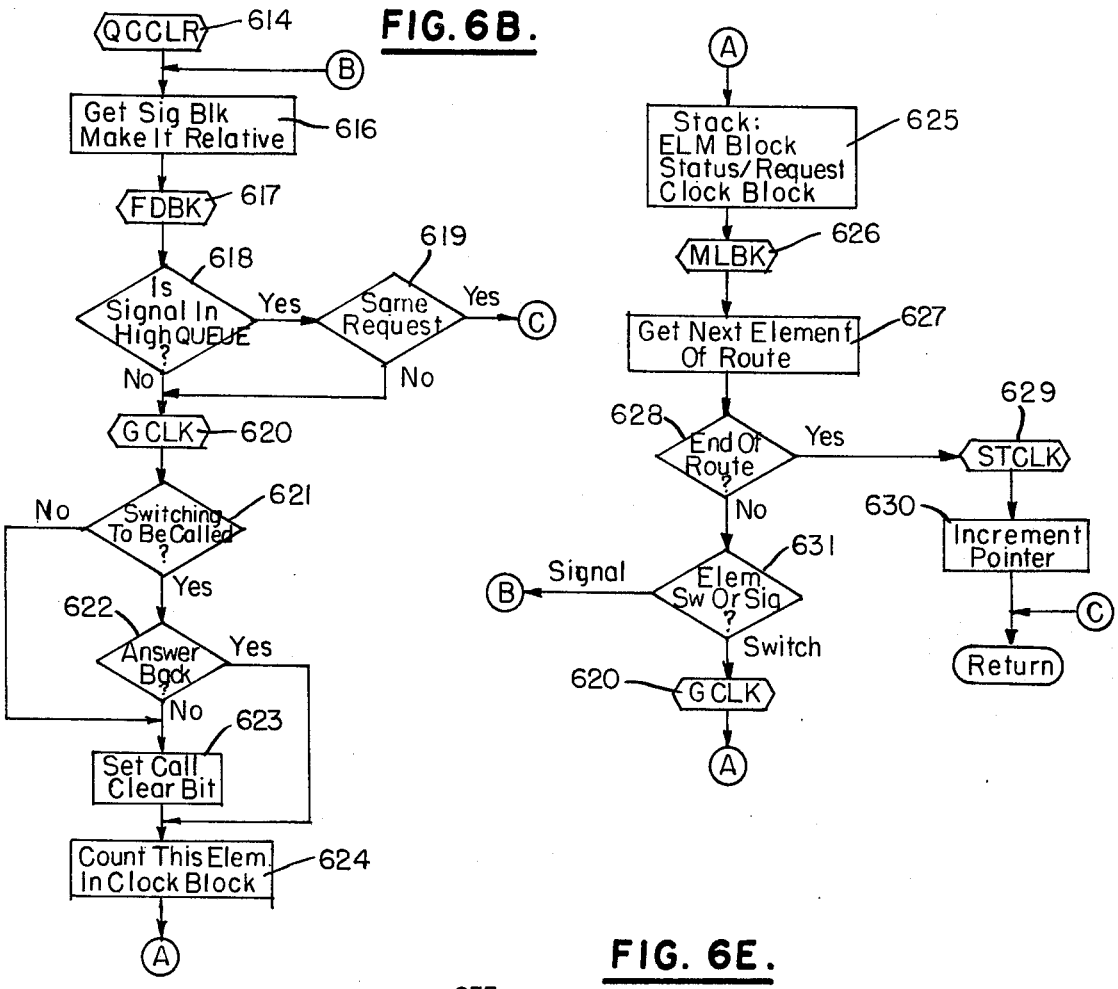
FIG. 6B is a detailed flow chart of QGCLR.
Figure 6E:
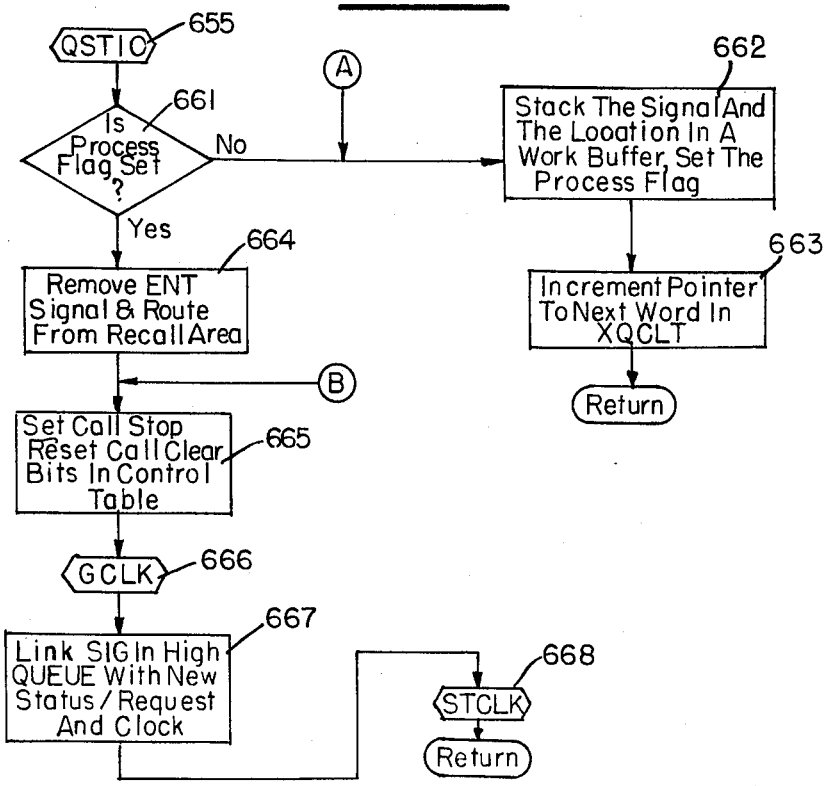

Assuming, however, that there were no fatal errors, function 604 obtains a pointer to the first request code. At this point, there are six request codes and the pointer is obtained to point to the first one. Function 605 isolates the request for the first entry in XQCLT. Decision point 606 determines if this is done. If not, function 608 gets the start of table XQCLT, and the table of service routines and the request code and dispatches to the appropriate subroutine. Either QPROG, QGSTP, QWMOV, QGCLR or QENRQ. As we discussed above, TAB II and ROUTE have converted the simple NX request into a series of subcommands or psuedo CTC controls for each signal and each switch must be necessarily thrown. FRCAL has already made the necessary switch calls and therefore the only thing remaining to be done is clear the necessary signals. To effect this, QGCLR (614) is entered. That is shown in FIG. 6B.

Function 616 obtains the signal block and makes the address relative. This merely requires subtracting the index into the site table. Function 617 then searches high Q area for the same signal. At the completion of FDBK, decision point 618 determines if the signal is in high Q. If it is, decision point 619 determines if it is the same request by a simple comparison. If it is, then the routine jumps to point C to the return, concluding this routine. However, assuming that either the signal is not in the high Q or it is not the same request, then function 620 obtains a clock. This is a routine shown in FIG. 7. That routine will be discussed in detail in connection with FIG. 7. It is merely necessary to note, here, that GCLK obtains a clock for this block and provides a cross reference between the clock ID and the block.

Decision point 621 then determines if switching is to be called. The status associated with this element will reveal whether or not switching is necessary. If it is not, function 623 sets the call clear bit in the working control table.

If switching was to be called and decision point 622 determines that the answer back has not yet occurred, then function 623 sets the call clear bit as before. However, if answer back has occurred, then it is not necessary to set the call clear bit and the routine skips immediately to function 624 where this signal element is counted in the clock block. One of the words in the clock block keeps a count of the number of elements waiting on that clock. Function 624 provides the manner in which this signal is recorded as waiting on that clock. The routine then jumps to point A.

Function 625 stacks the element block, the status/request code and the clock block identification using function 626 which fashions the appropriate block. This now is inserted in the high Q, however, the clock has not yet been started. Function 627 gets the next element of the route. This is available by merely referring to the recall word for the signal. Decision point 628 determines if we have reached the end of the route which will be identified by a minus one in the recall word. Assuming we have not, decision point 631 determines if the next element, the one beyond the signal is a switch or another signal. If it is a signal, we skip back to point B, and if it is a switch to perform GCLK once again to put this switch on the same clock. Then the program moves back to point A. In this fashion, we link each element for the route to each preceeding element with the appropriate status, and request code and for all the signals in the route we set the call clear bit. Switches are merely noted as being on the clock.

After we have preceeded through each switch and signal in the route, decision point 628 will determine that we have reached the end of the ROUTE and function 629 will start the clock. This routine is illustrated in FIG. 8. Subsequently, the pointer to XQCLT is incremented at function 630 and will return having completed this pass.

With the completion of all necessary service routines, decision point 607 determines if the process flag is set. The reason for this will become clear hereinafter. If it is not, then function 647 gets the start of the working control table, that is the table that GCNTB copied into a work area from the control tables for all stations on the site that is being operated with. The various functions that have been performed in the subroutines referred to above which have set or reset control bits have taken that action in the working control table and not in the actual control table, for the reasons expressed above. At this point, however, the executive is almost completed and in order to make the controls effective, they must be inserted into the actual control table. Function 648 then exclusive OR's the bits in the working control table with the corresponding bits in the acutal control table. Of course, if they are identical, decision point 649 will detect no changes and that will conclude the routine. With the working control bits the same as the actual control bits, there is no necessity to make any change in the actual control table. However, if the exclusive OR operation results in any bits being set, then decision point 649 will detect changed bits. Function 650 obtains the station numbers corresponding to the bits which are set indicating changes in controls. Functions 651 then sets a bit in the control array for each of the stations obtained at function 650. Function 652 replaces the actual control table with the contents of the working control table. That concludes Q call.

Figure 10:
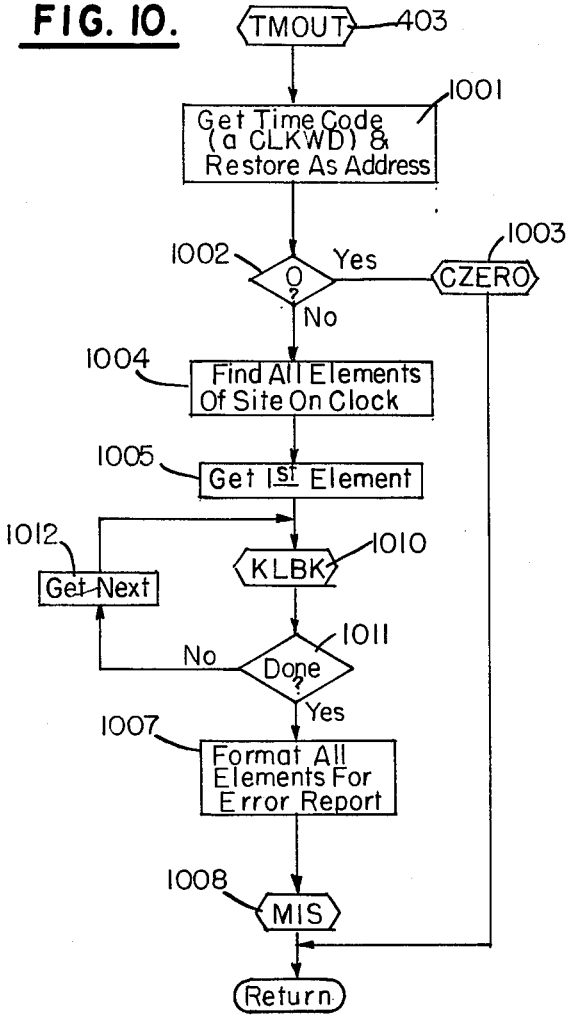
FIG. 10 is a detailed flow chart for TMOUT.

With the appropriate bits set in the control array, the communications subsystem will recognize that there are controls pending for the associated stations. This will initiate a communications cycle with each of those stations as is more fully explained in the Pulverenti et al application (GR-391) filed Assuming that the operator's NX request had thus been processed, a communication subsystem would now receive a signal indicating that there were controls pending, and these switch and signal controls would be transmitted to the field. Meanwhile, the clock which had been started is now running. Assuming that the clock timer had expired with no intervening activity at this site, the EXEC will again be called (FIG. 4A) at this time, however, decision point 402 will indicate that the caller was a time-out and the routine TMOUT would be performed. For this routine, see FIG. 10. The first function, 1001 gets the identification of the timer and stores it at an address. Decision point 1002 determines whether the first word in the address is zero. If it is, function 1003 (CZERO) merely releases the block for it is no longer necessary and that concludes the program. However, if the first entry in the clock block is not zero, then function 1004 defines all elements of the site that are on this clock. The number of elements which are on the clock is contained in the clock block as a count. Furthermore, by checking clock ID's we find the elements on the clock.

Function 1005 gets the first element and function 1010 kills the linkage block for that element, in effect erasing that element from the high Q. Decision point 1011 determines if we have completed all the elements that were on the clock which expired. If not, function 1012 gets the next element and function 1010 kills that linkage block. This loop is traversed until the linkage blocks for each of the elements has been erased. At that point, function 1007 formats all elements for error report and MIS (1008) creates an error report. That concludes the TMOUT routine.

At this point it would be appropriate to explain the other service routines which are available in response to operator key in requests. The first of these routines, BLOCK, is shown in FIG. 5A.

BLOCK can be entered in response to one of four different requests, cancel a signal block, cancel a switch block, initiate a signal block, or initiate a switch block. These commands are differentiated by their codes, and the codes are respectively 2, 3, 4, or 5. The first decision point, 514 determines if the request code is 2 or 3. If it is, then function 501 must be performed to set the flag cancel block to show that the routine is being performed to cancel a particular block. However, if the request code is not 2 or 3, that is if it is 4 or 5, then we are initiating a block and therefore function 501 is omitted.

Subsequently, function 502 is performed to save the return and get the elements of data word whose identity has been keyed in the operator. With the data word, decision points 503 and 504 can determine if this is a switch or a signal. Assuming it is a switch, decision point 508 determines if the cancel block flag was set. If it was set, then function 509 sets the BLOCK bit even, and if not, function 510 sets the bit odd. Function 511 makes a normal entry in a Q and function 512 resets the cancel flag so that is is ready for further operations.

Similar functions are performed if the element is a signal except that an additional decision point 505 is checked to determine if the signal has a blocking option. Some signals cannot be blocked and, if the signal does not have the block option, then function 512 merely resets the cancel flag and that concludes the routine. Blocking does not require any communications to the field since that is an internal status.

The next service routine available is SWMOD, illustrated in 5B. The purpose of this routine is merely to determine the mode of the switch, whether manual or automatic. If the switch is in the manual mode, then the system is not allowed to throw the switch, and only the operator can initiate a switch movement. The request code for switch automatic is 7 and therefore the first decision point 525 determines if that is the request code. If it is, then function 516 is performed to set a flag to indicate the switch should be in the automatic mode. If the request code is not equal to 7, then function 516 is skipped. Function 517 saves the return and gets the element's data word. Decision point 518 determines if the element is a switch. If not, the flag is reset, to ensure that it is in the reset condition and the routine concludes. If the element was a switch, decision point 519 determines if the switch has this option. If not, again the flag is reset and the routine concludes. However, if the option is available, decision point 520 determines that the automatic flag is set. If it is, function 522 sets a bit to indicate the switch is in the automatic mode, a normal entry is made in a Q and function 524 resets the flag so that it is available for further processing. If the automatic flag is not set, then the bit is set odd and functions 523 and 524 are performed to conclude the routine. Again, the mode of the switch is merely an internal status and therefore no controls are necessary.

The operator may also key in a switch movement. The service routine for that is illustrated in FIG. 5C.

There are two possible switch moves, the switch can be called normal or reverse. Function 526 saves the return and obtains the call normal or reverse and gets the element's data word. Of course, the element has been identified by the operator. Obtaining the data word merely requires reference to the element block in the site table. Decision point 527 determines if the element is a switch. If it is not, then it results in an error status code identifying the fact that the operator has called a switch movement on an element which is not a switch. Function 533 makes a normal entry in a Q to indicate that status and that concludes the routine. However, assuming the element was a switch, decision point 528 determines if the switch is blocked, locked or selected. If any of these are true, function 530 gets the error status, whether blocked, locked or selected and appends the request and the error status via function 533 in a Q. Assuming, however, that the switch is neither blocked, locked or selected, function 529 sets a bit for switch reverse or resets the bit for switch normal in accordance with the operator's request. At that point FRCAL is called (function 531) to actually make the entry in the control table which has the effect of moving the switch. This routine is illustrated in FIG. 11 and since it has been discussed previously, no further discussion thereof is deemed necessary. However, when this routine is concluded, the EXEC will reference Q call which in turn, in light of the request, will reference QMOV (which is illustrated in FIG. 6C).

Referring now to FIG. 6C, the first decision point 635 determines if this is a low Q entry. The error status would indicate that fact. For instance, if the switch is selected, this would result a low Q entry. The other error status that was possible as a result of FIG. 5C is a switch movement call on an element which is not a switch or a blocked or locked switch. Any of these errors would result in a fatal error and Q call (FIG. 6A) would delete that and make an appropriate error report.

If this was to be a low Q entry, the routine would skip the point B with function 644 would stack the element block, that is the address of the element, the status and request code and the element that it was waiting on. In this case, it would be the switch itself. Function 645 makes a block entry and function 643 increments the pointer to the next entry in the QXCLT table which includes the input for this subroutine so that when Q call is returned to the next entry in this Q will be selected for processing.

However, assuming that this was not to be a low Q entry, decision point 636 determines if the switch or any of its family is selected. The meaning of the word family has been discussed above, and, if it is, function 643 merely increments the pointer and that concludes the processing.

If the switch or its family is not selected and it does not correspond to a low Q entry, function 637 examines the high Q to see if that element is already in the high Q. Decision point 638 determines whether or not such an entry was found. If no such entry was found, the routine skips the point A, and function 647 obtains a clock. Function 648 stacks the element block, the status and request and the clock ID, function 649 moves the stack to an appropriate location which is available and function 650 starts the clock running. Function 643 then increments the pointer and returns.

If the switch was found in the high Q, decision point 639 determines if it is the same request. If it is, function 643 increments the pointer and returns.

If it is not, however, the system assumes the operator has cancelled the previous request and function 640 stops the clock. Function 641 obtains a new clock and function 642 starts the clock in the high Q block. Function 646 starts the clock and then the pointer is incremented and that concludes the routine.

Returning now to the exec's service routines, another serice routine is CROUT which is illustrated in FIG. 5B. This routine is entered for any CTC (unit lever) type request entered by the operator. The first functions 536 establishes the CTC code to TAB. In discussing the routines TAB I and TAB II, the exit from a number of decision points depend on the mode, NX or CTC. Function 536 writes an appropriate word to indicate that TAB will be run in the CTC mode. Function 536 gets the signal which is involved and the page start for the site table. Usually a CTC request may involve a number of switches and a single signal. With that information, TAB I is called. As we have mentioned, the service routines which we are now discussing are called in a predetermined order as follows: stop signal, cancel signal block, cancel switch block, initiate signal block, initiates switch block, initiate switch manual, restore switch automatic, call switch normal, call switch reverse, clear signal, entrance signal, exit signal, NX. Thus, when the operator enters a command string with a mixed number of requests, all requests for stop signal are serviced before any other requests, etc. As a result, before CROUT is entered, call switch normal and call switch reverse will have been serviced. As a result, the switch calls entered by the operator would be in the working control table (since these routines use FRCAL). Thus, the operator's signal clearing requests are checked against the switch positions that the operator has requested.

Reference briefly to TAB I (FIG. 13) illustrates that TAB I begins at the signal requested and links along in an attempt to find the next in line signal. If any switches are passed, as discussed above, the system assumes the switches are in the position to which the operator called them. If an in line signal is reached (decision point 1346 - FIG. 13E) the signal is marked as an exit and at decision point 1348 TAB I concludes. Decision point 539 (FIG. 5D) determines if a failure has been detected. Any failure, in the CTC mode is a fatal error and thus function 545 stacks for Q call with the error status. If such an error is detected after function 545, function 544 is performed to clear all flags and work words and return to the executive.

Assuming, however, that no failure was detected, function 540 gets the exit signal (in this case the in line signal which TAB I marked as an exit, function 1347 - FIG. 13E). As we saw in the discussion of TAB II, TAB II begins at the exit signal and links back. At switches, since they are in the CTC mode, decision point 1442 determines if we entered on the trail. If we did, function 1423 gets the called link, that is the link for the position in which the switch is called and we continue to work back to the entrance signal. If we have not entered on the trail, then we merely obtain the trailing link. And continue. At some point, EXSG² (FIG. 14G) will determine that the signal we have reached is the entrance signal and that would conclude the routine. As before, with either mode of operation, the recall words of the various elements of the route now refer to each other. Assuming that no failure was detected, decision point 542 would then skip the program to function 543, ROUTE. That subroutine is shown in FIG. 19. ROUTE will now merely stack the various elements along with their status and request codes for Q call. At the conclusion of ROUTE, function 544 clears all flags and work words and that concludes CROUT.

The next two routines ENROT (FIG. 5E) and EXROT (FIG. 5F) are merely subsets of NXROT which has previously been discussed. ENROT begins with the entrance signal and determines if there was an exit point with the signal. If there is, NXROT is performed. If not, function 548 ensures that the exit word equals zero. With that, TAB I is performed and decision point 548 determines if a failure occurred in the operation of TAB I. If there was a failure, function 548 gets the failure status and makes a normal entry in the Q for the use of Q call. EXROT merely performs those NXROT functions which are not performed by ENROT. That is, an exit signal is obtained (if there is not exit signal that is a fatal error). TAB II is then performed and then ROUTE. ENROT allows the operator to designate an entrance only, in the NX mode. ENROT processes this to the extent possible. As a result, the operator can later return, after dealing with other sites, if necessary, and designate an exit. At this time EXROT picks up where ENROT left off and completes the processing for this route and makes the information available to Q call.

Figure 5H:
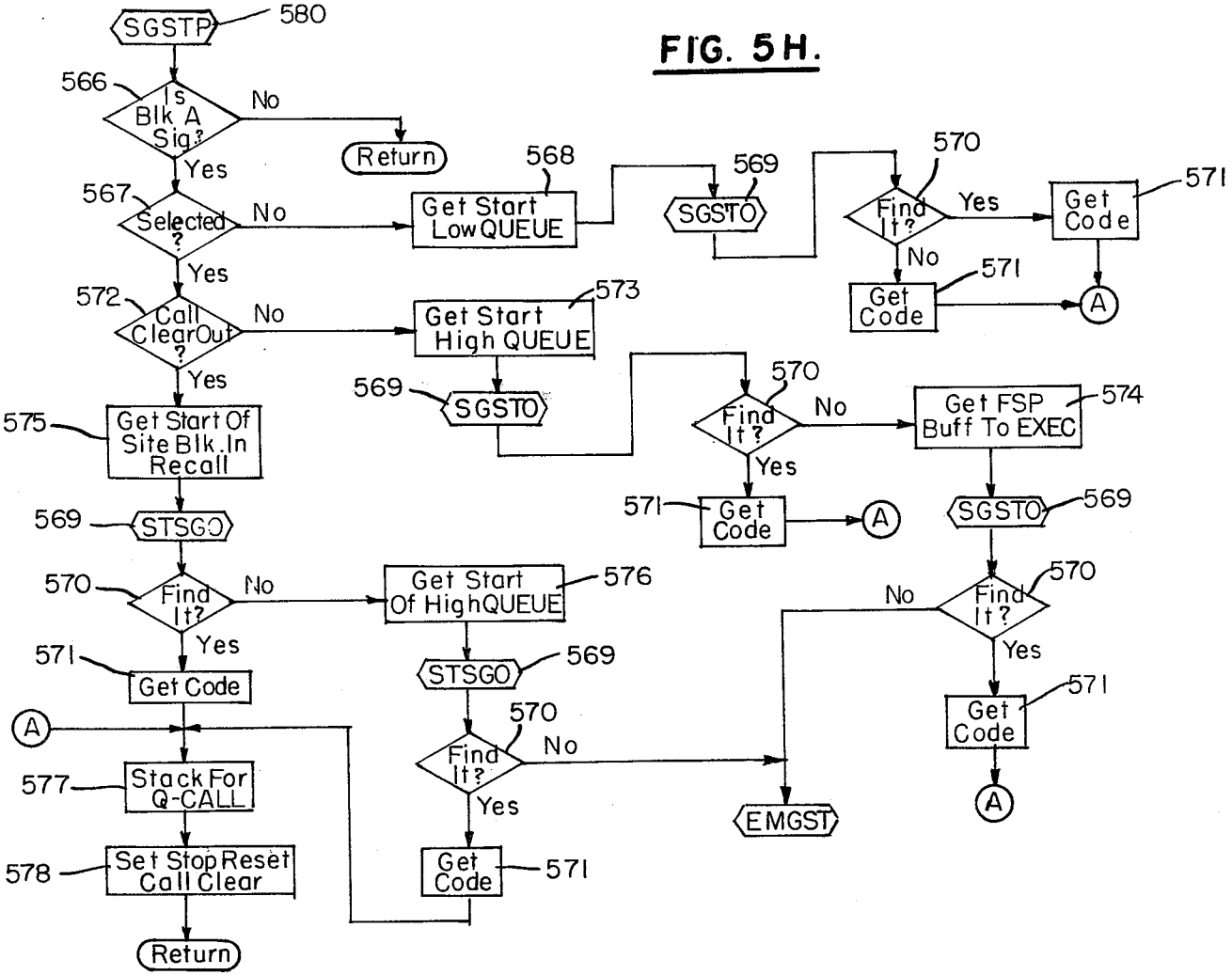
FIG. 5H is a detailed flow chart of SGSTP.

The next of the service routines, signal stop (SGSTP) is illustrated in FIG. 5H. Although calling a signal to stop is a very simple matter, this routine is complicated by the fact that the system must properly handle any entries in the high Q, low Q, recall areas in view of the operator's request to stop the signal. In order to effect this, decision point 566 determines if the block is a signal. If it is not, that concludes the routine, for the system cannot stop a block which is not a signal.

If the block is a signal, decision point 567 determines if it is selected. If it is not, function 568 gets the start of the low Q and function 569 searches the low Q for an entry for this signal block. Decision point 570 determines if it was found. It if was found, then functions 571 obtains the code for the location of the signal. The different codes and the different possible locations of the signal are illustrated in FIG. 5J. Thus, if the signal block was found in the low Q, the code would be 4 and the routine would skip to point A where function 577 would stack the status and the request code for Q call and function 578 would set the stop and reset the call clear. That would conclude SGSTP for this case.

However, assuming that a signal was not selected and it was not found in the low Q, then function 571 would obtain a code of 6, since the signal's location is unknown and also skip to point A.

However, assuming that the signal was selected, decision point 572 determines if there was a call clear out. This merely requires reference to the control for this signal. If there was not, then function 573 obtains the starting address for the high Q and function 569 searches through the high Q for an entry for this signal. If decision point 570 determines that it was found in the high Q, then function 571 obtains the code (a code of 3 - since the signal was found in the high Q but the call was not out) and the routine skips to point A. However, if there was no entry in high Q, then function 574 obtains the field status process buffer which is used to pass information from the field status processor to the EXEC. (More about this buffer will be discussed in relation to the field status processor). At this point it is sufficient to note that the buffer is merely a memory area which may or may not contain an entry for this signal. Function 569 searches the buffer and decision point 570 branches the routine depending upon whether or not is was found. If it was, function 571 gets the code (a code of 5) and the routine skips to point A. If it was not found, then the routine operates EMGST (emergency stop).

However, if the call clear signal was out, then function 575 would get the start of the site block in the recall directory and function 569 would search for an entry for this signal. Decision point 570 branches the routine, if it is found function 571 obtains the code (in this case 1) and functions 577 and 578 are performed. However, if it was not found in the recall directory, then function 576 gets the start of the high Q. Functions 569 and 570 are then performed. If it is not found, EMGST is performed. If it is, the code is obtained (a code of 2) and functions 577 and 578 are performed. Thus, signal stop in addition to setting the stop bit and resetting the call clear bit in the control area for this signal determines at what point in the processing the signal has achieved and stacks for Q call with an indication of this information, i.e., one of the codes 1–6.

Figure 5I:
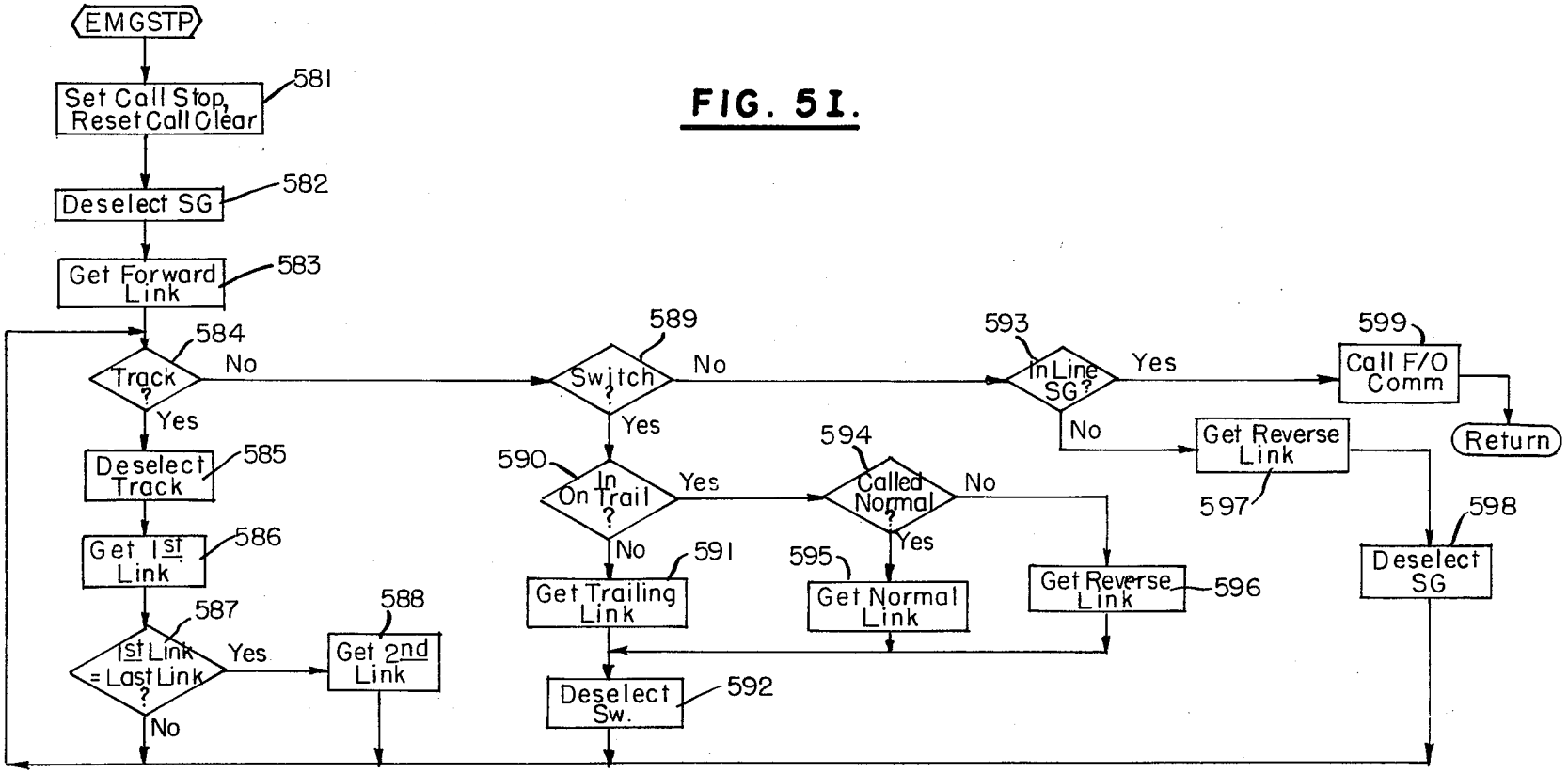
FIG. 5I is a detailed flow chart of EMGST.

If the signal is not found in the low Q, high Q, recall area or FSP buffer, then emergency stop is performed. This routine is illustrated in FIG. 5I.

This routine deselects the signal and any succeeding elements up to the next inline signal. Since the signal was not located in the low or high Q or the recall directory, the routine does not rely on recall words to locate succeeding elements for deselection. Since the routine is entered with identification of the relevant signal, function 581 sets the call stop and resets the call clear. Function 582 deselects the signal and function 583 gets the forward link. Decision points 584 and 589 branch the routine depending on the type of element obtained as the forward link.

If the forward element was a track, function 585 deselects the track and function 586 gets the first track link. Decision point 587 compares the first track link with the last link. If different, the routine loops back to determine the type of link. If the same function 588 gets the other track link and the routine loops back to determine the type.

If the element is a switch, decision point 590 determines if we have entered on the trail. If not, function 591 gets the trailing link.

If we entered on the trail, decision point 594 determines if the switch was called normal. If it was, function 595 gets the normal link and, if it was not, function 596 gets the reverse link. After functions 591, 595 or 596 are performed, function 592 deselects the switch and the routine loops back to determine the element type.

If the element is a signal, decision point 593 determines if it is an inline signal. If it is, function 599 calls the communication system and the routine is concluded. If not, function 597 gets the reverse link, function 598 deselects the signal and the routine loops back to determine the element type.

We have now concluded discussing each of the special service routines which the executive may dispatch to in light of the operator's requests. At the conclusion of these service routines, Q call is called for performing the function of managing the arrays in light of the results of the previous processing operations. We have already discussed Q call, OGCLR and OMOV. The Q call routines remaining to be discussed are QGSTP, QROG and QNERO.

QGSTP is illustrated in FIGS. 6D - 6G. Referring first to FIG. 6D, function 653 gets the location code from the status/request word. The location code is the location in which the routine SGSTP found the signal to be residing. Those codes are set forth in FIG. 5J. Assuming that the code was 1, that is the signal call was out and the signal was located in the recall area, function 654 dispatches to routine QST10 (655).

There, decision point 661 determines if the process flag is set. The manner in which this flag is set will become clear hereinafter. At this stage it is sufficient to note that the process flag is not set and therefore function 662 stacks the signal and the location, that is the recall area, in a work buffer and sets the process flag. Function 663 increments the pointer to the next word in XQCLT for processing.

Assuming that the signal was found in high Q with the signal call out, the location code would be 2 and function 664 would dispatch the routine QST20 (FIG. 6F). There, decision point 669 again checks to see if the process flag is set. Since it is not, functions 662 and 663 are performed.

Assuming that the signal was located in high Q with no call having yet been put in to clear the signal, the routine QST30 (657 - FIG. 6G) is dispatched to. There, function 672 releases the signal block from the high Q and function 673 gets the call stop mode. In this mode, ROUTE is entered. After ROUTE accomplishes its function in the call stop mode, function 675 gets the stop mode and ROUTE is again performed. These two passes through ROUTE ensure that the select bits for any elements in the route have been reset and the recall words for the elements have been deleted. That concludes the processing functions for this routine and function 677 increments the pointer.

If the signal was located in the low Q, function 678 merely releases the signal from the low Q, the pointer is incremented and another entry is processed.

If the signal was located in the field status buffer, the routine QST50 (FIG. 6G) is dispatched to. There, function 679 gets that buffer and distorts the request code so that when the EXEC reaches this request it will not respond to it.

The process flag, which has been referred to, ensures that any routines leading to signals in the high Q (with no call out) or with signals located in the low Q or the field status process buffer will be serviced before signals are serviced which have calls out.

After all the original stack of routines awaiting processing by Q call have been completed, decision point 606 (FIG. 6A) will determine that all entries have been processed. Decision point 607 now determines if the process flag is set and if set, returns and looks for those entries for which we set the process flag. If the entry related to a signal which is located in the recall area QST10 would again be dispatch to. There, decision point 661 would determine that the process flag was set. Function 664 would remove the entrance signal and the route from the recall area. This is accomplished by merely removing a word in the recall directory related to that route. Function 665 sets the call stop, resets the call clear bits in the control table and function 666 gets a clock. Function 667 links a signal in high Q with the new status and request and the clock identity. Function 668 starts the clock running and that concludes the processing.

If a signal is located in the high Q, routine QST20 (FIG. 6F) would be referred to. There, after decision point 669 determined that the process flag was set, function 670 would get the clock timer associated with that signal in the high Q. Function 671 would stop that clock and the routine would skip to point B at which point the functions 665 – 668 would be performed to set the call stop, reset the call clear, get a clock, link the signal in the high Q with the new status/request and the clock and start the clock.

Q call dispatches to QENRQ in a case of a route which is unavailable but which the system expects may become available due to changing traffic conditions and the like. The major function accomplished in this routine is performed by function 680 which stacks the entrance signal, status/request, the element that must be released for the route and the exit point. Function 681 makes a block for this information in the low Q and then returns.

The only Q call service routine not yet discussed is QPROG. This is a routine for handling a switch unclocking operation. Since the operator cannot control this condition, the code for calling this routine is generated by function 1976 (FIG. 19C) of ROUTE. When QPROG is operated, function 682 gets a clock. Function 683 stacks the switch element in high queue with the status/request code and clock identification. Function 684 starts the clock and that concludes the routine.

Thus far explained the service routines associated with the EXEC obtain entrance and exit points for a route, and the exit point may or may not be real. If no exit point has been specified, such as in the CTC mode, or in the NX mode wherein the operator has not yet designated the exit point, an exit point of zero is used. In the CTC mode the system will select, as an exit point, the first in line signal passed. In the NX mode, the TAB I routine will determine all possible exit points so that when the operator designates the exit point the system can easily determine if he has chosen a valid exit point. After establishing the validity of the route, ROUTE makes the appropriate linkages between the elements of the route and Q call stacks the route in the high Q if it is available, and the low Q if the route must wait for the deselection of an element. At the conclusion of Q call the actual control bits are set and the calls are made. If the timer associated with a high Q route expires, TMOUT handles the situation by destroying the entry in high Q and informing the operator.

Figure 15A:
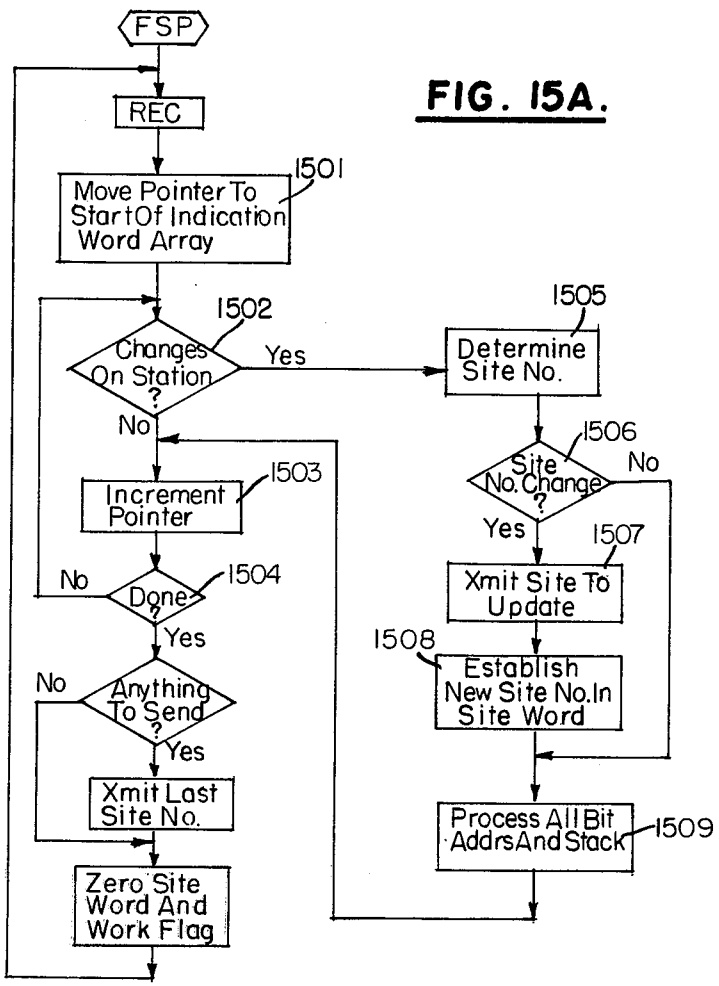
FIG. 15A is a detailed flow chart of FSP.

The system's link to the received indications is via the field status processor (FSP). This routine is illustrated in FIG. 15A. Before referring to FIG. 15A, however, we can refer to FIG. 3C to see some of the major routines that will be utilized in processing indications from the field. When FSP recognizes changed indications, UPDATE is called. This routine determines whether the site associated with the changed bits have an active recall or an active Q. If there are any change indication bits which do not correspond to an active recall or active Q, then UPDATE may refer to PUWBA (process unknown switch bit addresses) and/or PUGBA (process unknown signal bit addresses). After those routines are concluded, if necessary, PRCBA (process recall bit addresses) is operated. As we have discussed before, a site will have an active recall only when a route is lined and cleared. When indications come in from such a route, they occur because a train, for which the route has been lined, has accepted the route and entered it. Thus PRCBA handles the entries necessary to reflect that fact.

PWGBA (process wait bit addresses) processes changed indications for the sites which have either an active high Q or low Q. This routine may call on ROUTE to make appropriate entries.

As a result of the train movements which cause indication changes, it may be necessary to move an identified train's designation from one track section to another. This process is handled by TRACK which may call FAMILY. Finally, as a train accepts a route, enters an element of the route and then leaves that element, that element may now be deselected. This process is handled by SLOT and SHROT (shorten route).

Figure 16:
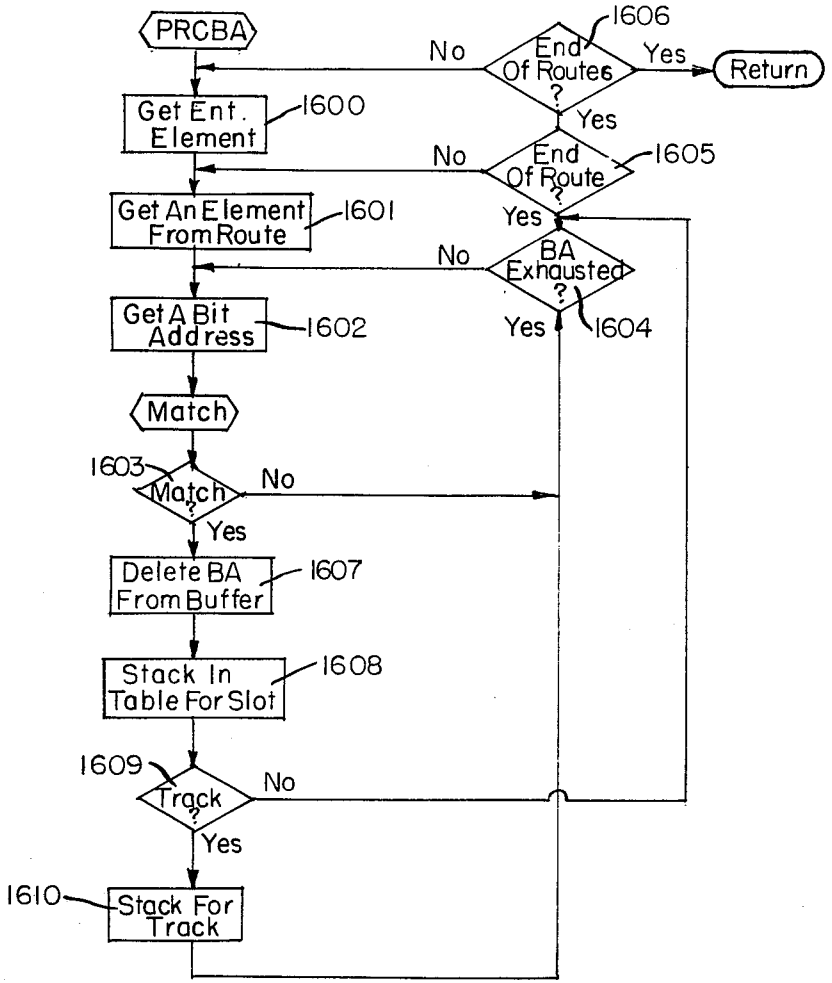
FIG. 16 is a detailed flow chart of PRCBA.

At this point, we can refer to FIG. 15A which illustrates FSP. This routine waits in the receiver mode. The communication system only calls the field status processor when it has identified an indication message or messages which include indication bits which have changed. Therefore, when FSP is entered, there should be at least one changed bit in the indication message. The first function 1501 moves a pointer to the start of the indication word array, and decision point 1502 determines if there are any changes in the indications words for the station to which the pointer is pointing at. If there are none, function 1503 increments the pointer and decision point 1504 determines if we are done. We are done when the pointer has worked through the control territory. Assuming we are not done, decision point 1502 determines whether there are any bit changes on the station which the pointer is now pointing at. At some point, we will detect bit changes. At that point, function 1505 determines the site number. And decision point 1506 determines if the site number has changed. That is, does the site number on which changes have been detected correspond to the site number which is presently located in the internal memory. If it has changed, function 1507 transmits the new site number to UPDATE and function 1508 establishes a new site number and a site word. Function 1509 determines the set bit numbers and stacks them. Before completing a discussion of FSP, we will refer to UPDATE (FIG. 15B) to see the manner in which the bit addresses are processed. UPDATE is also inactive, awaiting a signal. When function 1507 transmits, UPDATE is activated and function 1510 actually writes the site table identified at function 1505 into the internal memory. Decision point 1511 determines if the site has an active recall. This merely requires reference to the recall directory and to the word in that directory associated with the site. If there is an active site the routine refers to PRCBA. Before discussing this routine further we will refer to PRCBA which is found in FIG. 16. The first function there, 1600 obtains the entrance element. The reader will recall that the entry in the recall directory, if active, pointed to a block associated with the entrance element which included the entrance element's identification. Thus, the entrance element is identified. Function 1601 gets an element from the route. In this pass this would be the entrance element, although in later passes, subsequent elements will be obtained. Function 1602 gets the bit address for a changed indication and MATCH is operated to attempt to match the changed bit address with the element in the route which we are working with. MATCH is illustrated in FIG. 17. There, decision points 1701, 1702 or 1703 determine the element type. Assuming it is a track element, function 1704 determines the block occupancy bit for this track section and decision point 1705 determines whether or not they match. That is, whether the block occupancy bit address for this track section matches the bit address for the changed indication bit (which was obtained at function 1602). If there is a match, the routine skips to point A where function 1706 sets the match indicator and bit number which concludes the routine. This is, in effect, the successful conclusion for this routine. However, in the case of a track section, it could be a multiply selected track which has two occupancy indication bits. Therefore, if we have not made a match, decision point 1707 determines if this is a dual bit track. If it is not, the routine skips to point B where function 1708 sets the no match indicator and returns. However, if this is a dual bit track, then function 1709 gets the second occupancy bit address and decision point 1710 determines if it matches the change indication bit address. Depending upon the outcome, either function 1706 or 1708 is performed.

If the element obtained at function 1601 was a switch, then decision point 1702 would be responded to positively and function 1711 would get a lock bit. Since a switch has a number of indications, locked, normal or reverse, we check each one of them and that is the function which is performed by functions 1711 through 1716. If at any point a match occurs, the successful completion route is used at point A. And, if no match occurs, further checks are made until all three indication bits are checked. If no match occurs, the routine skips to point B to exit.

Finally, if the element we had obtained was a signal, then function 1717 would get the clear bit address for this signal and decision point 1718 would determine if it matched the changed indication bit address.

In any event, decision point 1603 determines whether or not we have a match. If there was no match with the first element of the route, decision point 1604 determines if we have exhausted the bit addresses. If not, function 1602 gets a new bit address and the same process is repeated, in an effort to match the changed indication bits to the indication bits for the element. If at some point in this process decision point 1604 determines that we have exhausted all the bit addresses, then decision point 1605 determines if we are at the end of the route. If we are not, we get a new element and repeat the process with the new element. If at some point decision point 1605 determines that we have completed that route, decision point 1606 determines if we are at the end of all the routes associated with this site. If not, function 1600 gets a new entrance element and the entire process is repeated. Every time that decision point 1603 determines a match is made, function 1607 deletes the bit address from the buffer and it stacks the identification of this element in a table for SLOT. Decision point 1609 determines if the element is a track section. If not, we return to decision point 1605 to get a new element from the route. If, however, the element was a track, function 1610 stacks this identification for TRACK and we return to decision point 1604.

Thus, PRCBA processes all the changed indications and attempts to match them to one or more of the elements identified in the recall directory associated with the site. At the conclusion of PRCBA, we may or may not have additional bit addresses that have not yet been processed, we may or may not have information stacked in a table for SLOT and we may or may not have information stacked in a table for TRACK.

Decision point 1512 determines if any of the changed indication bits refer eto sites with active Qs. If there are, function 1513 stacks them for the routine PWTBA. Decision point 1514 determines if there are any unknown bits left. Assuming there are not, the routine skips to point B and operates PWTBA. This routine is illustrated in FIG. 18.

PWTBA comprises a number of routines which refer back to themselves. The first one, illustrated in FIG. 8A handles indication changes related to switch indications. The portion of PWTBA illustrated in FIG. 18C handles switch unlocking indication changes, the portion of PWTBA illustrated in FIG. 18D handles signal stop indication changes and the portion of the routine illustrated in FIG. 18E handles signal clear indication changes.

Before discussing the logic of the routine illustrated in FIG. 18A, it will be helpful to understand the normal sequence of operations which occurs when a switch movement call is made. After the call goes out, the first indication to come back is that the switch is no longer in its original position. As yet, the switch has not yet reached its final position. Thus, normally the first pass of this routine would identify the indication changes which are associated with the switch leaving its first position (the uncalled position). The second indication change, handled on the second pass, occurs when the switch comes into correspondence with the called for position.

With that explanation in mind, function 1801 obtains, from the active Q, identification of a switch waiting for correspondence. Function 1802 obtains its called-for indication address. Thus, it if the switch is called normal, function 1802 would obtain the indication bit which is set when the switch is in its normal position. Function 1819 attempts to match that bit address against all the bit addresses which have been stacked for PWTBA. If this were the first pass through this routine for this particular switch, decision point 1803 would not find a match. Function 1805 would get the bit address for the switch's uncalled for position. That is, if the switch were called normal, function 1805 would obtain the bit address for the indication that the switch was in the reverse position. Function 1806 attempts to match the bit address obtained at function 1805 with one of the bit addresses which had been stacked for the PWTBA. Decision point 1807 determines if there is a match. If there is, function 1808 deletes the bit address that had been stacked for PWTBA from the buffer and decision point 1809 determines if the CPMFG flag is set. On this, the first pass through this routine, the flag would not be set and the routine would skip back to point A waiting for further change indication bits for a switch. When the switch, whose movement had been called for, reached its called for position, another indication bit would change. This would result in the bit address for that indication bit being stacked for PWTBA by FSP and UPDATE. On this pass through PWTBA the same functions are performed except that, at decision point 1803, a match would be determined, and function 1804 would set the CPMFG flag. We can also assume that decision point 1807 will not find a match and, when decision point 1809 is reached, the routine will move on since the CPMFG flag is now set. The first succeeding function 1810 is to reset the CPMFG flag and decision point 1811 determines if the position of the switch is equal to its called position. If it is not, the routine moves back to point A and awaits further activity. However, if the switch is now in the called for position, function 1812 decrements the clock count (number of elements waiting on the clock) and decision point 1813 determines if it is zero. This clock is the clock which was started by the routine QMOV or QGCLR. If the clock count is not zero, the routine merely skips to function 1818 to release the high Q block. Since there are other elements waiting on the clock, no further processing is possible. Assuming, however, that the count has reached zero, then decision point 1814 determines if the switch was selected. Of course, at some point in time in order to initiate this whole process of moving the switch, the switch would have had to have been selected. However, at this point in time the operator may have cancelled his switch movement and therefore if the switch is no longer selected and function 1817 stops the clock, then function 1818 releases the clock block.

However, if the switch had been selected, decision point 1815 determines we are operating in the answerback mode. In the answerback mode a signal call will not be transmitted until switch correspondence has been checked. Therefore, if we are in the answerback mode, then function 1816 gets the signal which is associated with this switch and stacks for Q call to make the appropriate entries in a control table for the signal. However, if we are not in the answerback mode, then this function has already been performed, i.e. the control bits for the signal have already been set and function 1816 is unnecessary. Therefore, the porgram merely stops the clock since there are no further elements on the clock and releases the block.

The routine illustrated in FIG. 18C handles switch unlocking indication changes as a result of the operator action. Function 1820 obtains the address of the element block table for this switch. Function 1821 obtains the lock indication bit, that is the address for the bit which indicates the switch is locked and function 1822 attempts to match that bit address against all bit addresses which are remaining for processing. Decision point 1823 determines if there is a match. If there is not, then this portion of the routine is concluded. However, if there is a match, then function 1824 releases the high Q block made for the switch by QPROG, function 1825 decrements the clock count and decision point 1826 determines if it is zero. If it is, function 1827 stops the clock since there are no further elements on the clock. If not, decision point 1828 determines if the switch is in the low Q. If it is, function 1830 releases the block in the low Q and function 1831 stacks the switch element and the request for the executive. This operation would occur where the operator wanted to reposition the switch which was locked. To effect this, he first stopped the signal to unlock the switch and then called the switch position. However, the switch call will not go out and the switch identification will be inserted in the low Q waiting for indication that the switch is unlocked. Thus, when the indication comes back and is processed by PWTBA, function 1831 stacks the switch and the request for positioning the switch for the executive.

However, assuming that the switch was not in low Q, decision point 1829 determines if a signal is in the low Q which is associated with the switch. If there is, the same two functions are performed. If not, the routine merely returns to D and awaits further activity.

The routine illustrated in FIG. 18D handles indication change bits on signals waiting for stop indications. The first function 1832 obtains the address of the element block for the signal from the identification of the signal. Function 1833 gets the address of the indication bit which indicates the signal is clear. Function 1834 matches that address against all available bit addresses. If no match is determined the program moves back to point E and awaits further activity.

However, assuming a match is made, decision point 1836 determines if the signal is now stopped. If it is not, that concludes the routine. If the signal is stopped, function 1837 releases the high Q block and function 1838 decrements the clock count. Decision point 1839 determines if the clock count has reached zero. If it has, function 1840 stops the clock since there are no further elements waiting on the clock. Decision point 1841 determines if the signal is in the low Q. If it is not, the routine moves back and awaits further activity. However, if the signal is in the low Q, indicating that some call is waiting the signal in the stop condition, then function 1842 releases the block in low Q and function 1843 stacks the element and the request for the EXEC for further processing.

The routine for handling changed indication bits from signals waiting for clear is illustrated in FIG. 18E. In that routine function 1844 gets the indication of the signal waiting for clear and function 1845 obtains the bit address for the bit in the indication array which is set when a clear indication signal is received. Function 1846 attempts to match this bit address with all the bit addresses which are stacked waiting for PWTBA processing. Decision point 1847 determines if there was a match. If there was not, the routine skips back to point F and awaits further activity. Decision point 1848 determines if the indication bit is set, indicating the signal is clear. If it is not, the routine again moves back to point F and awaits further activity. However, if the signal is now clear, function 1849 releases the high queue block. Functions 1850, 1851 and 1852 are similar to functions 1825-27 and 1838-40 and are performed for the same reasons. Function 1853 appends this signal and its status to the recall array and function 1854 performs ROUTE.

Figure 15B:
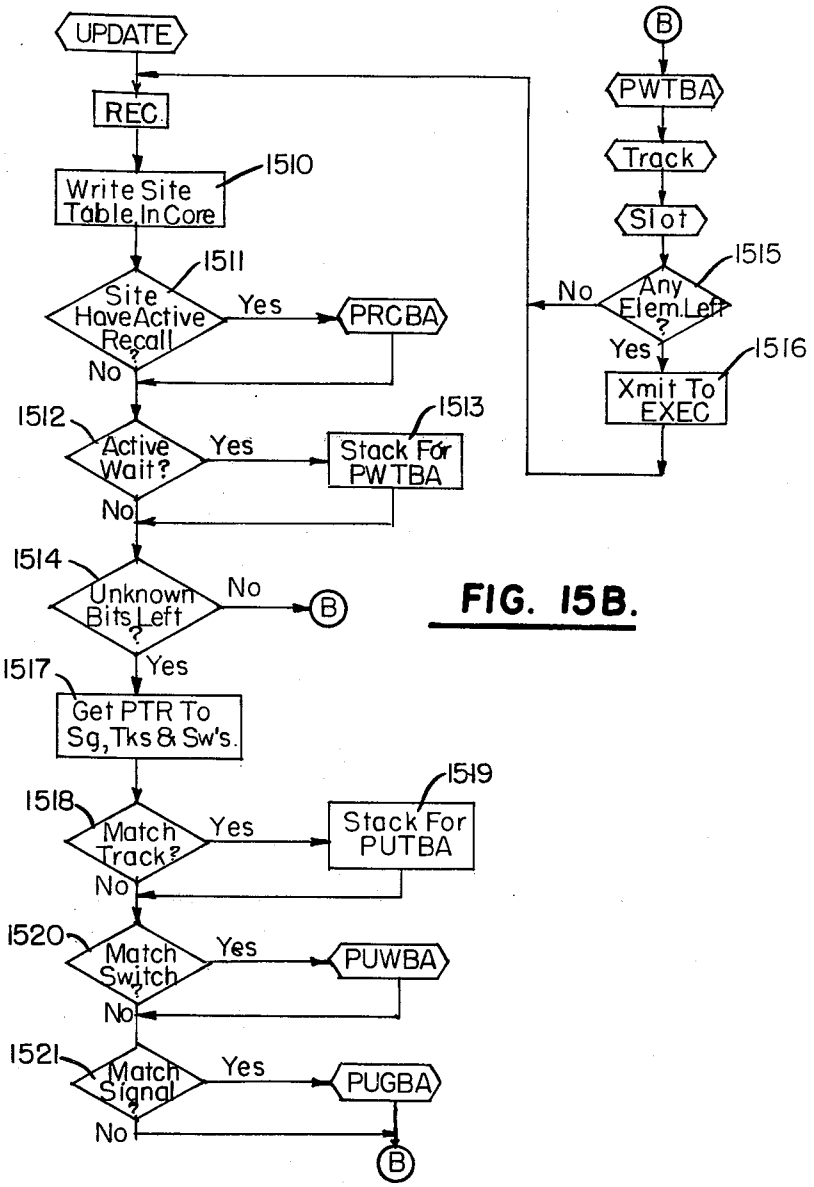
FIG. 15B is a detailed flow chart of UPDATE.
Figures 20A, 20B, 20C:
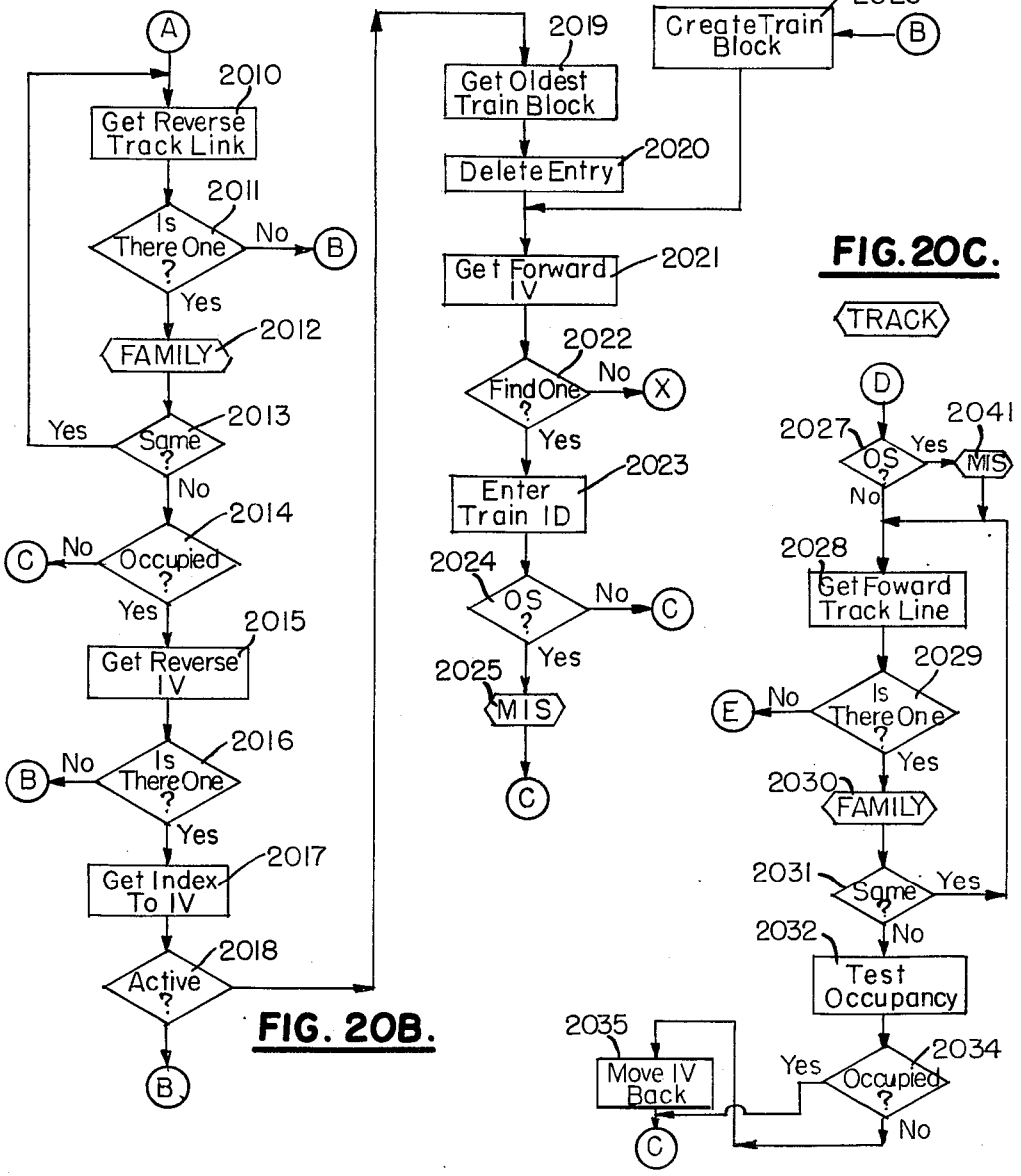
FIGS. 20A, 20B, 20C and 20D comprise a detailed flow chart of TRACK.
Figures 20D, 21, 22:
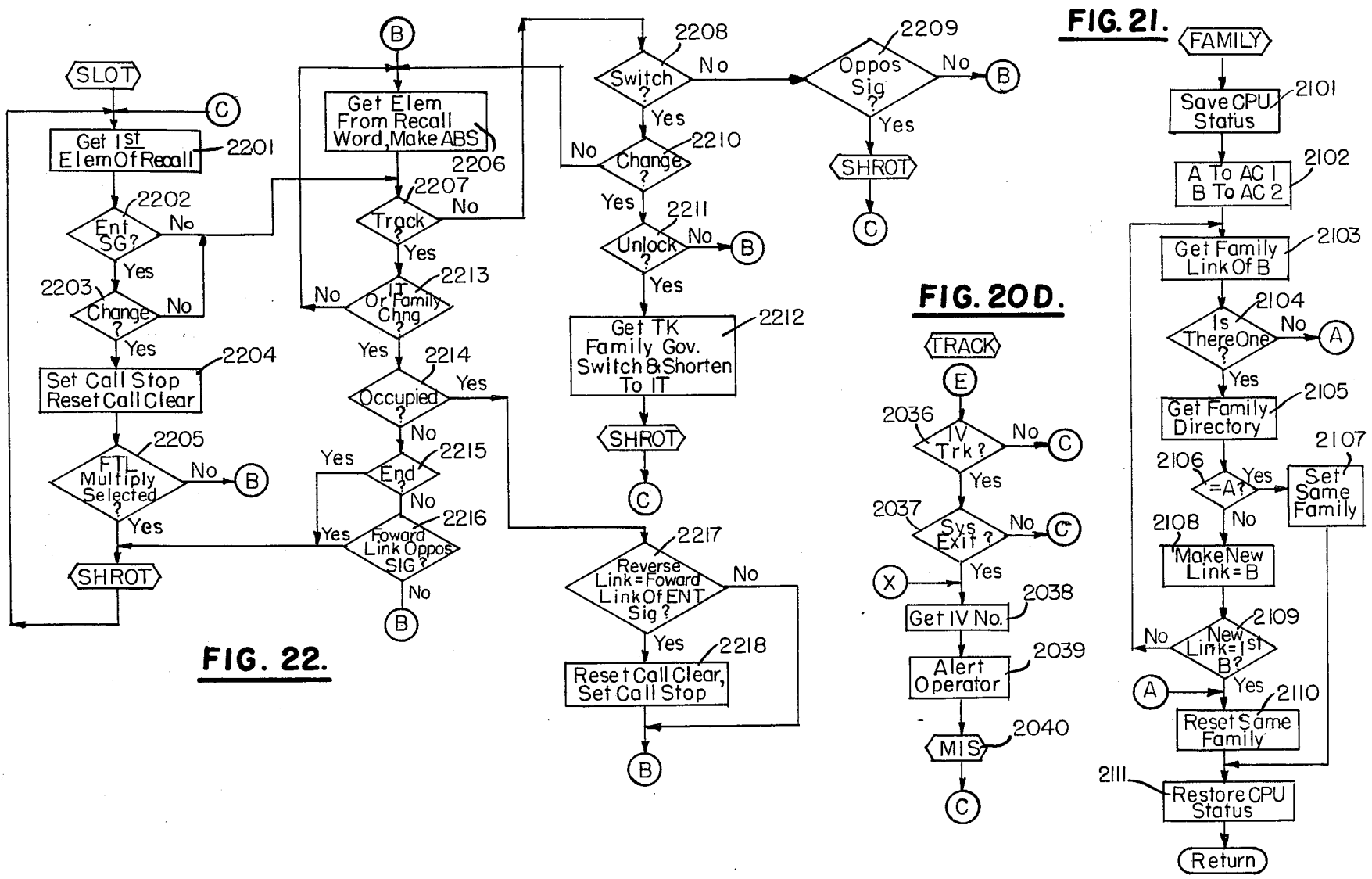
FIG. 21 comprises a detail flow chart of FAMILY.
FIG. 22 comprises a detail flow chart of SLOT.

The operation of PRCBA may or may not have stacked certain elements for the routines TRACK and SLOT. In particular, every change indication in an element in a recall array is stacked for SLOT. Since elements only reach the recall array when they are part of a route which is available, and furthermore since these routes are protected from operator initiated changes, any changes must be the result of train movement. In some cases, when the train has moved completely off an element it is now available for other routes. This is the function SLOT of perform. Furthermore, when the changed indication bits refer to a track occupancy indication this may provide information which is necessary for TRACK. As is illustrated in FIG. 15B, TRACK is first performed. From a brief review of PRCBA (FIG. 16) we see that TRACK has available to it information respecting every track section whose occupancy condition has changed. TRACK is illustrated in FIGS. 20A through 20B, and it also calls on the routine FAMILY which is illustrated in FIG. 21.

Before describing TRACK, we will describe FAMILY which is relied on by TRACK.

FAMILY is passed the identification of two railroad elements and determines if the two elements are of the same family. Some railroad elements, i.e. the track section around the switch, may be separately designated although they are functionally identical. Taking the example we have mentioned above, when a train enters a track section on any link of a switch, indications are received that all sections are occupied. Since the routine TRACK moves from one link to the next to determine how far along the train has moved, there is obviously no purpose in moving from one track section around the track switch to the next since, if any one track section is occupied, the indications will designate they are all occupied. TRACK is, therefore, searching for adjacent links in different families. FAMILY then helps to determine if two adjacent links are in the same family. Whether or not they are can be determined by referring to the element blocks for the different elements as each member of a family refers to another member, and so on in an endless chain. Therefore, function 2101 saves the CPU status and function 2102 separately stores each of the railroad elements which are passed to FAMILY. Function 2103 gets a family link of one of the elements and then decision point 2104 determines if there is one. If there is not, the routine skips from point A to function 2110 which resets the same family indicator to indicate that the two elements passed to FAMILY are not of the same family.

However, if there was a family link of B, function 2105 gets the family directory and decision point 2106 determines if it is equal to A, i.e. the other element passed to the routine FAMILY. If it is, then the two elements passed to FAMILY are of the same family and function 2107 sets the same family flag. However, if decision point 2106 indicated that the family link of B is not the same as A, then function 2108 stores the link of the B family and decisiion point 2109 determines if this new link is equal to the B element which entered the routine. If this were the first pass through FAMILY, this decision point would result in a negative indication. However, as we pass through FAMILY a number of times, we may check each of its elements and finally return to the initial one at which point decision point 2109 would determine that the new link was the same as the original link. When this occurs, it is apparent we have checked each of the elements of the family of B and found none to equal the A element. When that occurs, function 2110 resets the same family flag and then function 2111 restores CPU status and returns. Thus, FAMILY checks the two elements passed to see if they are the same family. If not, the routine checks each of the elements of the family of B against A. If each of the elements are checked without discovering one that is equivalent to A, then we have determined that the two elements originally passed to FAMILY were not of the same family. Thus, FAMILY concludes with the family indicator either set or reset.

For tracking purposes a number of track sections are designated as inventory tracks. Of course, if desired, all track sections could have this capability. For each inventory track section a block of memory space may be allocated. In this block of memory space is written the identification of any trains which are currently occupying that track section. As trains move along through the territory, their designation is likewise moved into the appropriate track section inventory blocks. The routine which accomplishes this function is TRACK. Since a number of ostensibly different track sections are all members of the same family, all of whose indication bits change simultaneously, TRACK employs FAMILY to determine if a track section whose indication bit changes to occupied is or is not a member of the same family as another track section whose indication bit has also changed. The running of PRCBA stacks the track identification of bit addresses whose indications have changed. Thus, TRACK is entered with a list of indication table addresses whose occupancy bits have changed. The routine TRACK will be traversed twice for each track section in the route. The first time TRACK is entered occurs when a track section in the route goes occupied. The routine is also entered when the same track section goes unoccupied.

Function 2001 gets the route changed elements and saves pointers. Function 2002 gets the entrance element, which is available from the entry in the recall directory for this site. The recall directory actually contains a pointer to the recall block which includes the address for the element block of this element. With this address, decision point 2003 determines if this is or is not a signal. Assuming it is, function 2004 gets the forward link. This forward link normally would be the first track section in the route. Decision point 2005 determines if there is one, and if there is, function 2006 compares the bit address for the occupancy indication bit for the section with the bit address of a changed element. Decision point 2007 determines if the indication has changed. If it has, function 2008 tests the occupancy of the track section and decision point 2009 branches depending whether or not the section is occupied. Assuming it is occupied, function 2010 gets the reverse track link. This is the immediately preceding track section. Decision point 2011 determines if there is one. If there is, FAMILY is operated and with the results decision point 2013 determines if the reverse track link is of the family as the forward link. If it is, functions 2010, 2011, and 2012 are run again until a reverse track link is obtained which is not of the same family. Decision point 2014 determines if that track section is occupied. If it is, function 2015 gets the reverse inventory track location. Decision point 2016 determines if there is one and if there is, function 2017 gets the index to the inventory track. Decision point 2018 determines if it is active, i.e. are there entries at that location? If there are, function 2019 gets the oldest train block and function 2020 deletes this entry. Thus, the train which has caused the indication bits to change has now had its identification deleted from the reverse inventory track. Function 2021 obtains the forward inventory track and decision point 2022 determines if one is found. It it was, function 2023 enters this train's identification in the forward inventory track. Now, the moving train's indication has been moved forward one inventory track section. Decision point 2024 determines if this new track is an operating section, one whose occupancy is to be reported. If it is, function 2025 generates a call to the management information system to generate a report.

The next time this same track section occupancy indication will change is when the train clears the track section. At this point, after performing functions 2001 through 2008, decision point 2009 will determine that the track section is not occupied. The routine then skips to point B (FIG. 20C).

Decision point 2027 determines if this is an operating section on which MIS reports are desired. If it is, function 2041 calls the MIS system to generate such a report. Function 2028 gets a forward track link, i.e. the next track section in the direction of the route. Decision point 2029 determines if there is one and functions 2030 and 2031 determine if the forward link is of the same family. If it is, functions 2028 through 2031 are repeated until the next forward track section is discovered which is not of the same family. Function 2032 determines the occupancy of that track section and decision point 2034 branches the routine to point C if the section is occupied and to function 2035 if it is not. In effect, the first track section in the route has become unoccupied. Decision point 2034 then determines whether the train has moved forwardly or backwardly. If the train has moved forwardly, the next track section would be occupied. However, if the next section is not occupied, then the train must be moving backwardly and, therefore, function 2035 moves the inventory designation back.

As we will see in discussing SLOT and SHROT, as the elements which were included in the route become released when the recall directory is modified to in effect shorten the route. Therefore, the entrance element of the route may not always be a signal. Thus, when decision point 2002 gets an entrance element, it may not be a signal. If that is the case, functions 2042 through 2045 will be performed. In particular, function 2045 gets the last track block of the route. Decision point 2042 determines if there is one, decion point 2043 determines if it has changed and decision point 2044 determines if it is now occupied. These particular functions will be performed every time an element in a route whose entrance is not a signal changes indication. At some point, the last track block of the route will go unoccupied and the routine will skip to point E. Decision point 2036 will determine if this is an inventory track and if it is, decision point 2037 will determine if this the system exit. If it is, function 2038 will get the inventory number and function 2039 will alert the operator that a particularly identified train is leaving the system.

The operator may also be alerted if the routine is unable to find a forward inventory track. In that case, decision point 2022 (FIG. 20B) skips to point X.

Another instance in which operator assistance is required is when the routine is unable to find a reverse track link (decision point 2011 - FIG. 20B). In this case function 2026 creates a train block and the operator is required to supply an identification designation for this train block which then entered in the forward inventory track section by function 2021.

Thus TRACK monitors the changing status of the occupancy indications for the different track sections and moves train identification designations in accordance with the movement of a train which causes the occupancy indications to change. It should also be apparent that the system is not limited to merely forward movement, but can react properly if the train moves backwardly as well.

Figure 23:
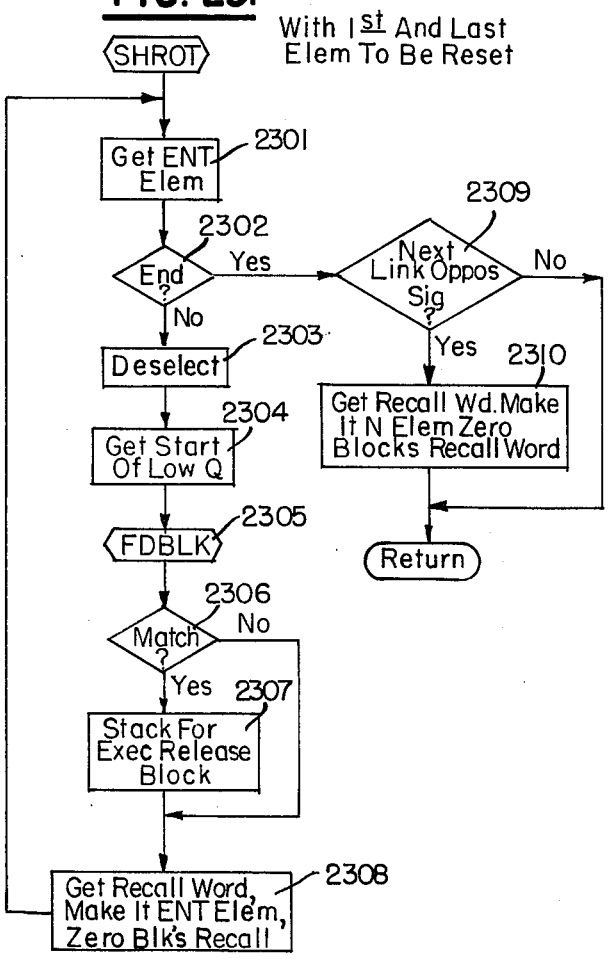
FIG. 23 comprises a detail flow chart of SHROT.
Figure 24:
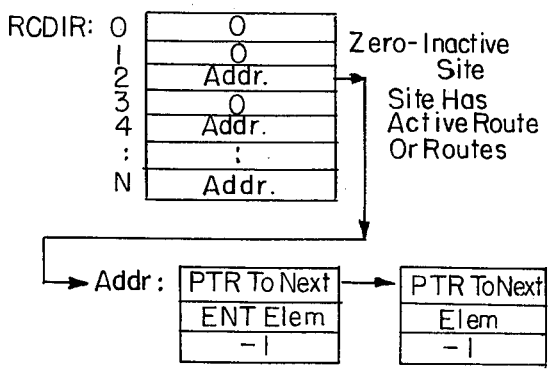
FIG. 24 is a schematic representation of a recall directory.
Figure 25:
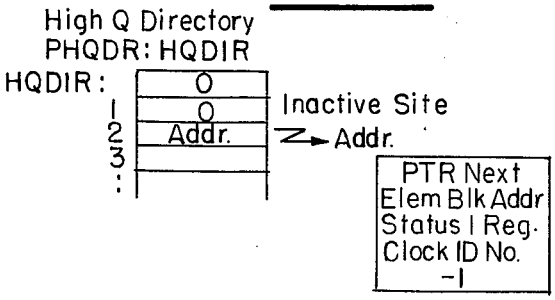
FIG. 25 is a schematic representation of a high Q directory.
Figure 26:
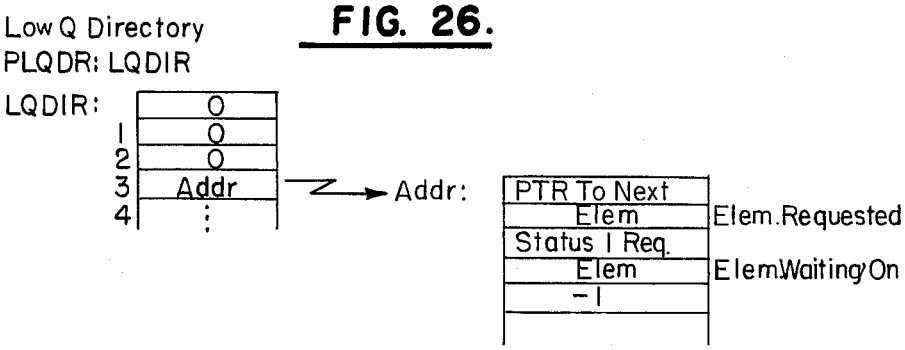
FIG. 26 is a representation of a low Q directory

As directed by UPDATE (FIG. 15B) after TRACK is performed SLOT is run. SLOT is illustrated in FIG. 22. A brief reference to that figure will show that SLOT relies on SHROT to shorten any particular route. SHROT is illustrated in FIG. 23.

SHROT is entered with the first and last elements of a route which can now be deselected and thus made available for other routes. The manner in which this information is supplied will become clear when we discuss SLOT. Function 2301 obtains the entrance element, i.e. the first of the two elements which we are supplied with. Function 2302 compares the first with the last, if there is a match, that is the end and otherwise function 2303 is performed to deselect the first element. This merely requires resetting its bit in the select table. Function 2304 gets the start of the low Q table and function 2305 attempts to find the block corresponding to that element. Decision point 2306 branches the program. If we were able to match a low Q element with the element which has just been deselected, function 2307 stacks the low Q entry for the executive and releases the low Q block. If there was no match, then function 2308 gets the recall word for the element which has just been deselected. That recall word will contain the link to the next element of the route, and function 2308 makes this new link the entrance element and zeros the block's recall word, i.e. the first element with which we entered this program has its recall word set to zero. Functions 2301 and 2302 are performed to determine if we have handled all elements in the route. If we have not, functions 2303 through 2306 are again performed. At some point, the element with which we are working will equal the last element to be reset. At that point, decision point 2309 determines if the next link is an opposing signal. If it is not, that concludes the routine. If the next link is an opposing signal, function 2310 gets the recall word (to get the next link), makes it an entrance element, zeros the recall word or the last block of the route and then returns.

Thus SHROT acts to deselect the first and last elements of a route which can be released, and all elements therebetween and also zeros the recall word for each of those elements and makes the next element, the one which cannot yet be released, the new entrance element of the route. These functions are employed by SLOT, as shown in FIG. 22.

The function 2201 gets the first element of the recall directly and decision point 2202 determines if this is a signal. If it is, decision point 2203 determines if it has changed. If it has, function 2204 sets the call stop and resets the call clear. This action merely follows the action that has already taken place in the field by reason of the field circuits. Decision point 2205 determines if the forward track link is multiply selected. If it is not, function 2206 gets the element from the recall word. That is, the identification of the element beyond the signal in this route. Decision points 2207, 2208 and 2209 then determine from the definition word for this element whether it is a track switch or signal. If it is a signal, SHROT is operated and we perform the same functions for the next route. If it is a switch, decision point 2210 determines if it has changed and decision point 2211 determines if it is now unlocked. If the element is a switch, if its indication has changed and if it is now unlocked, then function 2212 gets the track family governing the switch and shortens to it via SHROT. If the switch indication has not changed, or if it has changed but the switch is not unlocked, then the routine moves back to point B. At point B, function 2206 gets the element from the recall word and again decision points 2207, 2208 and 2209 determine if the element is a track switch or signal. If it is a track, function 2213 determines if it or its family has changed. Decision point 2214 determines if it is occupied and decision point 2215 determines if we are at the end of the route. If the element was a track, and it or its family indications have changed, and it is not occupied and we are at the end of a route, then SHROT is operated. Even if we are not at the end of the route but if decision point 2216 determines that the forward link is an opposing signal, then SHROT is also operated. If the forward link is not an opposing signal, then the program loops back to point B.

However, if the track section was still occupied, decision point 2217 determines if the reverse link is equal to the forward link of the entrance signal. If it is, then function 2218 resets the call clear, sets the call stop and loops back to point B.

In effect, SLOT begins at the entrance of a route, identifies all the track sections in it and when it identifies all the unoccupied track sections, it manipulates the control tables for signals and operates SHROT to deselect all the intervening elements and resets the recall words for those elements.

Now that we have discussed PWTBA, TRACK AND SLOT, we can return to FIG. 15B and complete the discussion of UPDATE. At the conclusion of SLOT, decision point 1515 determines if there are any unprocessed bit addresses left. If not, the routine concludes and awaits further information. If there are, function 1516 XMIT's to the EXEC, with this information.

In our original pass through update, we had assumed that at decision point 1514 there were no unknown bits left. However, there may well be. In that case function 1517 gets a pointer to the first signal, the first track and the first switch in the site. It will be recalled that this information is available from the site control table. Decision point 1518 then attempts to match the changed indication bits with the first track section in the site, failing this the next track section in the site, and so on until the routine has attempted to match each track section in the site with the indication bit addresses. If any are found, function 1519 stacks them for PUTBA (process unknown track bit addresses).

Decision point 1520 then performs the same function with switches and calls PUWBA (process unknown switch bit addresses) if any are found. Finally, decision point 1521 attempts to match the changed indication bit addresses with the indication bit addresses for the first and succeeding signals in the site. If any are located, PUGBA (process unknown signal bit addresses) is run. At the conclusion of this schedule, the routine jumps to point B to then run PWTBA, TRACK and SLOT.

The routines PUGBA and PUWBA are not illustrated in detail. In effect, each of these routines attempts to match changed indication bit addresses which have not been specifically identified, with the indication bit addresses for either the switch indication bits (PUWBA) or signal indication bits (PUGBA). If any matches are made, an appropriate error report is made. If no match is made, no other steps are taken.

Figure 12:
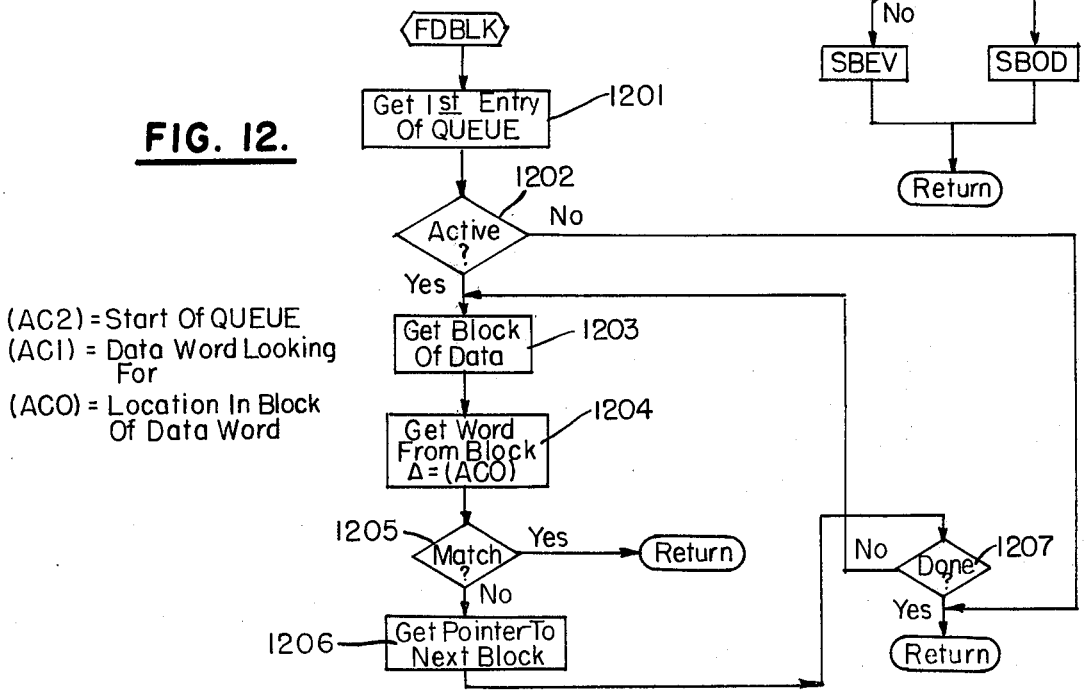
FIG. 12 is a detailed flow chart for FDBLK.
Figure 13B:
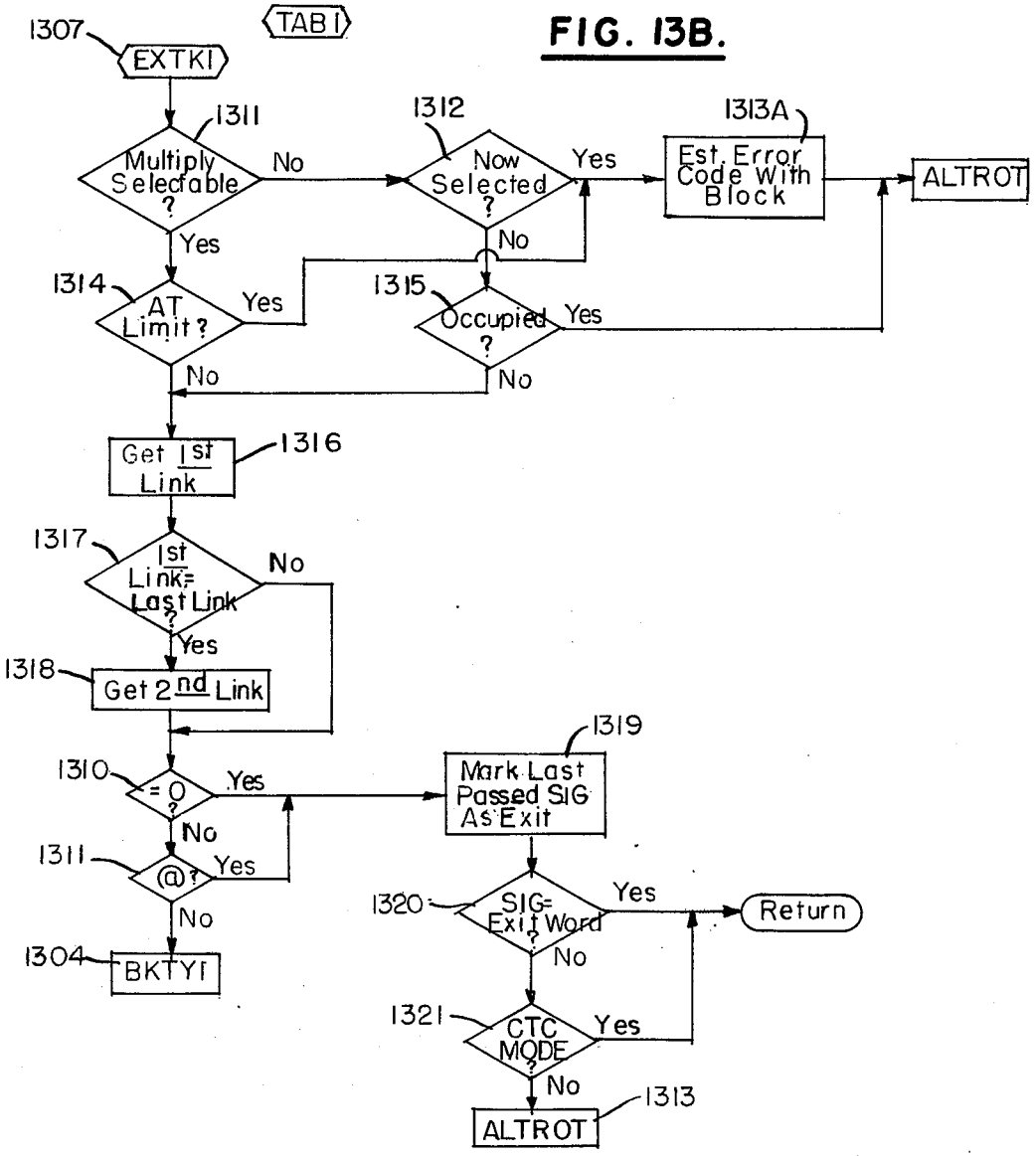
Figure 13A:
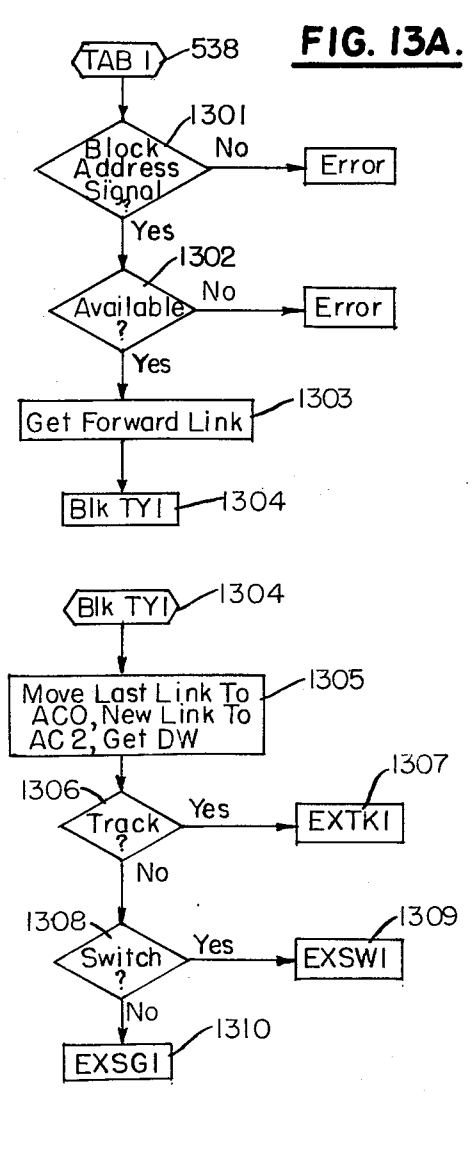
Figure 13D:
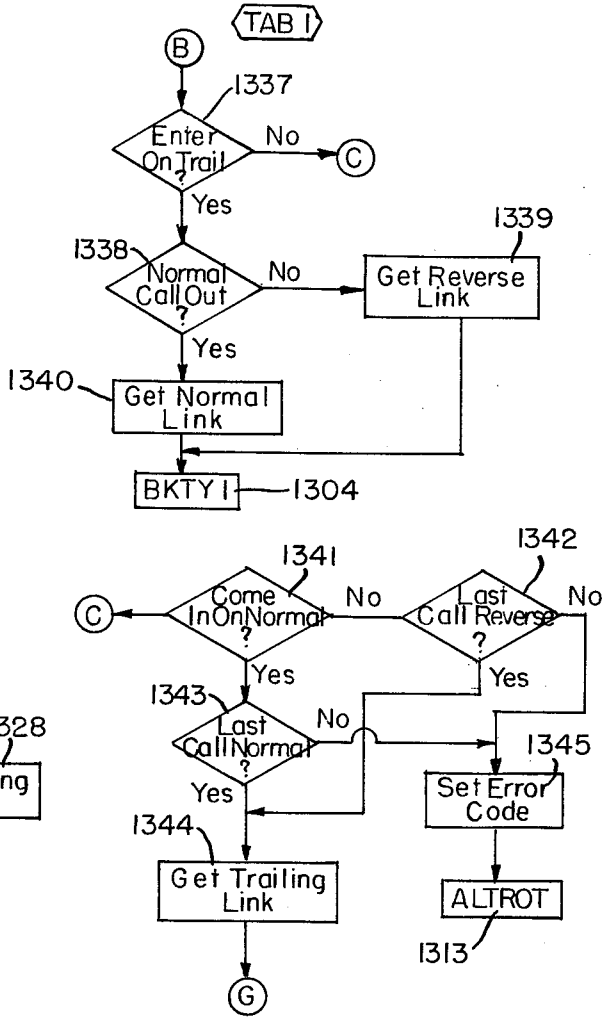
Figure 13C:
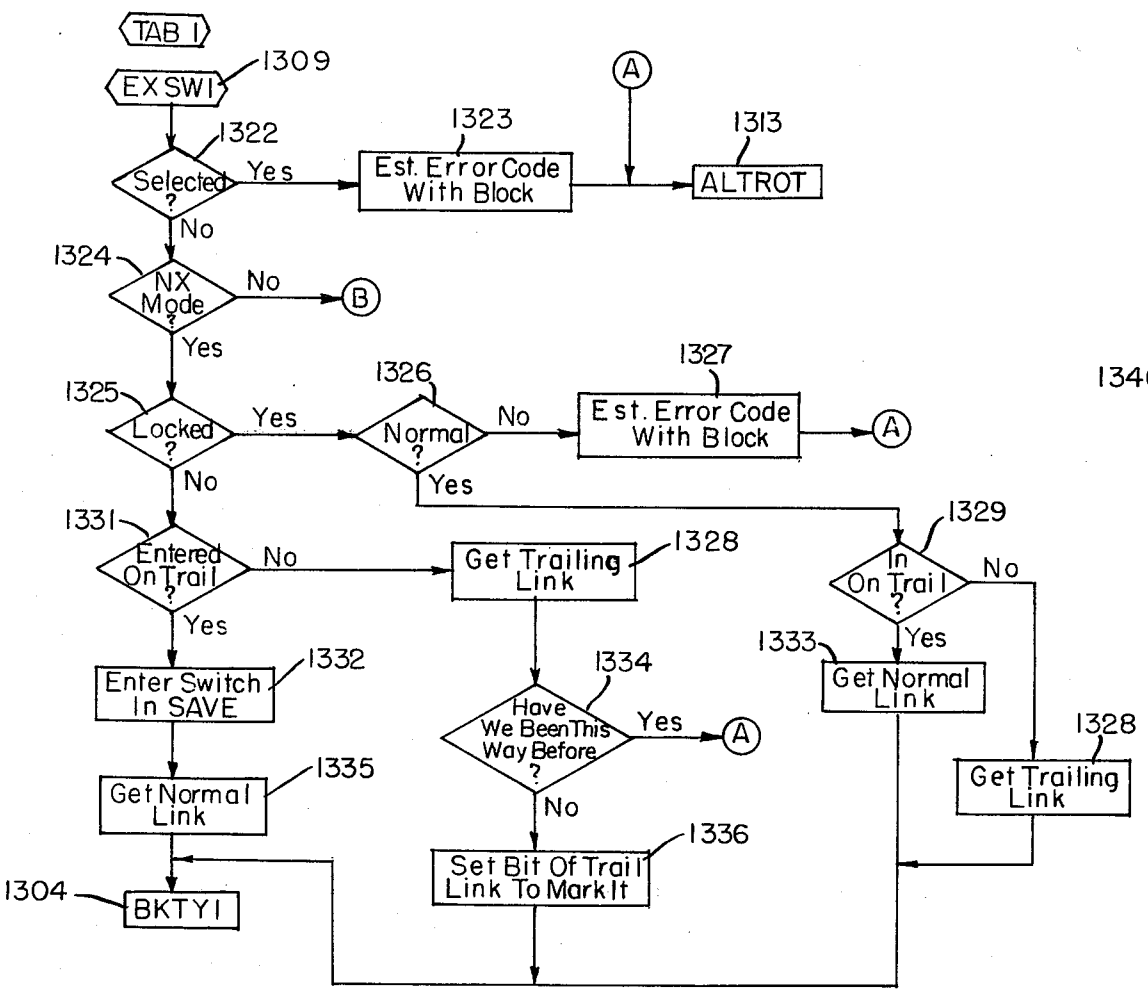

A number of the routines discussed above included a subroutine FDBLK (find a block). Since much of the data on which the system operates is included in queues whose length may vary, this routine is helpful in locating or determining the absence of an entry in a queue related to a particular element or clock. The functions of this subroutine are illustrated in FIG. 12. Before discussing it in detail, it should be noted that this routine is not entered until we have identified three specific items of information. First, the address of the start of the queue, which address is inserted into a specified location in the computer. The second item of information is the data word we are looking for, this may be the designation of a particular element or the designation of a particular clock. Finally, the third element of information is the location in the block of the data word we are looking for, such as the second word, third word, etc.

With that information, function 1201 obtains the first entry of the queue and decision point 1202 determines if it is active. If it is not active, it concludes the routine. However, if the Q us active, then function 1203 gets the first block of data which forms the first entry in the Q. Function 1204 isolates the specific word in the block that we are interested in, i.e. word two, word three, etc. Decision point 1205 determines if we have matched the word we have selected with the data word we are looking for. If so, the routine is concluded. If not, function 1206 gets a pointer to the next block in the Q and decision point 1207 determines if we are done. Each Q includes an indication, at its start, of its length. With this length indication, we can determine, at decision point 1207, if we have run through the Q. If not, the routine moves back to function 1203 and we begin again. If we either match what we are looking for or run through the entire Q, then we have completed the routine. Other routines which are employed by a number of the routines in this system include GCLK (get a clock), STCLK (start a clock) and SPCLK (stop a clock), illustrated in FIGS. 7, 8 and 9 respectively.

Dealing first with FIG. 7 which illustrates GCLK, this routine is referred when it is necessary to attach a timer to an entry in the high Q. Decision point 701 determines if a timer is already available on another element in this route. If it is, function 704 merely obtains the contents of the location CLKWD. This gives the address for the block which includes the number of elements already on the timer, the site identification and the identification of the timer. In this situation, that concludes the routine. However, assuming the timer has not been obtained, function 702 gets a medium block and function 703 inserts a dummy word into the first word location of a block and stores the address of the next word at CLKWD. Then, function 704 gets the contents of CLKWD that is the identification of the block and returns.

FIG. 8 shows the routine STCLK (start a clock). function 801 gets the contents of CLKWD and uses it as an address. Function 802 formats the address of what is now CLKID and the present time and calls a subroutine INTVS (interval timers start). With the information provided at function 802, INIVS initiates the timer.

FIG. 9 shows SPCLK (stop a clock). Function 901 obtains the timer ID which is located at CLKID plus 2. The subroutine INTVK (kill a timer) then provides the necessary timer stopping function. Function 903 gets CLKID minus 1 which is the actual start of the block and CAERO in effect releases the block for it is not longer necessary. That concludes the routine.

Now that we have completed discussing FSP and associated routines, we can return and explain NCXOO (function 413, FIG. 4A, shown in detail in FIG. 4C). During the EXEC processing, NCS is performed, after the site table has been transferred into the internal memory and after the site's control table has been copies by GCNTB. The function of NCXOO is to determine if there are any routes which were waiting on elements in which each of the elements is now available. Function 440 gets a model of the code for this situation. This would be available in the FSP buffer, written into by PWTBA. Function 418 searches for a match and decision point 441 branches on the result. If none is found, the routine is concluded. However, if one is found, function 442 stacks the route for QCALL. No further EXEC processing is required for this route, and if there is no further business, we can go directly to QCALL.

Now that system operation has been explained with respect to operator CTC or NX requests, we have a framework with which to discuss the passing operation. A passing move is accomplished by routing one train onto a siding over a first reversed switch. Routing the main line or preferred train past the siding over first and second switches normal and then allowing the train on the siding to reenter the main line by routing it over the second switch reversed. There are clearly three routes involved, and each conflicts with at least one other route. In particular, the second route conflicts with the first, and the third conflicts with the second. The system of our invention would allow the operator to key in these routes in the NX mode. The first route would be set up and the second would be held in the low Q. When the train cleared the first route, the second would be set up by the system and so forth.

However, by merely storing three NX commands, the operator may key in a pass by merely reading out the stored commands and causing them to be executed by the executive. In the case of a site with only one siding, only the site need be identified along with the pass request. For sites at which there are a plurality of sidings, the operator would also have to designate the desired siding by keying in an entrance signal.

What we claim is:

1. A control system for operating track switches and signals of a railroad comprising a plurality of railroad elements including:

a central office from which controls are transmitted to a plurality of field stations over a communication channel and at which indications are received from said field stations indicative of field conditions, means for designating control requests, digital computer means responsive to said control requests and to said indications, said digital computer means including means for storing and retrieving a. dynamic data including indications definitive of the condition of the said railroad elements and the controls for said railroad elements, and b. static data definitive of each of said railroad elements, the relationship between said elements and the location of dynamic data related to each said element, processor means included in said digital computer means for accepting said control requests and for interrogating said portions of said dynamic data storage in a sequence determined by said control requests and by said static data, said processor means providing updated controls corresponding to said control requests for transmission to said field stations only if said control requests are determined to be valid by said processor means.

2. The apparatus of claim 1 in which said means for designating is capable of designating CTC type requests in which a control request is provided for each track switch or track signal which is required to change or NX type of requests in which an entrance and exit location are specified, said processor means including executive means for determining which type of requests has been designated and including, NX processor means responsive to said executive means for generating pseudo CTC type control requests to implement said NX requests and for determining the validity of said NX control requests, and CTC processor means responsive to said executive for determining the validity of said CTC control requests.

3. The apparatus of claim 2 which includes queue management means responsive to a determination of a valid route for storing a representation of said route including identification of each element thereof in a high Q storage means, timing means, means for initiating said timing means contemporaneous with the transmission of said updated controls, means responsive to receipt of indications verifying effectiveness of said controls for deleting said representation from said high Q storage means.

4. The apparatus of claim 3 in which said queue management means includes means for storing a representation of said route in a recall storage means on deletion of said representation from said high Q storage means.

5. The apparatus of claim 1 which includes queue management means responsive to a determination of a valid route for storing a representation of said route including indentification of each element thereof in a high Q storage means, timing means, means for initiating said timing means contemporaneous with the transmission of said updated controls.

means responsive to receipt of indications verifying effectiveness of said controls for deleting said representation from said high Q storage means.

6. The apparatus of claim 5 which includes means responsive to the expiration of said timing means without receipt of indications verifying the effectiveness of said controls for deleting each element from said high Q means.

7. The apparatus of claim 5 in which said queue management means includes means for storing a representation of said route in a recall storage means on deletion of said representation from said high Q storage means.

8. The apparatus of claim 4 in which said NX processor means includes means for determining that at least one element of said route between said designated entrance and exit locations is common to another active route, said queue management means including means for storing a representation of said route along with data definitive of said common element in a low queue storage means.

9. The apparatus of claim 8 which includes means responsive to the receipt of indications to the effect that said common element has been cleared for searching said low queue storage means for an entry related to said element, said queue management means including means responsive for said last named means for providing updated controls in response to a control request which was not valid when made but which is valid in light of said indications.

10. The apparatus of claim 1 in which said processor means includes, first means responsive to operation of said means for designating a valid entrance and exit location of a route to determine if said exit location is achievable from said entrance location, second means responsive to operation of said first means to select each element in said route and store data linking each one of said elements to an adjacent element, routing means responsive to said second means for identifying each track switch in said route which must be moved and for distinctively conditioning a control for such track switch to move said track switch, means for identifying each track signal in said route for distinctively conditioning a control for such track signal to clear each such track signal.

and control means responsive to said conditioning for controlling each track switch and track signal in response to said controls.

11. The apparatus of claim 10 in which said first means interrogates said static data storage to determine the identity of a first railroad element adjacent said entrance location and then interrogates said static data storage to determine the identity of another railroad element adjacent said first railroad element until said first means identifies said exit location or determines that said exit location cannot be reached.

12. The apparatus of claim 10 in which said second means interrogates said static data storage and identifies a first railroad element adjacent said exit location in the direction of travel towards said entrance location and then interrogates said static data storage and identifies another railroad element adjacent said first railroad element in said direction until said entrance location is identified.

13. The apparatus of claim 12 in which said second means, upon identifying a switch, interrogates said static data storage to determine a preferred condition of said switch and interrogates said static data storage to determine an undetermined railroad element adjacent to said switch in said preferred condition.

14. The apparatus of claim 10 in which said first means in identifying an element common to said requested route and another active route, stores data representative of said common element along with a representation of said requested route, queue management means responsive to last named storage for storing said data in a low queue storage means.

15. The apparatus of claim 14 in which further includes, indication responsive means responsive to indications enabling slotting of said common element for searching said low queue storage means and for conditioning appropriate of controls for said requested route.

16. The apparatus of claim 1 in which said static data includes individual storage means for each railroad element which has stored therein identical information in the identical order for each element of identical type, and a pair of storage means for storing routing data indicating preferred and alternative conditions for each track switch.

17. The apparatus of claim 16 in which each individual storage means for a track section identifies, a. the individual storage means for the next track section, b. individual storage means for all directly adjacent elements on either side of said track section, c. a storage area indicating the status of said track section.

18. The apparatus of claim 16 in which each individual storage means for a track signal identifies a. the individual storage means for the next track signal, b. individual storage means for all element directly adjacent said track signal, c. a storage area indicating the status of said track signal, and d. a storage area representing the control for said track signal.

19. The apparatus of claim 16 in which each individual storage means for a track switch identifies, a. the individual storage means for the next track switch, b. individual storage means for all elements directly adjacent to said track switch, c. a storage area indicating the status of said track switch, d. a storage area representing the control of said track switch, and e. a location of data defining preferred and alternative conditions of said switch in said pair of storage means.

20. In a control system including a central station and a plurality of field stations for operating the track switches and signals of a railroad in which digital computer means at said central station responds to operator entered requests for verifying the validity thereof in light of actual field conditions before transmitting controls corresponding thereto to field locations, apparatus for accepting and operating on conflicting control requests without requiring further operator intervention comprising, first means responsive to a control request for a first route for determining the validity thereof including means for identifying each separate element in said route, means for determining if each such element is available and for storing data linking each such identified element of a route to another such element, means for storing data indicating said element is included in an active route and for storing appropriate controls for transmission to clear said first route, said first means responsive to a second request for determining at least one common element of said second route is included in another active route for storing data definitive of said route along with the data definitive of said common element, indication responsive means responsive to the receipt of indications releasing said common element for retrieving said data definitive of said second route and for conditioning appropriate controls for transmission to clear said second route.

21. The apparatus of claim 20 in which said first means includes means for interrogating data definitive of said railroad configuration for determining if said route is achievable, and error means responsive to said first means determining that said route is not achievable for preventing said first means from storing controls for any portion of said requested route.

22. The apparatus of claim 20 in which said first means includes second means, upon identification of a track switch, for directing said route across said switch in a first predetermined condition, third means for determining that a requested route is not achievable with said track switch in said predetermined condition for again identifying said track switch and for directing said route across said track switch in a second predetermined condition.

23. The apparatus of claim 22 which includes a first directory means including data for each track switch defining said first predetermined condition, said second means interrogating said first directory means for determining said first predetermined condition.

24. The apparatus of claim 23 which further includes a second directory means including data for each track switch for defining said second predetermined condition, said third means interrogating said second directory means for determining said second predetermined condition.

25. In a control system including a control station and a plurality of field stations for operating the track switches and signals of a railroad in which digital computer means at said control station responds to operator entered requests for verifying the validity thereof in light of actual field conditions before transmitting controls corresponding thereto to field locations, apparatus for determining positioning of a track switch based on a requested route including entrance and exit locations, first means for identifying a particular switch as included in said route, preferred table means designating a preferred position of said switch in said route, and means for interrogating said table means to determine said preferred switch position.

26. The apparatus of claim 25 which further includes default table means designating an alternative position of said switch in said route, means responsive to said requested route and to said preferred switch position for determining if current field conditions allow such route, and means for interrogating said default table means if said last named means indicate that said route is not achievable with said switch in said preferred position.

27. The apparatus of claim 26 which includes means for transmitting controls to position said particular switch.

28. The apparatus of claim 25 which includes means for transmitting controls to position said particular switch.

* * * * *